US011427011B2

(12) United States Patent
Ozeki et al.

(10) Patent No.: US 11,427,011 B2
(45) Date of Patent: Aug. 30, 2022

(54) MANUFACTURING METHOD OF LIQUID STORAGE BODY AND RESTORED LIQUID STORAGE BODY

(71) Applicant: SEIKO EPSON CORPORATION, Tokyo (JP)

(72) Inventors: Hiroyoshi Ozeki, Shiojiri (JP); Takumi Nagashima, Matsumoto (JP); Manabu Yamaguchi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 552 days.

(21) Appl. No.: 16/412,246

(22) Filed: May 14, 2019

(65) Prior Publication Data

US 2019/0352053 A1 Nov. 21, 2019

(30) Foreign Application Priority Data

May 15, 2018 (JP) ..... JP2018-093409

(51) Int. Cl.
*B41J 2/175* (2006.01)
*B41J 29/13* (2006.01)

(52) U.S. Cl.
CPC ..... *B41J 2/17559* (2013.01); *B41J 29/13* (2013.01)

(58) Field of Classification Search
CPC ..... B41J 2/17559
See application file for complete search history.

(56) References Cited

U.S. PATENT DOCUMENTS

| | | | |
|---|---|---|---|
| 8,220,909 | B2 | 7/2012 | Domae |
| 9,162,466 | B2 | 10/2015 | Nagashima et al. |
| 9,902,159 | B2 | 2/2018 | Hatano et al. |
| 2018/0043694 | A1 | 2/2018 | Toya et al. |
| 2018/0043695 | A1 | 2/2018 | Kawate et al. |
| 2018/0104955 | A1* | 4/2018 | Kawate ..... B41J 2/17556 |
| 2019/0352053 | A1 | 11/2019 | Ozeki et al. |

FOREIGN PATENT DOCUMENTS

| | | | |
|---|---|---|---|
| CN | 210126353 | U | 3/2020 |
| JP | 2004-358802 | A | 12/2004 |
| JP | 2007-145032 | A | 6/2007 |
| JP | 2009-279876 | A | 12/2009 |
| JP | 2015-074103 | A | 4/2015 |
| JP | 2017-043054 | A | 3/2017 |
| JP | 2018-024195 | A | 2/2018 |
| JP | 2018-027680 | A | 2/2018 |
| JP | 2018-065373 | A | 4/2018 |
| JP | 2018-065374 | A | 4/2018 |
| JP | 2019-198990 | A | 11/2019 |

* cited by examiner

*Primary Examiner* — Jason S Uhlenhake
(74) *Attorney, Agent, or Firm* — Oliff PLC

(57) ABSTRACT

A manufacturing method of a liquid storage body includes: preparing a pre-restored storage body that has a bag to which a connection member is attached, and that is thereby sealed, the connection member being provided with a liquid outlet port, a storage-body-side electrical connection portion, a first receiving portion that receives a first positioning portion, and a second receiving portion that receives a second positioning portion; forming a communication portion that is in communication with the internal space of the bag by processing the bag; injecting a liquid from the communication portion into the internal space of the bag; and closing the communication portion so as to seal the bag.

3 Claims, 38 Drawing Sheets

MANUFACTURING METHOD OF LIQUID STORAGE BODY AND RESTORED LIQUID STORAGE BODY

The present application is based on, and claims priority from JP Application Serial Number 2018-093409, filed May 15, 2018, the disclosure of which is hereby incorporated by reference herein in its entirety.

BACKGROUND

1. Technical Field

The present invention relates to a liquid storage body.

2. Related Art

Heretofore, liquid storage bodies that are detachably attached to a liquid ejection apparatus, and supply liquid have been widely used. For example, liquid storage bodies disclosed in JP-A-2009-279876, JP-A-2017-43054, and JP-A-2018-027680 have a flexible bag, which contains a liquid to be supplied to a liquid ejection apparatus. Such liquid storage bodies may include, in addition to the bag, a large number of various constituent parts such as a member that is coupled to the liquid ejection apparatus, and forms a supply path of liquid, and an electrical part that is electrically coupled to the liquid ejection apparatus, and enables communication of electrical signals.

JP-A-2009-279876, JP-A-2017-43054, and JP-A-2018-027680 are examples of related art.

Usually, the above-described liquid storage body is removed from the liquid ejection apparatus and is replaced with a new one, when the residual amount of the liquid contained therein decreases below a predetermined lower limit amount. Heretofore, there have been cases where, although the above-described various constituent parts can still be used, liquid storage bodies used and removed from a liquid consumption apparatus are discarded in this state.

SUMMARY

One aspect of the present disclosure is provided as a manufacturing method of a liquid storage body. A direction parallel to a gravity direction is defined as a Z direction, in which a direction that is the same as the gravity direction is defined as a +Z direction and a direction that is opposite to the gravity direction is defined as a −Z direction, a direction orthogonal to the Z direction is defined as a Y direction, in which one direction is defined as a +Y direction and another direction is defined as a −Y direction, and a direction orthogonal to the Z direction and the Y direction is defined as an X direction, in which one direction is defined as a +X direction and another direction is defined as a −X direction. The liquid storage body is attachable/detachable to/from a liquid ejection apparatus that includes a case storage portion, a case inserted into the case storage portion by moving toward the +Y direction, a liquid introduction portion positioned in an end portion on the +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion. The liquid storage body includes a flexible bag that contains a liquid, and a connection member positioned in an end portion on the +Y direction side of the bag in a mounted state where the liquid storage body is mounted in the liquid ejection apparatus. The connection member is provided with a liquid outlet port that receives the liquid introduction portion in the mounted state, and that is in communication with an internal space of the bag, a storage-body-side electrical connection portion that comes into electrical contact with the apparatus-side electrical connection portion while receiving force that has at least a component in the +Z direction from the apparatus-side electrical connection portion in the mounted state, a first receiving portion that receives the first positioning portion in the mounted state, and a second receiving portion that receives the second positioning portion in the mounted state. The first receiving portion is located on the −X direction from the liquid outlet port. The second receiving portion is located on the +X direction from the liquid outlet portion. The liquid storage body has a width in the Z direction of the liquid storage body which is smaller than a width in the Y direction and a width in the X direction. The manufacturing method of this aspect includes preparing a pre-restored storage body that has the bag to which the connection member is attached, and that is thereby sealed; forming a communication portion that is in communication with the internal space of the bag by processing the bag of the pre-restored storage body; injecting a liquid from the communication portion into the internal space of the bag; and closing the communication portion so as to seal the bag.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

A. First Embodiment

1. Introduction

The configuration of a liquid ejection apparatus 11 will be described below with reference to FIGS. 1 to 3, and the configuration of a liquid storage body 20 that is mounted in the liquid ejection apparatus 11 will be described below with reference to FIGS. 4 to 19. Then, a manufacturing method of a liquid storage body 20A acquired by restoring the liquid storage body 20 used in the liquid ejection apparatus 11 and the configuration of the liquid storage body 20A will be described with reference to FIGS. 20 and 21A to 21C.

2. Configuration of Liquid Ejection Apparatus

Figure 1:
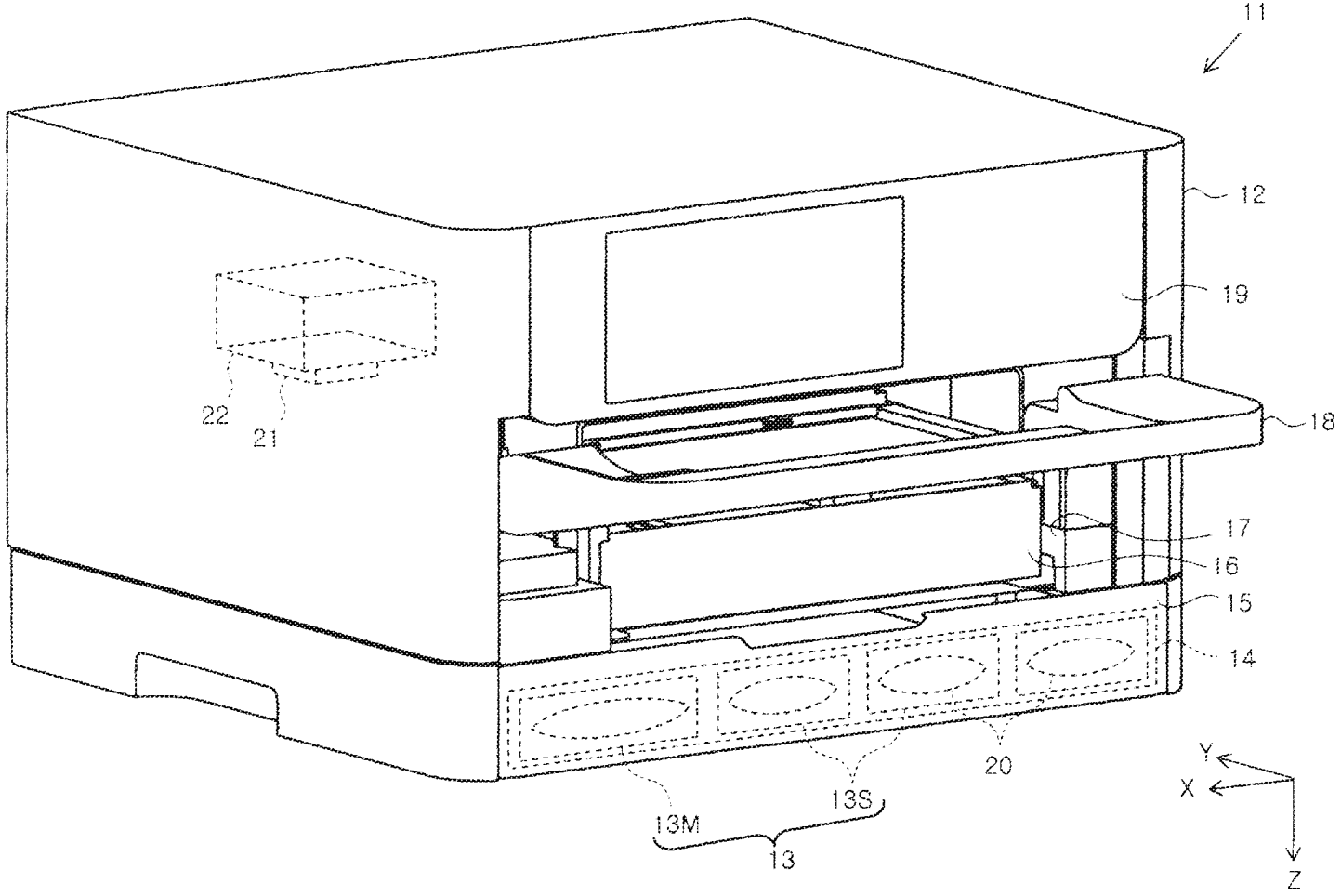
FIG. 1 is a schematic perspective view of a liquid ejection apparatus.

FIG. 1 is a schematic perspective view of the liquid ejection apparatus 11. For example, the liquid ejection apparatus 11 is an inkjet printer that records dots by ejecting ink, which is an example of a liquid, onto a medium such as paper, and forms a printing image.

The liquid ejection apparatus 11 is provided with a housing 12 that is an exterior body having a substantially rectangular parallelepiped shape. In the housing 12, a case storage portion 14 in which a case 13 is detachably stored is provided. In a front face portion of the housing 12, a front lid 15 that opens/closes the case storage portion 14 by pivoting and a mount port 17 in which a cassette 16 that can store a medium (not illustrated) is mounted are arranged in the stated order upward from the bottom side. Furthermore, a discharge tray 18 from which a medium is discharged and an operation panel 19 that allows the user to operate the liquid ejection apparatus 11 are arranged above the mount port 17. Note that the front face of the housing 12 refers to a side face that has a height and a width, and that the user is envisioned to face when operating the liquid ejection apparatus 11.

A plurality of cases 13 can be mounted in the case storage portion 14 of this embodiment in a mode of being aligned in the width direction. For example, three or more cases 13 including a first case 13S and a second case 13M whose width is longer than the first case 13S are mounted in the case storage portion 14, as the plurality of cases 13. In addition, respective liquid storage bodies 20 are placed removably on these cases 13. Specifically, a liquid storage body 20 is placed on a case 13 that is detachably mounted to the liquid ejection apparatus 11. The case 13 can be detachably mounted to the case storage portion 14, even in a single state in which it does not hold a liquid storage body 20, and is a constituent element that is mounted in the liquid ejection apparatus 11.

A liquid ejection unit 21 that ejects a liquid from a nozzle and a carriage 22 that moves reciprocally along a scanning direction that coincides with the width direction of the liquid ejection apparatus 11 are provided in the housing 12. The liquid ejection unit 21 prints on a medium by moving along with the carriage 22, and ejecting, onto this medium, liquid supplied from the liquid storage body 20 placed on the case 13. Note that in another embodiment, the liquid ejection unit 21 may be a line head whose position is fixed, and that does not move reciprocally.

In this embodiment, a direction intersecting the movement path when the case 13 is mounted to the case storage portion 14 is defined as the width direction, and a direction in which the movement path extends is defined as the depth direction. Note that the movement path and the width direction preferably intersect to be orthogonal to each other. The width direction and the depth direction virtually lie along a horizontal plane. In the drawings, the direction of gravity in a normal in-use state where the liquid ejection apparatus 11 is placed on the horizontal plane is indicated by a Z axis, and the movement direction when the case 13 is mounted to the case storage portion 14 is indicated by a Y axis. The movement direction may also be expressed as a mounting direction to the case storage portion 14 or an insertion direction into the case storage portion 14, and the opposite direction to the movement direction may be expressed as a removal direction. In addition, the width direction is expressed as an X axis orthogonal to the Z axis and the Y axis. The width direction, the gravity direction, and the mounting direction intersect each other, and are respectively directions when expressing width, height, and depth. Note that the width direction, the gravity direction, and the mounting direction preferably intersect to be orthogonal to each other.

In the following description, unless stated otherwise, the liquid ejection apparatus 11 is assumed to be in a normal in-use state. In addition, a direction parallel to the Z axis is referred to as a Z direction, in which a direction that is the same as the gravity direction is referred to as a +Z direction, and the opposite direction to the gravity direction is referred to as a −Z direction. In addition, a direction parallel to the Y axis is referred to as a Y direction, in which one direction is referred to as a +Y direction, and the other direction is referred to as a −Y direction. A direction parallel to the X axis is referred to as an X direction, in which one direction is referred to as a +X direction, and the other direction is referred to as a −X direction. The +Y direction is the movement direction of the case 13 when the case 13 is inserted into the case storage portion 14.

Figure 2:
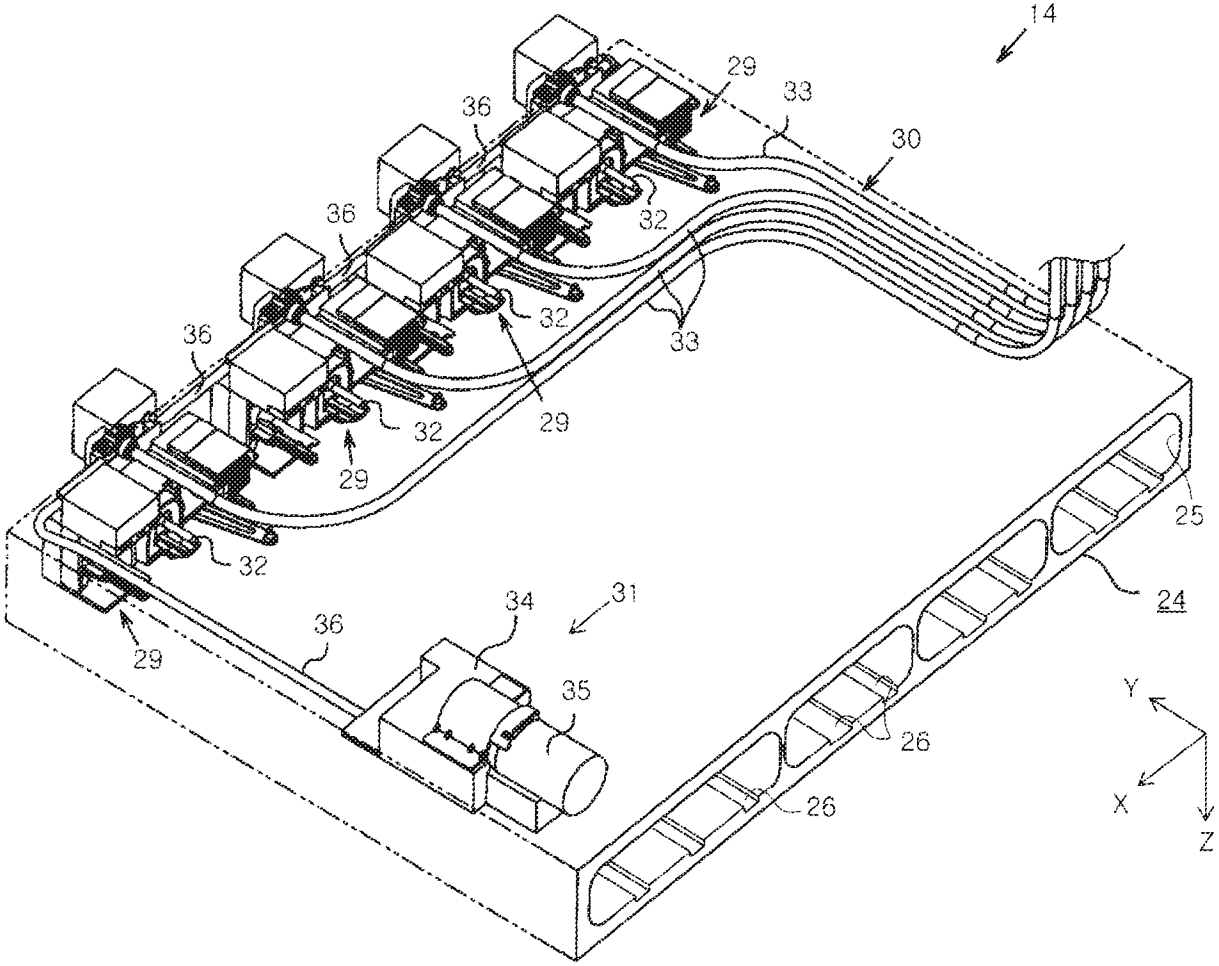
FIG. 2 is a schematic perspective view of a case storage portion.

FIG. 2 is a schematic perspective view of the case storage portion 14. The case storage portion 14 is a storage space in which one or more cases 13 can be stored. In this embodiment, the case storage portion 14 can store four cases 13. On the −Y direction side of the case storage portion 14, a frame body 24 is arranged. The frame body 24 has insertion ports 25 that are in communication with the case storage portion 14, and allow insertion of cases 13 into the case storage portion 14. The frame body 24 preferably has a plurality of pairs of linear guide rails 26 consisting of one or more projecting shapes or recessed shapes extending in the depth direction in order to guide the movement of the case 13 when mounted or removed.

The case 13 is moved along the +Y direction, and thereby is mounted to the case storage portion 14, through an insertion port 25. Note that in FIG. 2, regarding the frame body 24, only the vicinity of a front plate in which the insertion ports 25 are formed is illustrated with a solid line. In an end portion on the +Y direction side of the case storage portion 14, one or more connection mechanisms 29 are provided in correspondence with the cases 13. In this embodiment, four connection mechanisms 29 are provided.

The liquid ejection apparatus 11 is provided with supply channels 30 for supplying a liquid toward the liquid ejection unit 21 from the liquid storage body 20 that is mounted on the case storage portion 14 along with the case 13, and a supply mechanism 31 configured to send liquid contained in the liquid storage body 20 to the supply channels 30.

The supply channel 30 is provided for each type of liquid, and includes a liquid introduction portion 32 to which the liquid storage body 20 is coupled, and a flexible supply tube 33. In this embodiment, the supply channel 30 is provided for each ink color. The liquid introduction portion 32 is constituted by a needle-like tube member extending in the −Y direction. A pump chamber (not illustrated) is provided between the liquid introduction portion 32 and the supply tube 33. The downstream end of the liquid introduction portion 32 and the upstream end of the supply tube 33 are in communication with the pump chamber. The pump chamber is sectioned via a pressure change chamber and a flexible film (which are not illustrated).

The supply mechanism 31 is provided with a pressure change mechanism 34, a driving source 35 of the pressure change mechanism 34, and a pressure change channel 36 that couples the pressure change mechanism 34 and the above-described pressure change chambers. The driving source 35 is constituted by a motor, for example. When the pressure change mechanism 34 depressurizes a pressure change chamber through the pressure change channel 36 due to driving of the driving source 35, the flexible film warps and shifts to the pressure change chamber side, and thus the pressure in the pump chamber decreases. Accompanied with this pressure decrease in the pump chamber, liquid contained in the liquid storage body 20 is suctioned to the pump chamber through the liquid introduction portion 32. This is called "suction driving". Then, when the pressure change mechanism 34 releases the decompression in the pressure change chamber through the pressure change channel 36, the flexible film warps and shifts to the pump chamber side, and thus the pressure in the pump chamber increases. Accompanied with the increase in the pressure in the pump chamber, the liquid in the pump chamber then flows out to the supply tube 33 in a state of being pressurized. This is called "discharge driving". The supply mechanism 31 supplies liquid from the liquid storage body 20 to the liquid ejection unit 21 by alternately repeating the suction driving and the discharge driving.

Figure 3:
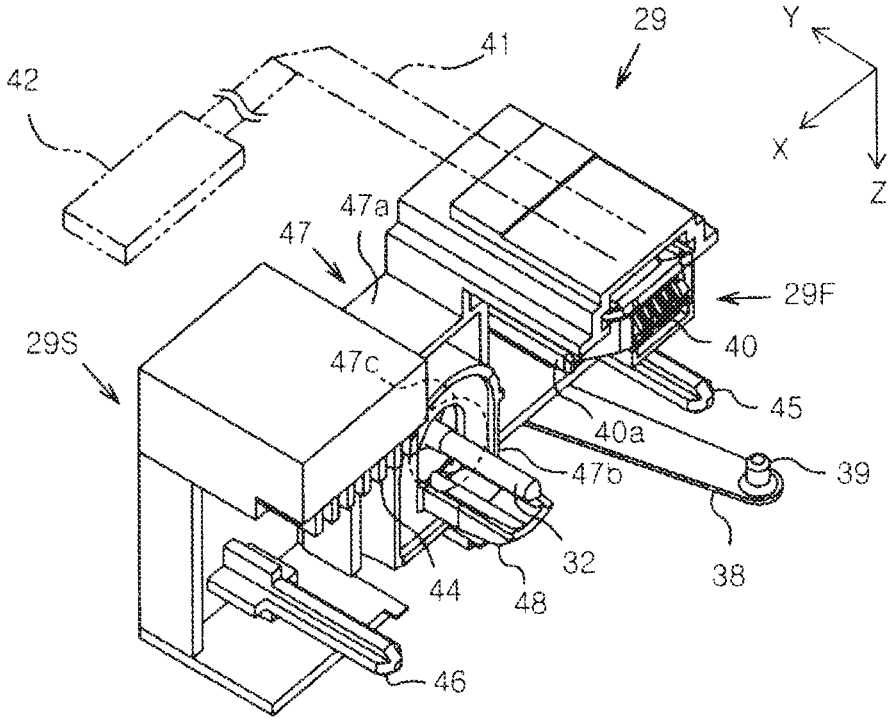
FIG. 3 is a schematic perspective view of a connection mechanism.

FIG. 3 is a schematic perspective view of a connection mechanism 29. The connection mechanism 29 has a first connection mechanism 29F and a second connection mechanism 29S respectively at positions sandwiching the liquid introduction portion 32 in the width direction. The first connection mechanism 29F has an apparatus-side fixing structure 38. In a stored state in which the case 13 is mounted in the case storage portion 14, the apparatus-side fixing structure 38 engages with a case-side fixing structure of the case 13, which will be described later, and thereby restricts movement of the case 13 in the −Y direction. In the first embodiment, the apparatus-side fixing structure 38 is constituted by an arm-like member. The apparatus-side fixing structure 38 is arranged vertically lower than the liquid introduction portion 32, and protrudes in the −Y direction that is the removal direction of the case 13. The leading end side of the apparatus-side fixing structure 38 is configured to be pivotable around its base end side. An engaging portion 39 is provided at a leading end of the apparatus-side fixing structure 38. The engaging portion 39 is arranged on the movement path of the case 13 when the case 13 is mounted to the case storage portion 14 (see FIG. 2). In the first embodiment, the engaging portion 39 is configured as a projection-shaped section that protrudes vertically upward from the apparatus-side fixing structure 38.

The first connection mechanism 29F is provided with an apparatus-side electrical connection portion 40. The apparatus-side electrical connection portion 40 is arranged vertically higher than the liquid introduction portion 32, and protrudes in the −Y direction that is the removal direction. The apparatus-side electrical connection portion 40 is coupled to a control apparatus 42 via an electric line 41 such as a flat cable. The apparatus-side electrical connection portion 40 is arranged such that the upper end of the apparatus-side electrical connection portion 40 protrudes past the lower end in the removal direction, and is directed obliquely downward. In addition, a pair of guiding projections 40*a* that protrude in the width direction, and extend along the mounting direction are arranged on the two sides of the apparatus-side electrical connection portion 40 in the width direction.

The second connection mechanism 29S has blocks 44 for preventing erroneous insertion that are arranged higher than the liquid introduction portion 32 in the vertical direction, and protrude in the removal direction. The blocks 44 have a recession-and-protrusion-shape arranged to face downward. This recession-and-projection shape is different for each connection mechanism 29 arranged in the case storage portion 14.

The connection mechanism 29 is provided with a pair of positioning portions 45 and 46. The first positioning portion 45 is included in the first connection mechanism 29F, and the second positioning portion 46 is included in the second connection mechanism 29S. The first positioning portion 45 and the second positioning portion 46 are configured as shaft-like parts extending toward the −Y direction side, and are provided at positions spaced apart from each other in the X direction sandwiching the liquid introduction portion 32. The length of protrusion in the removal direction of the positioning portions 45 and 46 is preferably set longer than the length of protrusion in the removal direction of the liquid introduction portion 32.

The connection mechanism 29 is further provided with an extrusion mechanism 47 arranged to surround the liquid introduction portion 32 and a liquid receiving portion 48 protruding in the removal direction below the liquid introduction portion 32. The extrusion mechanism 47 has a frame member 47*a* surrounding the base end portion of the liquid introduction portion 32, a pressing portion 47*b* protruding from the frame member 47*a* in the removal direction, and a biasing portion 47*c* that biases the case 13 in the removal direction via the pressing portion 47*b*. The biasing portion 47*c* can be a coil spring installed between the frame member 47*a* and the pressing portion 47*b*, for example.

As described above, the connection mechanism 29 is positioned in the end portion on the +Y direction side of the case storage portion 14 (see FIG. 2). Therefore, the liquid introduction portion 32 and the apparatus-side electrical connection portion 40 included in the connection mechanisms 29 are positioned in the end portion on the +Y direction side of the case storage portion 14. In addition, the liquid introduction portion 32, the apparatus-side fixing structure 38, the first positioning portion 45, and the second positioning portion 46 extend from the end portion on the +Y direction side of the case storage portion 14 toward the −Y direction side.

3. Configuration of Mount Body

Figure 4:
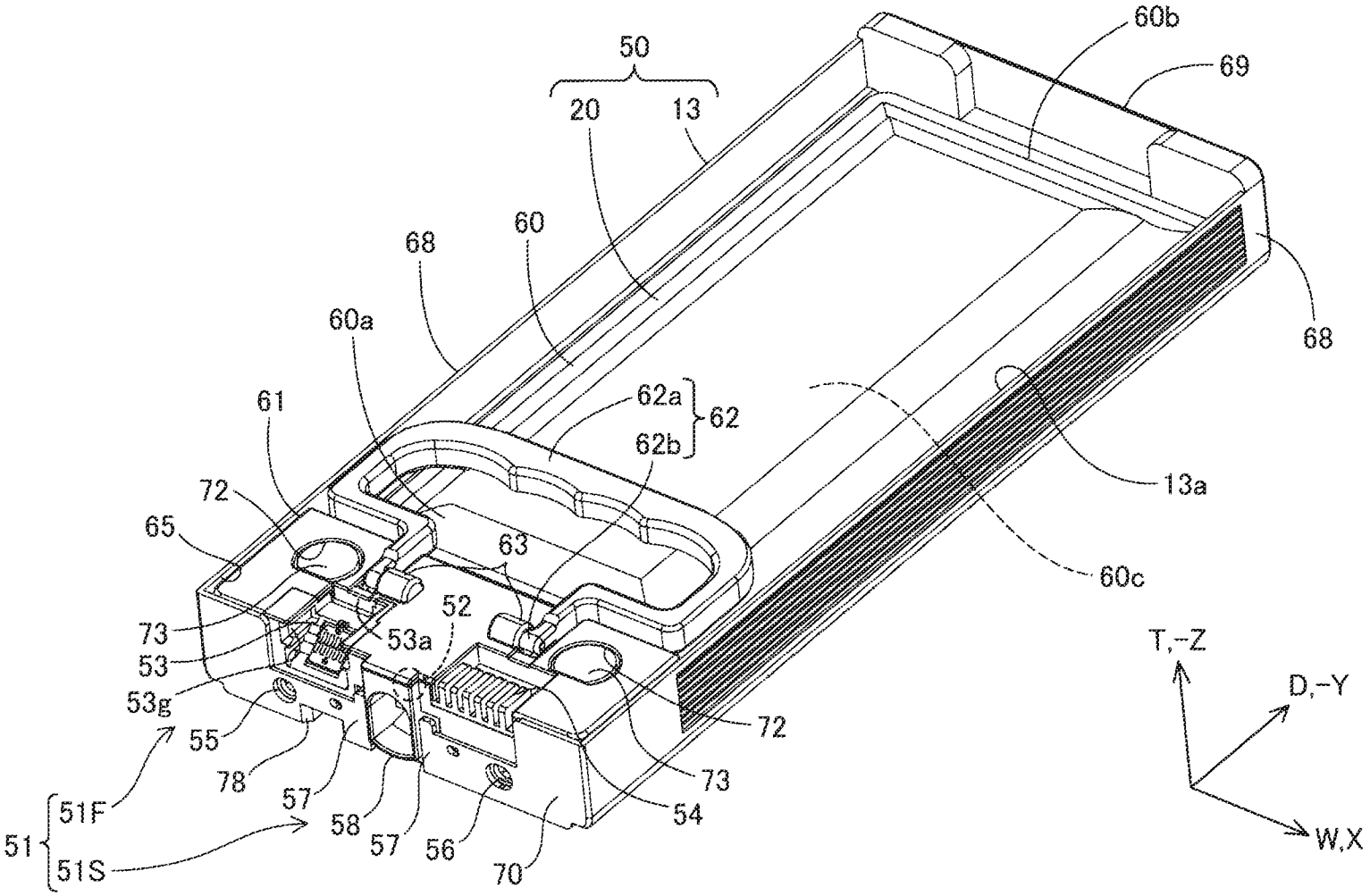
FIG. 4 is a schematic perspective view of a mount body.
Figure 5:
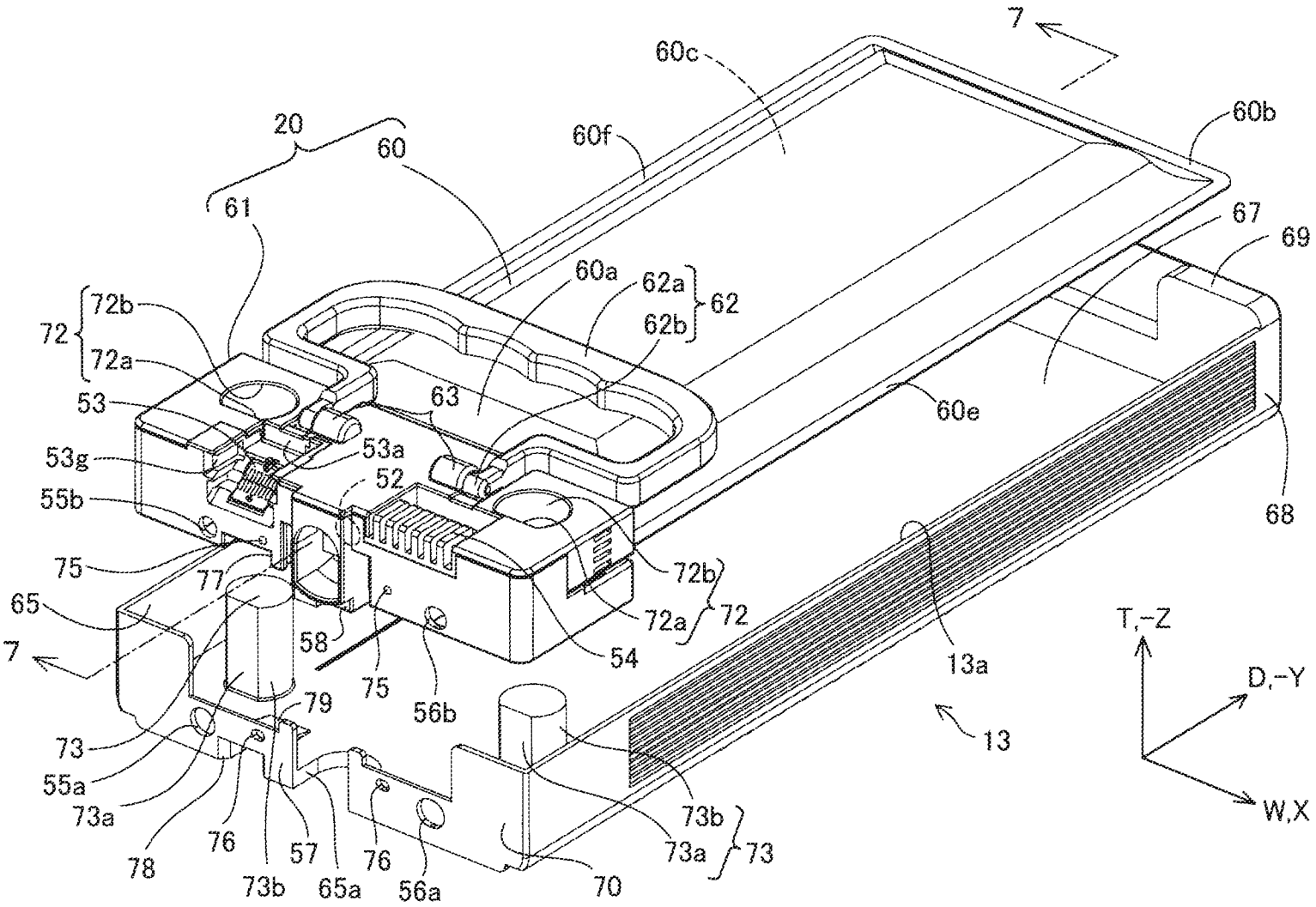
FIG. 5 is a schematic exploded perspective view of the mount body.

FIG. 4 is a schematic perspective view of a mount body 50 that is mounted to the case storage portion 14. In this embodiment, the mount body 50 is constituted by the case 13 whose outer shape is substantially rectangular parallelepiped, and the liquid storage body 20 that is placed on the case 13. FIG. 4 and FIG. 5 that will be described later show a perspective view of a second case 13M as the case 13. Hereinafter, a state where the liquid storage body 20 is arranged in the case 13 as shown in FIG. 4, and is mounted in the liquid ejection apparatus 11 in a normal in-use state is referred to as a "mounted state".

The liquid storage body 20 is a container for supplying liquid containing a sedimentary component to the liquid ejection apparatus 11. The liquid storage body 20 is provided with a bag 60 that contains liquid and a connection member 61 attached to the end portion on the +Y direction side of the bag 60.

The bag 60 is flexible. The bag 60 of this embodiment has a substantially rectangular shape in which the Y direction is a longitudinal direction, and the X direction is a traverse direction. The bag 60 of this embodiment is a pillow type bag formed by overlapping two rectangular films and joining the peripheral ends of the films to each other. In another embodiment, the bag 60 may be a gusset type bag. The films that constitute the bag 60 are formed of a material that is flexible and has gas barrier properties. Examples of the material of the films include polyethylene terephthalate (PET), nylon, polyethylene, and the like. In addition, the films may be formed using a layered structure in which a plurality of films made of such materials are layered. In such a layered structure, for example, a configuration may be adopted in which the outer layer is made of PET or nylon that has excellent impact resistance, and the inner layer is made of polyethylene that has excellent ink resistance. Furthermore, a film including a layer acquired by vapor depositing aluminum or the like may be one constituent member of the layered structure.

A storage portion 60*c* that is an internal space in which liquid is contained is provided in the bag 60. The storage portion 60*c* contains ink, as the liquid, in which pigment as a sedimentary component is dispersed in a solvent. The bag 60 has one end portion 60*a* and another end portion 60*b* that opposes the one end portion 60*a*. The connection member 61 is attached to the one end portion 60*a* of the bag 60. The connection member 61 is provided with a liquid outlet port 52 that is a supply port for leading out liquid in the storage portion 60*c* to the liquid ejection apparatus 11.

FIG. 4 shows three directions orthogonal to each other, namely, a D direction, a T direction, and a W direction. In this embodiment, the D direction is a direction that lies along the Y direction shown in FIG. 1, and in which the bag 60 extends. In the following description, in the D direction, a direction from the liquid outlet port 52 toward the other end portion 60*b* side of the bag 60 is defined as a +D direction, and the opposite direction to the +D direction is defined as a −D direction. Also, a direction in which the dimension of the outer shape of the liquid storage body 20 is smallest is defined as the T direction. A direction orthogonal to the D direction and the T direction is defined as the W direction. In this embodiment, the T direction is a direction along the Z direction, and a +T direction corresponds to a −Z direction. Also, the W direction is a direction along the X direction, and a +W direction corresponds to a +X direction.

When the end of the mount body 50 on the +Y direction side that leads when the mount body 50 is mounted to the case storage portion 14 (see FIG. 2) is assumed to be a leading end, and the end on the opposite side to the leading end, namely the −Y direction side is assumed to be a base end, a connection structure 51 is provided in the leading end portion. A first connection structure 51F and a second connection structure 51S are provided respectively on the two sides of the connection structure 51 sandwiching the liquid outlet port 52 in the width direction.

The first connection structure 51F is provided with a storage-body-side electrical connection portion 53, which is a terminal portion that comes into electrical contact with the apparatus-side electrical connection portion 40. The storage-body-side electrical connection portion 53 is arranged at a position vertically higher than the liquid outlet port 52. For example, the storage-body-side electrical connection portion 53 is provided on the surface of a circuit substrate, and this circuit substrate includes a storage unit that stores various types of information regarding the liquid storage body 20 (for example, the type of the liquid storage body 20, the amount of liquid contained, and the like).

The storage-body-side electrical connection portion 53 is arranged to be directed obliquely upward in a terminal arrangement portion 53*a* provided in a mode of a recessed portion that is open upward and in the mounting direction.

In addition, guiding recessions 53*g* extending in the mounting direction are respectively arranged on the two sides in the width direction of the storage-body-side electrical connection portion 53.

The second connection structure 51S is preferably provided with an identification portion 54 for preventing erroneous insertion that is arranged higher than the liquid outlet port 52 vertically. The identification portion 54 has recessions and projections that are shaped so as to fit the blocks 44 (see FIG. 3) of a corresponding connection mechanism 29.

The connection structure 51 is provided with a pair of receiving portions 55 and 56. The pair of receiving portions 55 and 56 are provided as hole portions that are open in the Y direction. The pair of receiving portions 55 and 56 are aligned in the width direction sandwiching the liquid outlet port 52. The first receiving portion 55 is included in the first connection structure 51F, and the second receiving portion 56 is included in the second connection structure 51S. While the first receiving portion 55 is configured as a substantially precise circular hole, the second receiving portion 56 is configured as an elongated hole that has a substantially ellipsoidal shape longer in the width direction. The first receiving portion 55 receives the first positioning portion 45 (see FIG. 3) of the connection mechanism 29. The second receiving portion 56 receives the second positioning portion 46 of the connection mechanisms 29.

The connection structure 51 is further provided with biasing-receiving portions 57 that receive a biasing force of the biasing portion 47*c* (see FIG. 3), and an insertion portion 58 provided below the liquid outlet port 52.

FIG. 5 is a schematic exploded perspective view showing a state where the liquid storage body 20 and the case 13 that constitute the mount body 50 are separated. In the orientation in the mounted state, the width in the Z direction of the liquid storage body 20 is smaller than the width in the Y direction and the width in the X direction. Accordingly, the arrangement orientation of the liquid storage body 20 on the case 13 is stabilized.

The case 13 has a bottom plate 67 that constitutes a bottom face on which the liquid storage body 20 is placed, side plates 68 that are erected vertically upward from the two ends in the width direction of the bottom plate 67, a front plate 69 that is erected vertically upward from the base end of the bottom plate 67, and a leading plate 70 that is erected vertically upward from the leading end of the bottom plate 67.

In the case 13, the bottom plate 67, the side plates 68, the front plate 69, and the leading plate 70 constitute a main body portion that has a storage space for storing the liquid storage body 20. The case 13 has an opening 13*a* for inserting/taking out the liquid storage body 20 into/from the storage space. In this embodiment, the opening 13*a* of the case 13 is open vertically upward.

The case 13 is sized to match the liquid storage body 20 that is mounted therein. When the liquid storage body 20 is stored in the case 13, the surface of the bottom plate 67 of the case 13 is substantially entirely covered with the liquid storage body 20, as shown in FIG. 4.

The bag 60 of the liquid storage body 20 has, in addition to the other end portion 60*b* that is the end portion on the −Y direction side, a first side end portion 60*e* that is the end portion on the +X direction side, and a second side end portion 60*f* that is the end portion on the −X direction side. In this embodiment, as described above, the bag 60 is a pillow type bag, and thus the end portions 60*b*, 60*e*, and 60*f* are configured as joint portions at which two films that constitute the bag 60 join. The end portions 60*b*, 60*e*, and 60*f* function as seal portions at which the storage portion 60*c* is sealed.

The connection member 61 that is attached to the end portion on the +Y direction side of the bag 60 is arranged on the leading end side in the opening 13*a* of the case 13. A main body portion of the connection member 61 has a substantially rectangular parallelepiped shape. The width in the Z direction of the main body portion of the connection member 61 is smaller than the width in the X direction and the width in the Y direction. The width in the X direction of the connection member 61 is slightly larger than the width in the X direction of the bag 60. The width in the X direction of the connection member 61 is larger than the width in the X direction of the bag 60 by about several millimeters.

On the leading end of the connection member 61, the liquid outlet port 52, the storage-body-side electrical connection portion 53, the terminal arrangement portion 53*a*, the guiding recessions 53*g*, and the identification portion 54 are provided. On the leading end of the connection member 61, a first hole 55*b* and a second hole 56*b* are further formed to sandwich the liquid outlet port 52 in the width direction.

The leading end portion of the case 13 constitutes an engagement-receiving portion 65 with which the connection member 61 of the liquid storage body 20 can engage. The engagement-receiving portion 65 includes the above-mentioned biasing-receiving portions 57 and a notch 65*a* that is provided between the biasing-receiving portions 57, and is engaged with the insertion portion 58 provided in the connection member 61 of the liquid storage body 20. The engagement-receiving portion 65 includes a first hole 55*a* and a second hole 56*a* that are provided on two sides in the width direction of the notch 65*a*.

When the liquid storage body 20 is placed in the case 13, the first hole 55*a* of the engagement-receiving portion 65 and the first hole 55*b* of the connection member 61 are aligned in the depth direction, and the second hole 56*a* of the engagement-receiving portion 65 and the second hole 56*b* of the connection member 61 are aligned in the depth direction. Then, the first holes 55*a* and 55*b* constitute the first receiving portion 55, and the second holes 56*a* and 56*b* constitute the second receiving portion 56. The first hole 55*b* of the connection member 61 constitutes the first receiving portion 55 that receives the first positioning portion 45 in the mounted state. The second hole 56*b* of the connection member 61 constitutes the second receiving portion 56 that receives the second positioning portion 46 in the mounted state. Hereinafter, the first hole 55*b* is also referred to as "first receiving portion 55*b*" provided in the connection member 61, and the second hole 56*b* is also referred to as "second receiving portion 56*b*" provided in the connection member 61.

In the engagement-receiving portion 65 of the case 13, a plurality of guiding portions 73 that are substantially cylindrical, and protrude from the bottom plate 67 in the guiding direction are provided. The "guiding direction" is a direction in which the liquid storage body 20 is inserted/taken out into/from the opening 13*a* of the case 13, and that intersects the bottom plate 67 and lies along the side plates 68. In the first embodiment, the guiding direction is the Z direction orthogonal to the bottom plate 67. In this embodiment, two guiding portions 73 are formed to align in the width direction.

In the connection member 61 of the liquid storage body 20, a plurality of guide portions 72 formed to pass through the connection member 61 in the guiding direction are provided. In this embodiment, at positions on the −Y direction side relative to the liquid outlet port 52 and the storage-body-side electrical connection portion 53, two guide portions 72 are formed to align in the width direction.

When the liquid storage body 20 is stored into the case 13, the guiding portions 73 provided in the case 13 guide the guide portions 72 provided in the connection member 61 in the guiding direction. On the other hand, the guide portions 72 provided in the connection member 61 are guided in the guiding direction by the guiding portions 73 provided in the case 13.

In this embodiment, the guiding portions 73 have a projecting and substantially semi-cylindrical shape, and the side faces of the guiding portions 73 that extend along the guiding direction respectively have flat restriction portions 73*a* positioned on the leading end side, and curved portions 73*b* on the base end side relative to the restriction portions 73*a*.

Moreover, the guide portions 72 are formed to be shaped to respectively have restriction portions 72*a* and curved portions 72*b* to follow the shape of the guiding portions 73. The restriction portions 72*a* and 73*a* restrict escape and rotation of the liquid storage body 20 that is placed in the case 13.

Furthermore, in the leading end face of the connection member 61, for example, domed protrusions 75 at least whose corner in the guiding direction is chamfered are formed. In addition, in the leading plate 70 of the case 13, engagement holes 76 that are engaged with the protrusions 75 are formed. With such a configuration, when the liquid storage body 20 is placed in the case 13, sense or tactile feeling indicating that engagement between the case 13 and the liquid storage body 20 is complete can be felt by the user through click feeling. The protrusions 75 and the engagement holes 76 of this embodiment are formed so as to be aligned as pairs on the respective two sides in the width direction, sandwiching the liquid outlet port 52 of the connection member 61 and the notch 65*a* of the case 13.

The connection member 61 is provided with a handle portion 62. The handle portion 62 is constituted by a member different from the main body of the connection member 61, and can move relative to the connection member 61. Specifically, the handle portion 62 can move by rotating centered on a rotation shaft 63 provided on the connection member 61. The rotation shaft 63 is formed so as to be open on two sides in the width direction, and a semi-cylindrical shaped portion of the rotation shaft 63 having a bottom protrudes from the upper face of the connection member 61.

The handle portion 62 has a grip portion 62*a* that is gripped by the user. The grip portion 62*a* is positioned on the bag 60 side distanced more from the connection member 61 in the depth direction than an axis portion 62*b* pivotally supported by the rotation shaft 63. The handle portion 62 can pivot between a first orientation where the grip portion 62*a* is positioned at the same height as or below the rotation shaft 63 and a second orientation where the grip portion 62*a* is positioned at a higher position than the rotation shaft 63. The handle portion 62 may be omitted.

Figure 6:
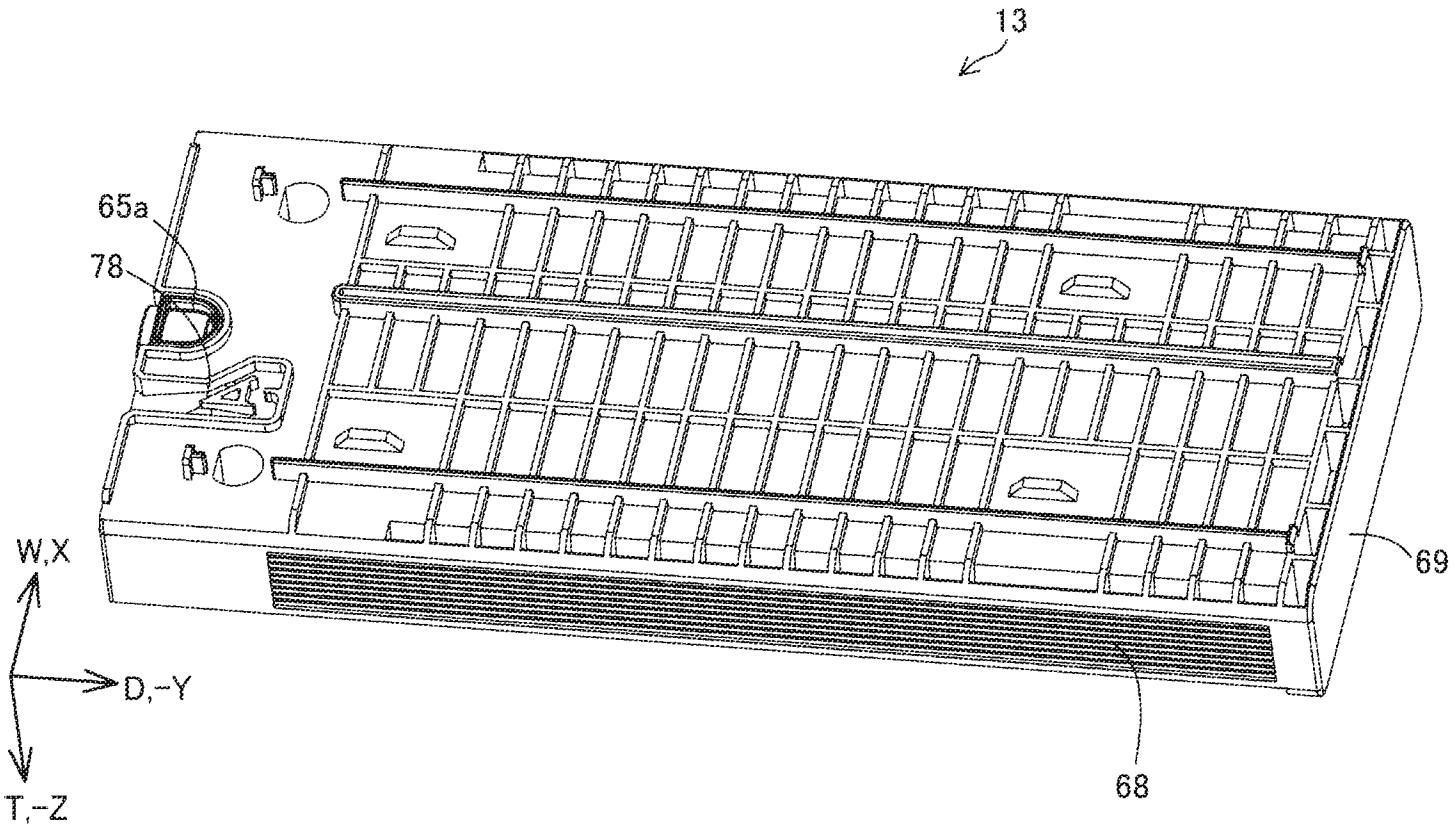
FIG. 6 is a schematic perspective view showing a reverse side of a case.

FIG. 6 is a schematic perspective view showing a reverse side of the case 13. The reverse side of the case 13 is a face opposite to the face on which the liquid storage body 20 is arranged, and is directed in the gravity direction in the mounted state. On the reverse side of the case 13, on the leading end side, an engagement groove 78 into which the engaging portion 39 (see FIG. 3) of the apparatus-side fixing structure 38 of the connection mechanisms 29 is inserted in the −Y direction, and that is thereby guided is provided. The engagement groove 78 has a known heart cam groove structure. The engaging portion 39 engages with the engagement groove 78 in a stored state where the case 13 is stored in the case storage portion 14, while giving force toward the −Z direction to the case 13. Accordingly, movement in the −Y direction of the case 13 in the stored state is restricted. The engagement groove 78 is also referred to as a "case-side fixing structure 78".

Description will be given with reference to FIG. 5. The case-side fixing structure 78 is open in the +Y direction at the leading end of the case 13 in order to receive insertion of the apparatus-side fixing structure 38. In the bottom plate 67 of the case 13, on the end portion on the +Y direction side, a hollow projection 79 that includes a portion of the case-side fixing structure 78, and protrudes in the +Z direction is provided.

On the lower end of the connection member 61, a recessed portion 77 that is depressed in the −Z direction in the mounted state, and stores the projection 79 is provided. The recessed portion 77 is positioned below the storage-body-side electrical connection portion 53. In the mounted state, the recessed portion 77 and the projection 79 engage with each other, and thus the positioning accuracy of the storage-body-side electrical connection portion 53 on the case 13 is improved. Therefore, the electrical connectivity between the storage-body-side electrical connection portion 53 and the apparatus-side electrical connection portion 40 of the connection mechanisms 29 (see FIG. 3) when the liquid storage body 20 is mounted in the liquid ejection apparatus 11 is improved.

Here, connection between the connection structure 51 of the mount body 50 and the connection mechanism 29 will be described with reference to FIGS. 3 and 4. When the mount body 50 is inserted into the storage space, and the leading end approaches the connection mechanism 29, first, the leading ends of the positioning portions 45 and 46, which has the longer protrusion length of the two in the removal direction, engage with the receiving portions 55 and 56 of the mount body 50 in an aspect of being inserted into the receiving portions 55 and 56, and restrict movement of the mount body 50 in the width direction. The second receiving portion 56 is an elliptic-shaped elongated hole extending in the width direction, and thus the positioning protrusion 45 that is inserted into the circular first receiving portion 55 serves as a reference for positioning.

When the mount body 50 advances even farther after the positioning portions 45 and 46 engage with the receiving portions 55 and 56, the biasing-receiving portion 57 comes into contact with the pressing portion 47*b*, and receives a biasing force of the biasing portion 47*c*. Then, as a result of the apparatus-side fixing structure 38 engaging with the case-side fixing structure 78, movement of the case 13 in the −Y direction is restricted. In addition, the liquid introduction portion 32 is inserted into the liquid outlet port 52 of the liquid storage body 20 in the −Y direction, and the storage portion 60*c* in the bag 60 of the liquid storage body 20 and the liquid introduction portion 32 are brought into communication. The positioning portions 45 and 46 preferably position the mount body 50 before the liquid introduction portion 32 is coupled to the liquid outlet port 52.

If the mount body 50 is inserted at an appropriate position, the identification portion 54 is appropriately fitted with the blocks 44 of the connection mechanism 29. On the other hand, if an attempt is made to mount the mount body 50 at an inappropriate position, the identification portion 54 does not fit to the blocks 44, and thus the mount body 50 cannot advance any farther, thereby preventing erroneous insertion.

In addition, when the mount body 50 advances in the mounting direction, the apparatus-side electrical connection portion 40 enters the terminal arrangement portion 53*a* of the mount body 50, and the position of the apparatus-side electrical connection portion 40 is adjusted by the guiding recessions 53*g* being guided by the guiding projections 40*a*, such that the apparatus-side electrical connection portion 40 comes into contact with the storage-body-side electrical connection portion 53. The storage-body-side electrical connection portion 53 is inclined to be directed in the −Z direction, and thus comes into electrical contact with the apparatus-side electrical connection portion 40 while receiving, from the apparatus-side electrical connection portion 40, force having at least a component in the +Z direction. Thus, the storage-body-side electrical connection portion 53 is electrically coupled to the apparatus-side electrical connection portion 40, and information is exchanged between the circuit substrate and the control apparatus 42.

By the storage-body-side electrical connection portion 53 receiving, from the apparatus-side electrical connection portion 40, force that has at least a component in the +Z direction, an excellent state of electrical contact between the storage-body-side electrical connection portion 53 and the apparatus-side electrical connection portion 40 is achieved. In order to suppress position shift between the storage-body-side electrical connection portion 53 and the apparatus-side electrical connection portion 40, the first receiving portion 55 that serves as a reference for positioning is preferably arranged in the first connection structure 51F including the storage-body-side electrical connection portion 53 out of the first connection structure 51F and the second connection structure 51S.

When the liquid outlet port 52 of the liquid storage body 20 is coupled to the liquid introduction portion 32 in a state where liquid can be supplied to the liquid introduction portion 32, and the storage-body-side electrical connection portion 53 comes into contact with and is electrically coupled to the apparatus-side electrical connection portion 40, connection of the connection structure 51 to the connection mechanism 29 is complete. The mounted state is a state where this connection is complete.

Figure 7:
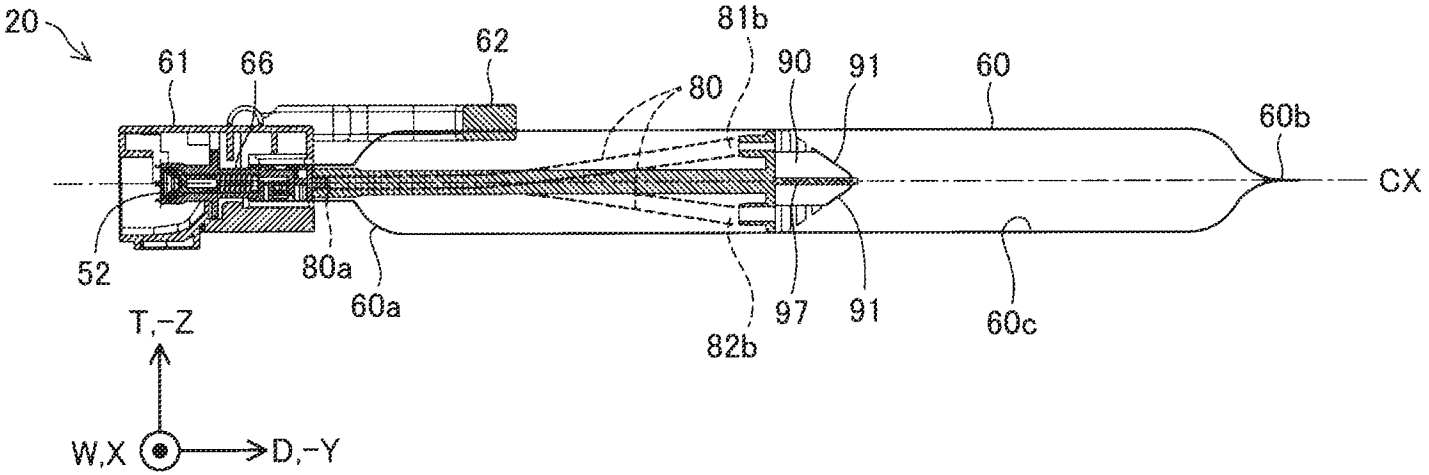
FIG. 7 is a schematic cross-sectional view of a liquid storage body.

FIG. 7 is a schematic cross-sectional view of the liquid storage body 20 cut along a line 7-7 in FIG. 5. FIG. 7 shows a central axis CX of the liquid outlet port 52 having a cylindrical shape. In the connection member 61, the liquid storage body 20 has a liquid outlet member 66 that is provided integrally with the liquid outlet port 52 and is for leading out liquid that is supplied to the liquid ejection apparatus 11. The liquid outlet member 66 is attached to the one end portion 60*a* of the bag 60, which is the end portion on the +Y direction side.

The liquid storage body 20 is provided with a liquid outlet tube 80 and a spacer member 90, in the storage portion 60*c* of the bag 60. The liquid outlet tube 80 is a flexible tube made of an elastomer, for example. The liquid outlet tube 80 has a base end portion 80*a* coupled to the liquid outlet member 66, in the storage portion 60*c*. The liquid outlet tube 80 extends from the liquid outlet member 66 toward the other end portion 60*b* side in the storage portion 60*c*. A channel that allows the liquid outlet tube 80 and the liquid outlet port 52 to communicate with each other is formed inside of the liquid outlet member 66. The liquid outlet member 66 fixes the liquid outlet port 52, the bag 60, the liquid outlet tube 80, and the spacer member 90 to the connection member 61.

The spacer member 90 is a structure for defining a region having a certain capacity in the bag 60. The spacer member 90 is made of a synthetic resin such as polyethylene or polypropylene. The spacer member 90 has a portion positioned on the +D direction side relative to the liquid outlet tube 80. In addition, the spacer member 90 is provided at a position intersecting the TD plane that includes the central axis CX of the liquid outlet port 52. The TD plane refers to a plane including the T direction and the D direction. The spacer member 90 has, on the +D direction side, a face 91 inclined such that the dimension in the T direction of the spacer member 90 increases from the +D direction side toward the −D direction side. Hereinafter, the face 91 is referred to as an "inclined face 91". In this embodiment, the spacer member 90 has inclined faces 91 respectively on the +T direction side and the −T direction side relative to the central axis CX. Therefore, the spacer member 90 has a shape pointed toward the +D direction side, when viewed from the W direction. Note that in this embodiment, a "face" includes not only a face constituted only by a flat face, but also a face on which a groove, a recessed portion or the like is formed, a face on which a protrusion or a projection is formed, and a virtual face surrounded by a frame. In other words, as long as the face can be grasped as being a "face" overall, a certain region occupied by the face may include recessions, projections, and a through hole.

In an orientation in which the liquid storage body 20 is mounted in the liquid ejection apparatus 11, at least one of the lowermost portion and the uppermost portion of the spacer member 90 come into contact with the internal face of the bag 60. In this embodiment, as shown in FIG. 7, both the lowermost portion and the uppermost portion of the spacer member 90 are in contact with the internal face of the bag 60. Hereinafter, the orientation of the liquid storage body 20 in which the liquid storage body 20 is in the mounted state is referred to as "a mounted orientation". In this embodiment, in the mounted orientation, the center between the heights of the lowermost portion and the uppermost portion of the spacer member 90 is the same as the height of the central axis CX of the liquid outlet port 52.

Figure 8:
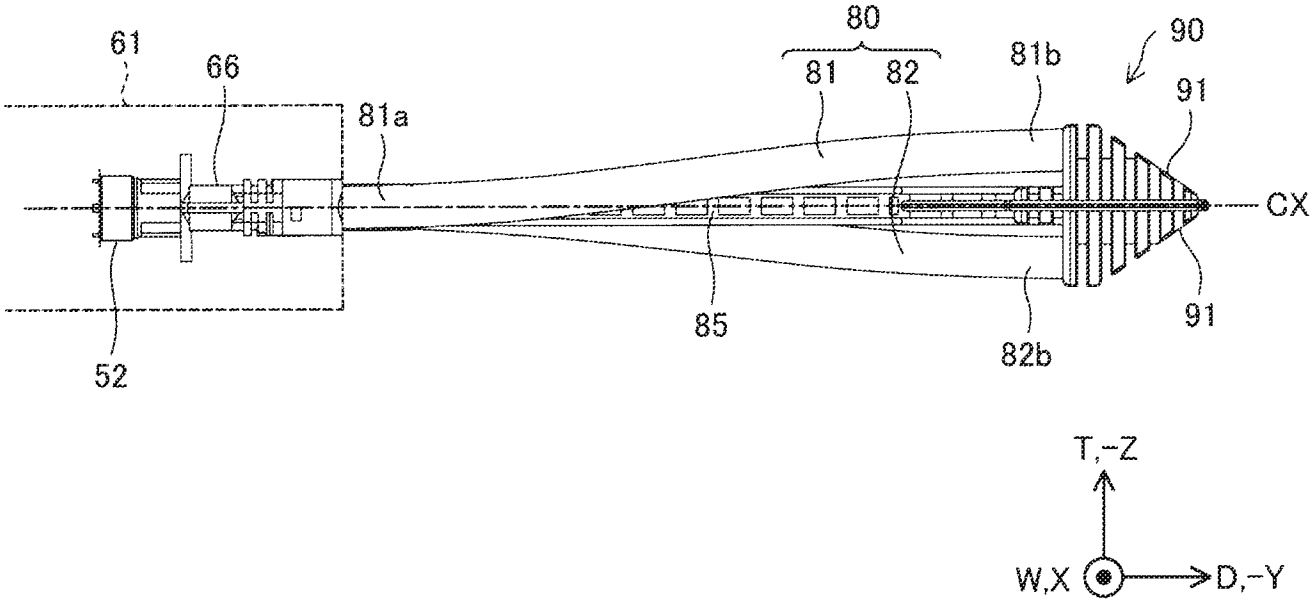
FIG. 8 is a schematic side view of a spacer member and a liquid outlet tube.
Figure 9:
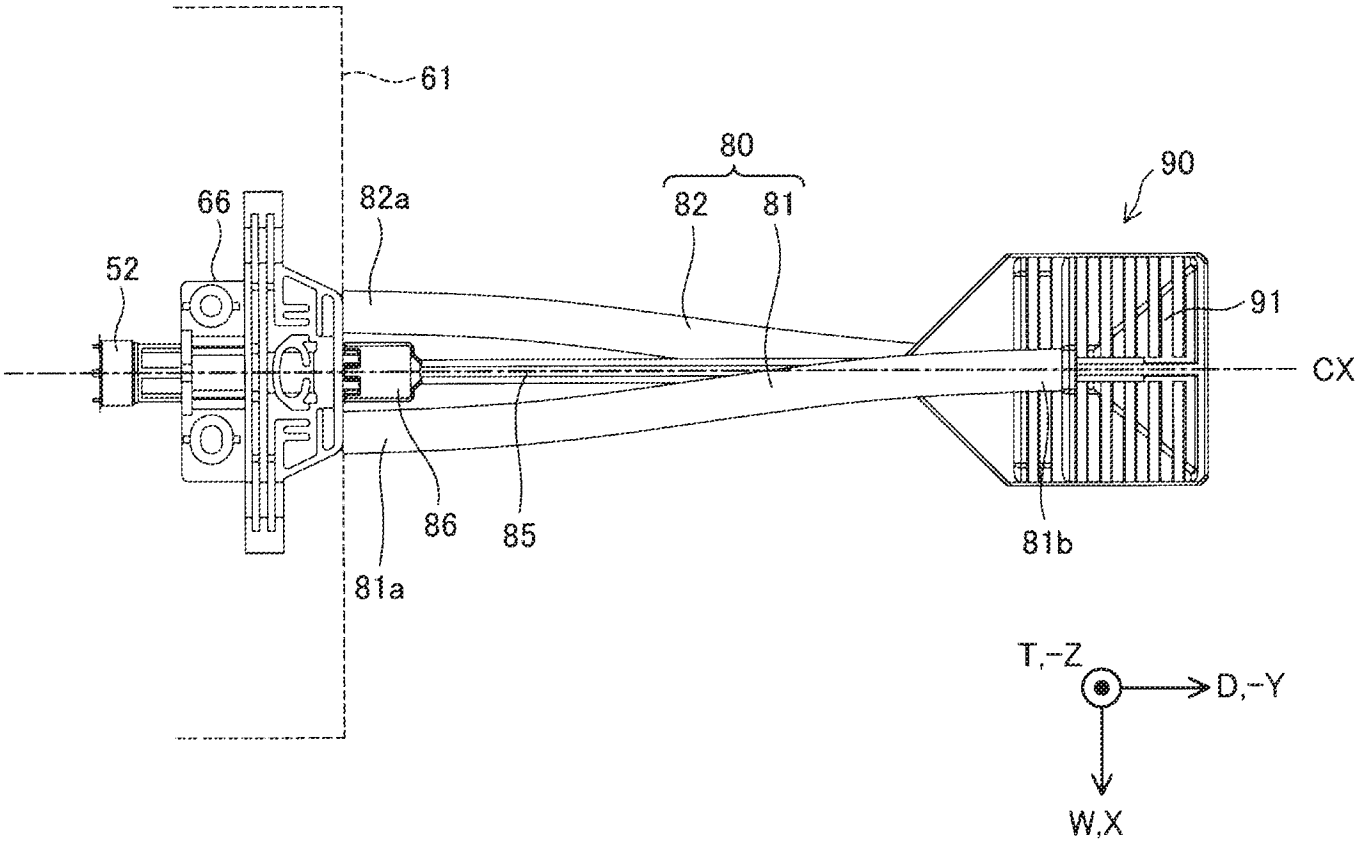
FIG. 9 is a schematic plan view of the spacer member and the liquid outlet tube.

FIG. 8 is a schematic side view of the spacer member 90 and the liquid outlet tube 80. FIG. 9 is a schematic plan view of the spacer member 90 and the liquid outlet tube 80. The liquid outlet tube 80 is configured to extend in the horizontal direction from the liquid outlet port 52 in the storage portion 60*c* (see FIG. 7) in the mounted orientation. In addition, in this embodiment, the spacer member 90 is fixed to the liquid outlet member 66 by a bar-like coupling member 85. In this embodiment, the coupling member 85 is connected integrally with the spacer member 90. An engaging portion 86 that is engaged with and fixed to a claw portion 59 (illustrated in FIG. 19 to be described later) provided in the face on the +D direction side of the liquid outlet member 66 is provided at the end portion on the −D direction side of the coupling member 85. Note that in another embodiment, the spacer member 90 does not need to be fixed to the liquid outlet member 66. For example, a structure may be adopted in which the spacer member 90 is fixed to the internal face of the bag 60.

In this embodiment, the liquid storage body 20 has a first channel portion 81 and a second channel portion 82 as the liquid outlet tube 80. In other words, the liquid storage body 20 has two liquid outlet tubes 80. In this embodiment, the first channel portion 81 and the second channel portion 82 have the same length. The first channel portion 81 has a first base end portion 81*a* that is coupled to the liquid outlet member 66 and a first leading end portion 81*b* for introducing the liquid in the storage portion 60*c* to the first channel portion 81. The second channel portion 82 has a second base end portion 82*a* that is coupled to the liquid outlet member 66 and a second leading end portion 82*b* for introducing liquid in the storage portion 60*c* to the second channel portion 82. Moreover, as shown in FIG. 7, in the mounted orientation, the first leading end portion 81*b* is positioned above the second leading end portion 82*b*. As shown in FIG. 9, the above-described engaging portion 86 is arranged so as to be sandwiched by the first base end portion 81*a* of the first channel portion 81 and the second base end portion 82*a* of the second channel portion 82 in the horizontal direction. Note that in another embodiment, the liquid storage body 20 may be provided with three or more liquid outlet tubes 80.

As shown in FIGS. 8 and 9, in this embodiment, in the mounted orientation, the first base end portion 81*a* of the first channel portion 81 and the second base end portion 82*a* of the second channel portion 82 are aligned in the horizontal direction, and the first leading end portion 81*b* of the first channel portion 81 and the second leading end portion 82*b* of the second channel portion 82 are aligned in the vertical direction. Therefore, liquid suctioned from the first channel portion 81 and liquid suctioned from the second channel portion 82 are converted from a state of flowing side by side in the vertical direction into a state of flowing side by side in the horizontal direction, are then mixed in the liquid outlet member 66, and are lead out from the liquid outlet port 52 to the liquid ejection apparatus 11. Note that in another embodiment, it is possible to adopt a mode in which the first base end portion 81*a* and the second base end portion 82*a* are aligned in the vertical direction, and the first leading end portion 81*b* and the second leading end portion 82*b* are aligned in the horizontal direction, a mode in which the first base end portion 81*a* and the second base end portion 82*a* are aligned in the vertical direction, and the first leading end portion 81*b* and the second leading end portion 82*b* are also aligned in the vertical direction, and a mode in which the first base end portion 81*a* and the second base end portion 82*a* are aligned in the horizontal direction, and the first leading end portion 81*b* and the second leading end portion 82*b* are also aligned in the horizontal direction.

Figure 10:
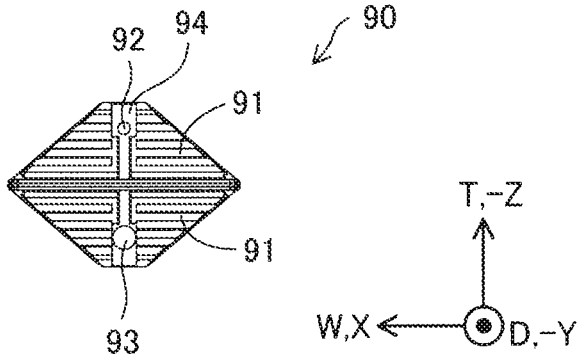
FIG. 10 is a schematic front view of the spacer member.
Figure 11:
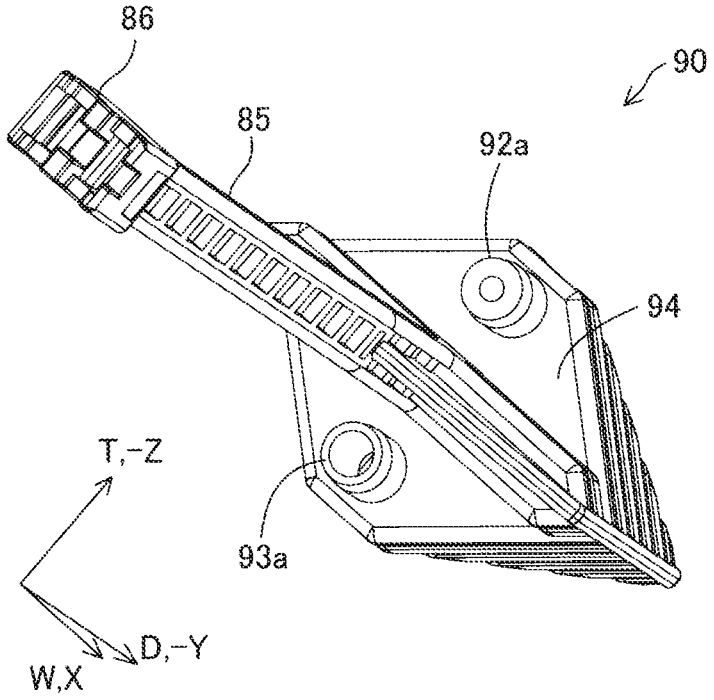
FIG. 11 is a schematic perspective view of a rear side of the spacer member.

FIG. 10 is a schematic front view of the spacer member 90. FIG. 11 is a schematic perspective view of the rear side of the spacer member 90. The spacer member 90 has a first introduction port 92 and a second introduction port 93. The first introduction port 92 is an opening for introducing liquid relatively on the upper side in the storage portion 60*c* of the bag 60 into the first channel portion 81. The second introduction port 93 is an opening for introducing liquid relatively on the lower side in the storage portion 60*c* of the bag 60 into the second channel portion 82.

The spacer member 90 has, at a section at which the dimension in the T direction of the spacer member 90 is the largest, a rear face member 94 parallel to and along the TW plane. The rear face member 94 has a substantially hexagonal shape whose upper side and lower side are horizontal. The first introduction port 92 and the second introduction port 93 are provided in this rear face member 94. In this embodiment, the internal diameter of the first introduction port 92 is smaller than the internal diameter of the second introduction port 93. In other words, the internal diameter of the second introduction port 93 is larger than the internal diameter of the first introduction port 92. Therefore, the second introduction port 93 positioned below the first introduction port 92 suctions liquid in the bag 60 more easily. Note that as shown in FIG. 9, in this embodiment, the spacer member 90 has an inclined face not only on the +D direction side but also on the +W direction side and a −W direction side.

The first introduction port 92 and the second introduction port 93 face in the +D direction. In addition, the first introduction port 92 and the second introduction port 93 are provided at positions symmetrical in the T direction relative to the central axis CX of the liquid outlet port 52 shown in FIG. 7. The first introduction port 92 is provided above the central axis CX, and the second introduction port 93 is provided below the central axis CX.

Figure 12:
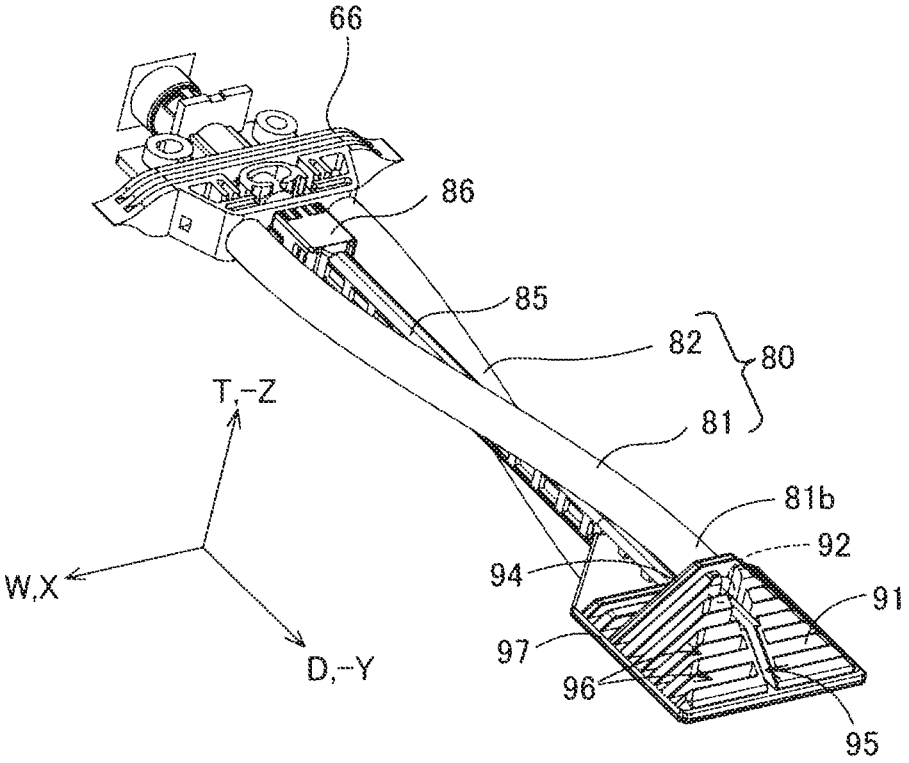
FIG. 12 is a first schematic perspective view of the spacer member and the liquid outlet tube.

FIG. 12 is a first schematic perspective view of the spacer member 90 and the liquid outlet tube 80. The first leading end portion 81*b* of the first channel portion 81 of the liquid outlet tube 80 is connected to the first introduction port 92. More specifically, a cylindrical first connection tube 92*a* that is in communication with the first introduction port 92 is provided on the face on the −D direction side of the rear face member 94 (see FIG. 11), and this first connection tube 92*a* is inserted into the first leading end portion 81*b* of the first channel portion 81, and thereby the first leading end portion 81*b* of the first channel portion 81 is connected to the first introduction port 92.

Figure 13:
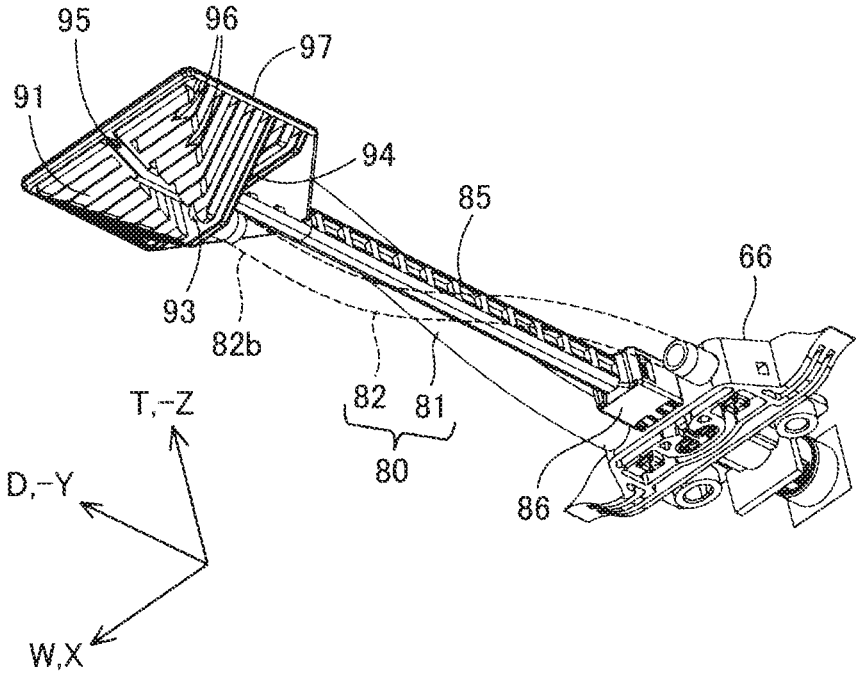
FIG. 13 is a second schematic perspective view of the spacer member and the liquid outlet tube.

FIG. 13 is a second schematic perspective view of the spacer member 90 and the liquid outlet tube 80. The second leading end portion 82*b* of the second channel portion 82 of the liquid outlet tube 80 is connected to the second introduction port 93. More specifically, a cylindrical second connection tube 93*a* that is in communication with the second introduction port 93 is provided on the face on the −D direction side of the rear face member 94 (see FIG. 11), and this second connection tube 93*a* is inserted into the second leading end portion 82*b* of the second channel portion 82, and thereby the second leading end portion 82*b* of the second channel portion 82 is connected to the second introduction port 93. In this embodiment, the lengths in the D direction of the second connection tube 93*a* and the first connection tube 92*a* are the same.

As shown in FIGS. 12 and 13, in this embodiment, the first leading end portion 81*b* of the first channel portion 81 and the second leading end portion 82*b* of the second channel portion 82 are fixed to the spacer member 90. On the other hand, in another embodiment, at least one of the first leading end portion 81*b* of the first channel portion 81 and the second leading end portion 82*b* of the second channel portion 82 may be separated from the spacer member 90. In this case, the first leading end portion 81*b* or the second leading end portion 82*b* separated from the spacer member 90 may introduce liquid directly, without the spacer member 90 being interposed therebetween.

As shown in FIGS. 12 and 13, the spacer member 90 is provided with a groove-shaped first channel 95 and second channels 96. The first channel 95 is a channel for flowing liquid from the +D direction to the first introduction port 92 and the second introduction port 93 positioned in the −D direction. The second channels 96 are channels for circulating liquid in a direction intersecting the D direction. In this embodiment, a plurality of second channels 96 are formed. The second channels 96 are constituted by forming grooves extending vertically along the W direction from the inclined face 91 of the spacer member 90. Note that the second channels 96 may be formed so as to circulate liquid in a direction intersecting both the W direction and the D direction. In addition, in another embodiment, at least one of the first channel 95 and the second channel 96 can be omitted.

In this embodiment, the spacer member 90 is provided with a plate-like partition portion 97 that lies along the DW plane that is the horizontal plane. The partition portion 97 is provided at a position between the first leading end portion

81*b* and the second leading end portion 82*b*, namely, a position between the first introduction port 92 and the second introduction port 93, in the T direction. In this embodiment, the central axis CX of the liquid outlet port 52 is included in the partition portion 97 (see FIG. 7). In other words, in this embodiment, the partition portion 97 is provided horizontally at the center of the storage portion 60*c*. It can also be said that a plurality of channels 96 are formed on the partition portion 97 by a plurality of ribs being provided. Note that in another embodiment, the partition portion 97 may be omitted.

Figure 14:
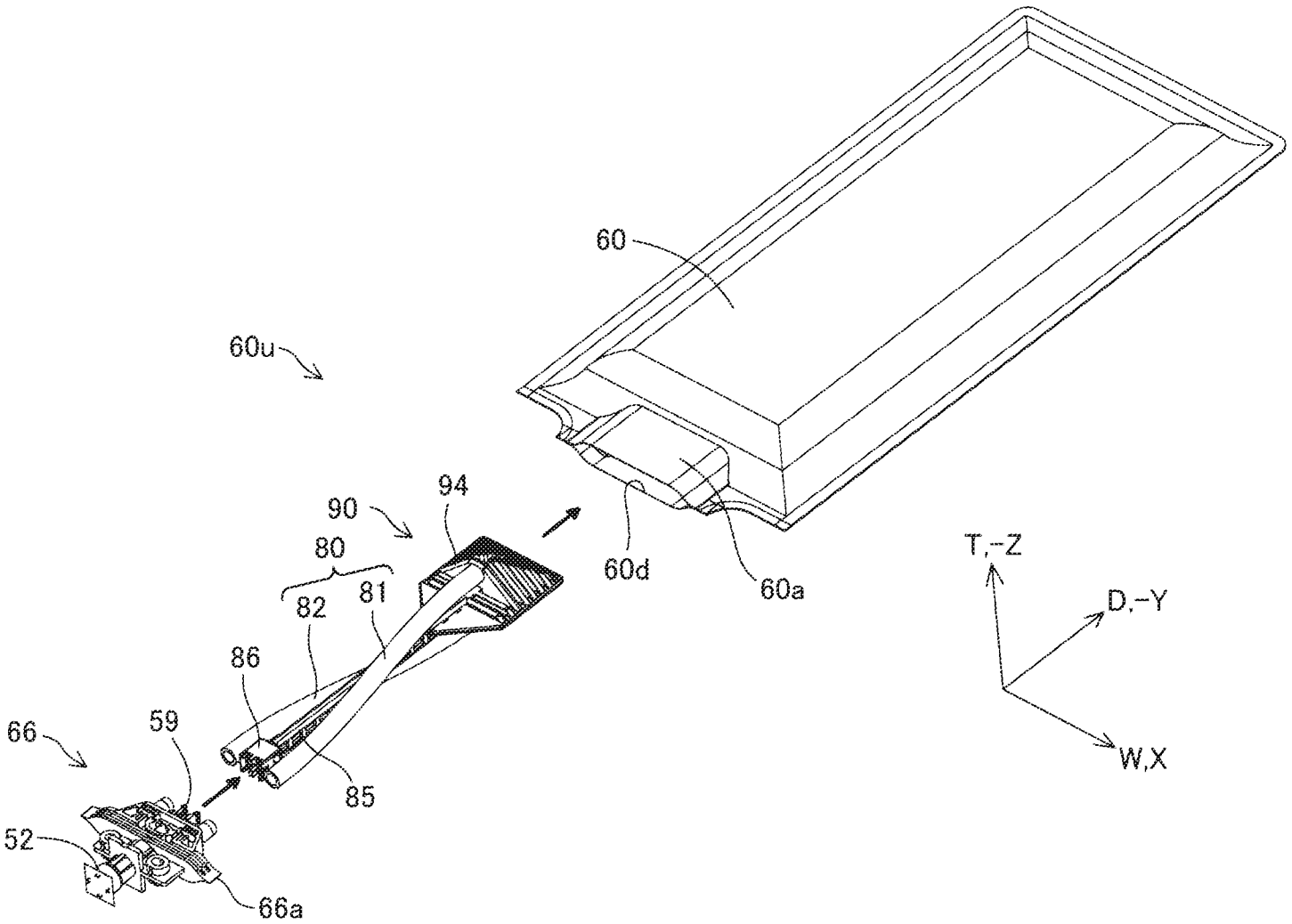
FIG. 14 is a first schematic exploded perspective view of a bag unit.
Figure 15:
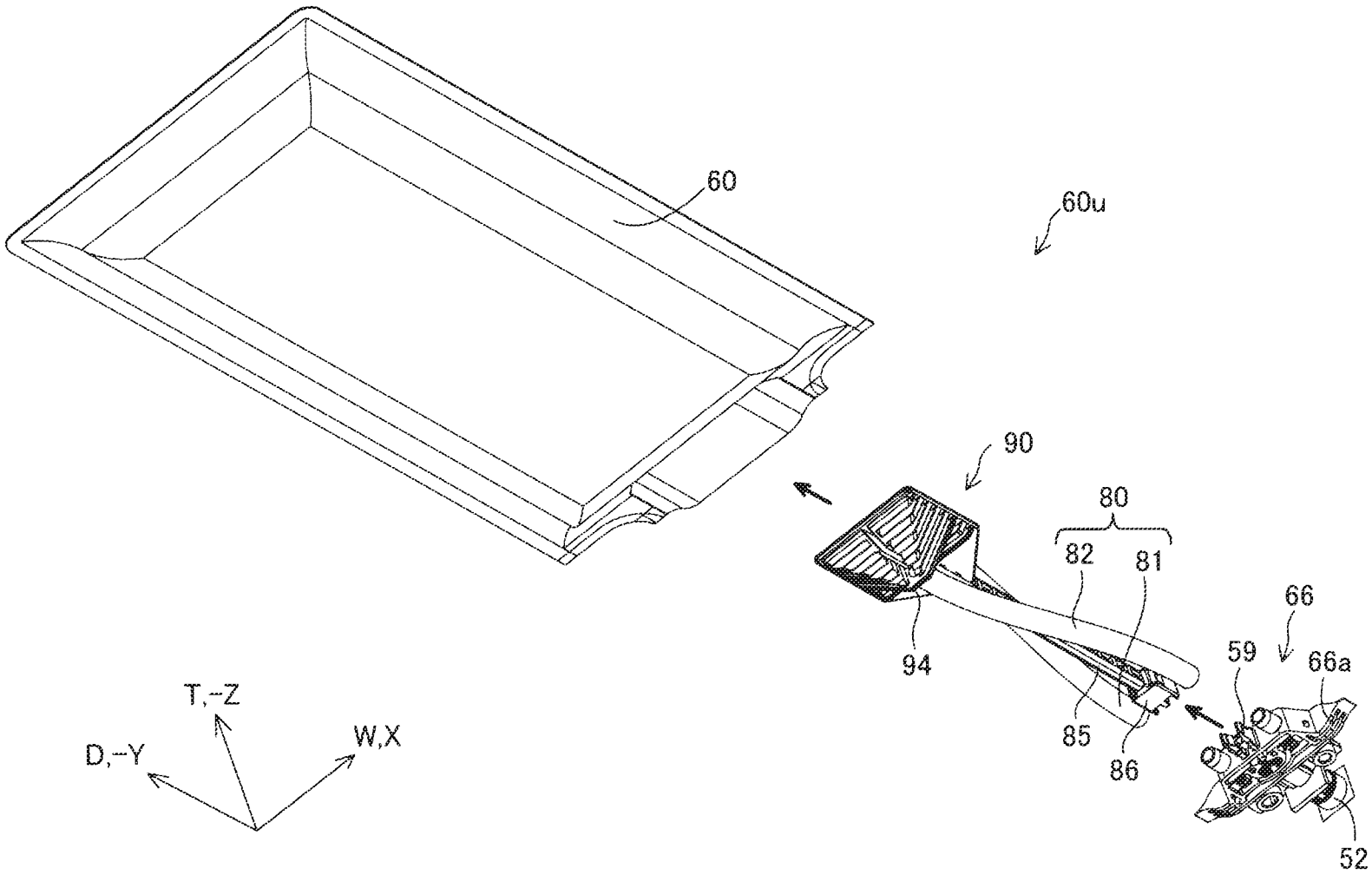
FIG. 15 is a second schematic exploded perspective view of the bag unit.

FIG. 14 is a first schematic exploded perspective view of a bag unit 60*u*. FIG. 15 is a second schematic exploded perspective view of the bag unit 60*u*. The bag 60 into which the spacer member 90 and the liquid outlet tube 80 are inserted, and whose one end portion 60*a* is welded to the liquid outlet member 66 is referred to as "bag unit 60*u*".

When manufacturing the liquid storage body 20, first, the spacer member 90 is fixed to the liquid outlet member 66 by coupling the engaging portion 86 provided on the coupling member 85 to the claw portion 59 provided in the liquid outlet member 66. The liquid outlet tube 80 that includes the first channel portion 81 and the second channel portion 82 is coupled to the spacer member 90 and the liquid outlet member 66. The liquid outlet member 66 to which the spacer member 90 and the liquid outlet tube 80 are connected is inserted from the spacer member 90 side into the bag 60 in which an opening portion 60*d* is provided in advance on the one end portion 60*a* side, through the opening portion 60*d*. When the spacer member 90 and the liquid outlet tube 80 are inserted into the bag 60, the opening portion 60*d* of the bag 60 is welded and joined to a welded portion 66*a* provided in the outer periphery of the liquid outlet member 66.

The welded portion 66*a* is a section in which the outer periphery of the liquid outlet member 66 is the largest. The size of the inner periphery of the opening portion 60*d* is larger than or equal to the size of the outer periphery of the welded portion 66*a* of the liquid outlet member 66. In addition, the size of the outer periphery of the welded portion 66*a* of the liquid outlet member 66 is larger than the size of the outer periphery of the rear face member 94 that has the largest outer periphery in the spacer member 90. Accordingly, in this embodiment, the spacer member 90 that is inserted into the bag 60 before the liquid outlet member 66 has a smaller outer periphery than the liquid outlet member 66, and thus the spacer member 90 can be easily inserted into the bag 60 during the manufacture of the liquid storage body 20. Therefore, it is possible to suppress damage due to the bag 60 excessively coming into contact with the spacer member 90 during manufacturing.

Figure 16:
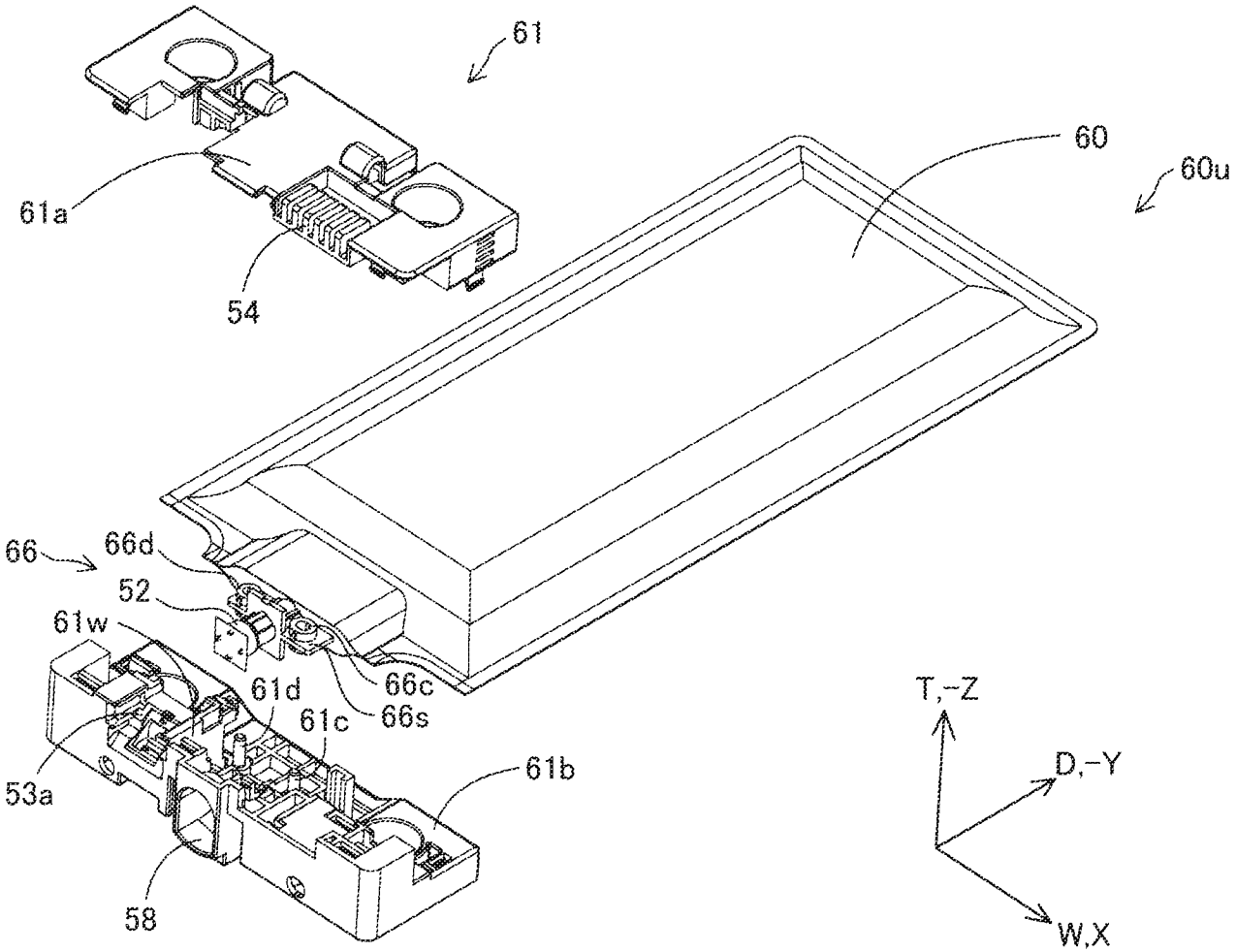
FIG. 16 is a schematic exploded perspective view of a connection member.

FIG. 16 is a schematic exploded perspective view of the connection member 61. The main body of the connection member 61 can be separated in the T direction, and is provided with a lid member 61*a* and a bottom member 61*b*. The bag unit 60*u* is fixed to the connection member 61 due to the lid member 61*a* and the bottom member 61*b* sandwiching the end portion on the −D direction side of the bag unit 60*u* from the +T direction side and the −T direction side.

The identification portion 54 is mainly formed in the lid member 61*a*. The above-described handle portion 62 (illustrated in FIGS. 4 and 5) is attached to the lid member 61*a*.

The insertion portion 58 and the terminal arrangement portion 53*a* are mainly formed in the bottom member 61*b*. In this embodiment, a first protrusion 61*c* and a second protrusion 61*d* are provided on the bottom member 61*b* so as to be directed in the +T direction. The first protrusion 61*c* and the second protrusion 61*d* are provided at positions sandwiching the insertion portion 58 in the W direction. A fixing portion 66*s* provided at a portion of the liquid outlet member 66 that is exposed from the bag 60 in the −D direction is provided with a first through hole 66*c* and a second through hole 66*d* at positions sandwiching the liquid outlet port 52. The first protrusion 61*c* is inserted into the first through hole 66*c*, and the second protrusion 61*d* is inserted into the second through hole 66*d*. A portion of the end portion on the −D direction side of the bag 60 along with the fixing portion 66*s* of the liquid outlet member 66 is sandwiched between the lid member 61*a* and the bottom member 61*b*.

Figure 17:
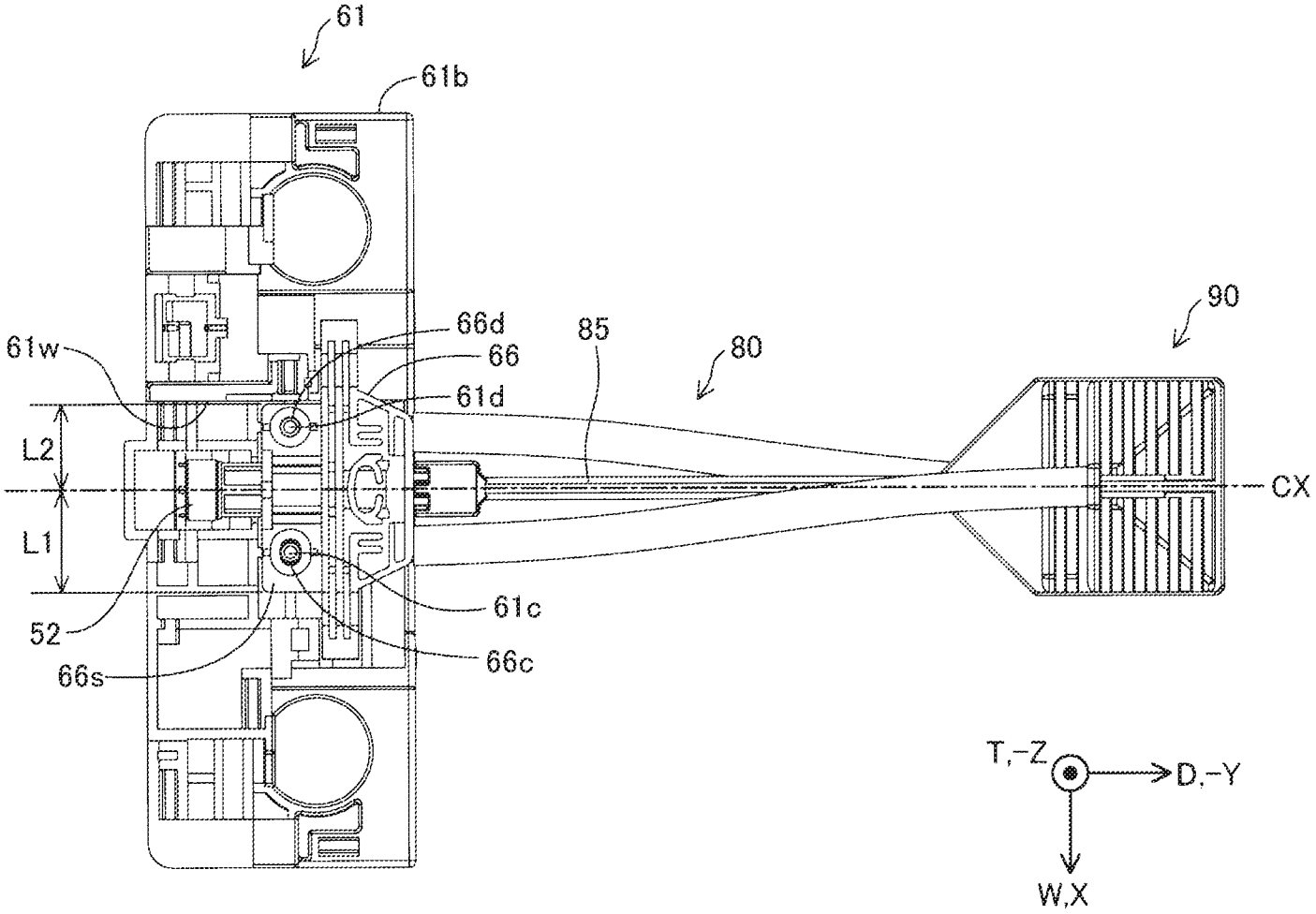
FIG. 17 is a schematic plan view showing a state where a liquid outlet member is fixed to a bottom member.
Figure 18:
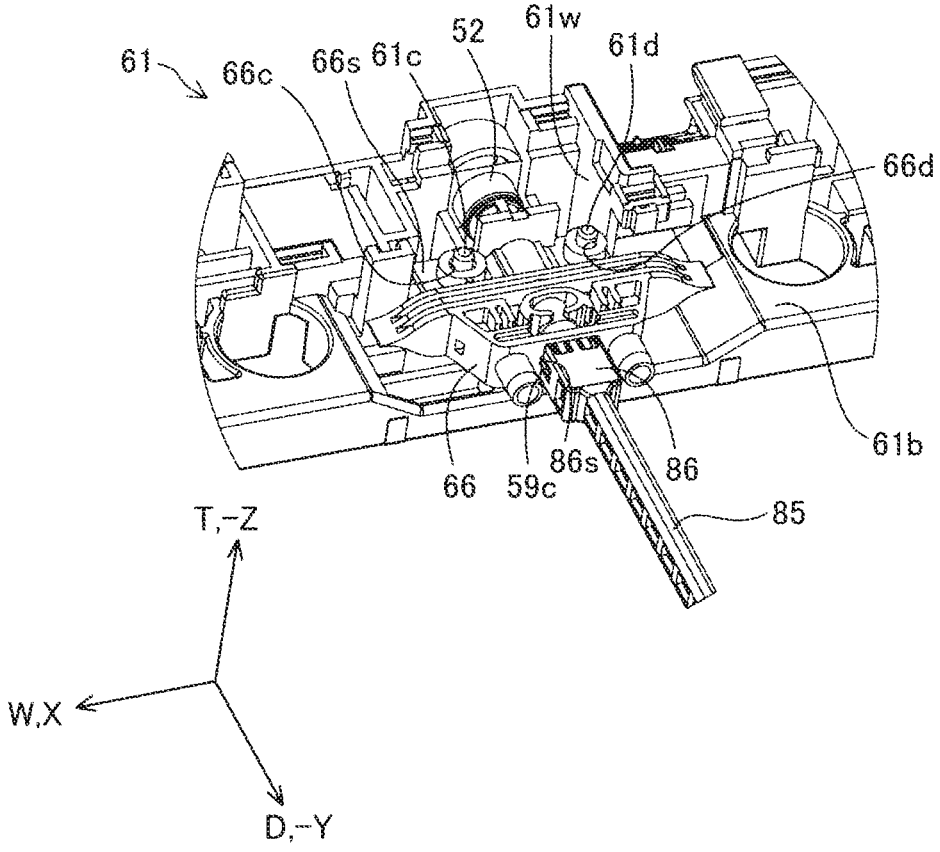
FIG. 18 is a schematic perspective view showing a state where a liquid outlet member is fixed to a bottom member.

FIG. 17 is a schematic plan view showing a state where the liquid outlet member 66 is fixed to the bottom member 61*b*. FIG. 18 is a schematic perspective view showing an extracted portion of FIG. 17 in which the liquid outlet member 66 is fixed. In FIGS. 17 and 18, illustration of the bag 60 is omitted.

As described above, the first through hole 66*c* into which the first protrusion 61*c* is inserted and the second through hole 66*d* into which the second protrusion 61*d* is inserted are provided at positions sandwiching the liquid outlet port 52 in the fixing portion 66*s* of the liquid outlet member 66. The first through hole 66*c* and the second through hole 66*d* are provided at substantially the same distance in opposite directions from the central axis CX of the liquid outlet port 52, and are aligned in the W direction.

The length of the fixing portion 66*s* from the central axis CX in the +W direction and the length of the fixing portion 66*s* in the −W direction are different. Specifically, a length L2 of the fixing portion 66*s* from the central axis CX in the −W direction, which is on the second protrusion 61*d* side, is shorter than a length L1 of the fixing portion 66*s* in the +W direction, which is on the first protrusion 61*c* side (L2<L1). In other words, the liquid outlet member 66 is formed to be asymmetrical relative to the central axis CX between the −W direction and the +W direction. In addition, a contact wall 61*w* is provided on the bottom member 61*b*, and is directed in the +T direction so as to be in contact with the end portion on the −W direction side of the fixing portion 66*s* on which the length of the fixing portion 66*s* is shorter. In this embodiment, with such a structure, the liquid outlet member 66 is prevented from being mounted to the bottom member 61*b* in a vertically inversed manner. Note that the first through hole 66*c* provided in the fixing portion 66*s* is preferably a substantially elliptic shaped elongated hole longer in the W direction in order to prevent the liquid outlet member 66 from being disabled to be mounted to the bottom member 61*b* due to a manufacturing error.

Figure 19:
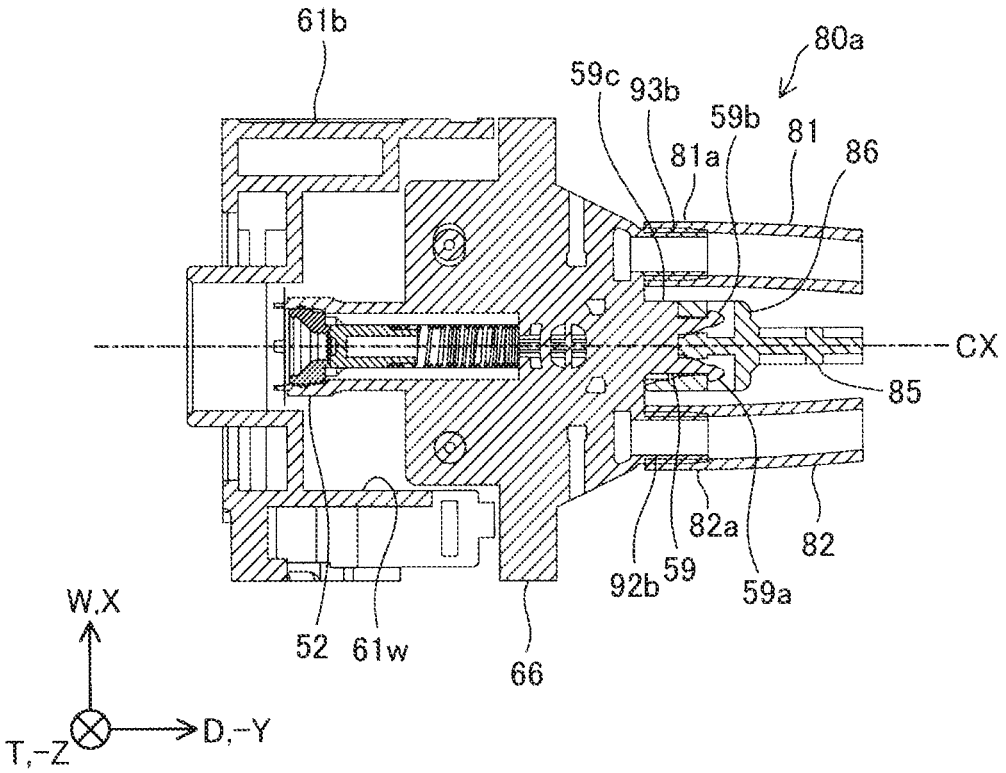
FIG. 19 is a schematic cross-sectional view showing a coupling section of the liquid outlet member, the liquid outlet tube, and a coupling member.

FIG. 19 is a schematic cross-sectional view showing a coupling section of the liquid outlet member 66, the liquid outlet tube 80, and the coupling member 85. The claw portion 59 of the liquid outlet member 66 is provided in the end portion on the −Y direction side of the liquid outlet member 66. The claw portion 59 is provided with a first claw 59*a* and a second claw 59*b* that extend in the +D direction, and are aligned in the W direction. The first claw 59*a* is arranged on the −W direction side, and the second claw 59*b* is arranged on the +W direction side. The leading end portions in the +D direction of the first claw 59*a* and the second claw 59*b* are respectively provided with protrusions directed in the opposite directions, and are fitted in openings provided in side faces of the engaging portion 86. Also as shown in FIG. 18, at the base end portion on the +W direction side of the second claw 59*b*, a rib 59*c* is formed from the −D direction toward the +D direction. The engaging portion 86 is provided with a slit 86*s* at a position corresponding to this rib 59*c*. In this embodiment, with such a structure, the spacer member 90 leading to the engaging portion 86 is prevented from being connected to the liquid outlet member 66 in a vertically inverted manner.

As shown in FIG. 19, at the end portion in the +D direction side of the liquid outlet member 66, a third connection tube 92*b* and a fourth connection tube 93*b* that are cylindrical, protrude in the +D direction, and are arranged in the storage portion 60*c* of the bag 60. The two connection tubes 92*b* and 93*b* are arranged to be aligned in the W direction sandwiching the claw portion 59. In this embodiment, the distance from the central axis CX of the liquid outlet port 52 to the third connection tube 92*b* and the distance from the central axis CX to the fourth connection tube 93*b* are equal. The third connection tube 92*b* and the fourth connection tube 93*b* communicate with the liquid outlet port 52, in the liquid outlet member 66. The third connection tube 92*b* is inserted at the base end portion of the second channel portion 82, and the fourth connection tube 93*b* is inserted at the base end portion of the first channel portion 81, and thus the liquid outlet tube 80 (the first channel portion 81 and the second channel portion 82) is fixed to the liquid outlet member 66.

In this embodiment, the internal diameters of the first channel portion 81 and the second channel portion 82 are the same, and the external diameters of these are also the same. Furthermore, in this embodiment, the internal diameters of the third connection tube 92*b* and the fourth connection tube 93*b* are the same, and the external diameters of these are also the same. Accordingly, in this embodiment, the ratio of the amount of liquid flowing into the first channel portion 81 to the amount of liquid flowing into the second channel portion 82 is defined according to the difference in the internal diameter between the first introduction port 92 and the second introduction port 93 provided in the spacer member 90. Therefore, members of the first channel portion 81 and the second channel portion 82 can be used in common. In addition, members of the first channel portion 81 and the second channel portion 82 can be used in common, and thus it is possible to prevent the first channel portion 81 and the second channel portion 82 from being attached in a reversed manner. Note that in another embodiment, the internal diameters of the first channel portion 81 and the second channel portion 82 may be different, and the external diameters of these may also be different. In addition, the internal diameters of the third connection tube 92*b* and the fourth connection tube 93*b* may be different, and the external diameters of these may also be different.

(4) Manufacturing Method and Configuration of Liquid Storage Body

Figure 20:
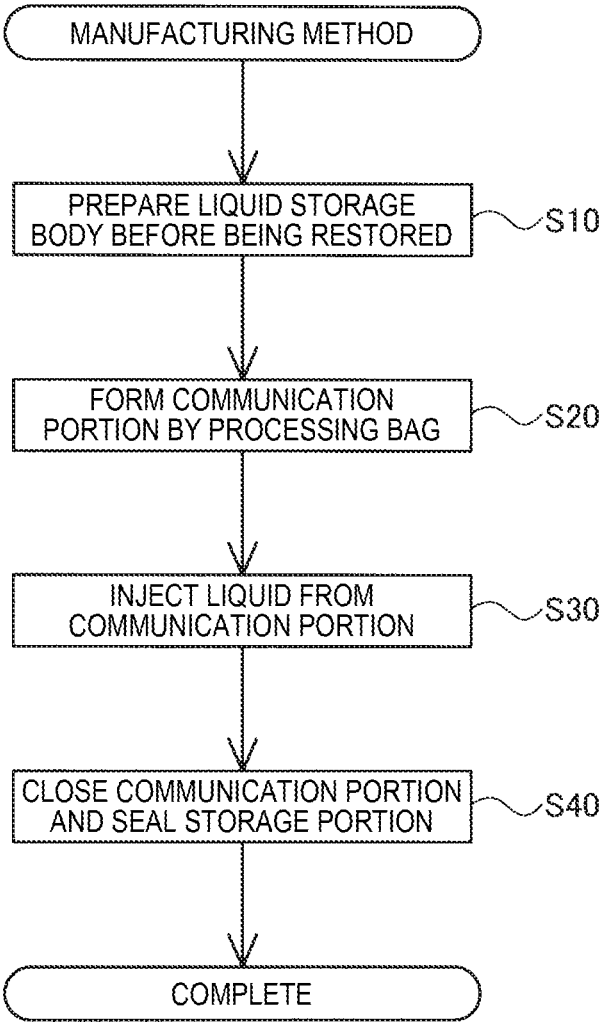
FIG. 20 is a flow chart showing a manufacturing process of a restored liquid storage body of a first embodiment.

FIG. 20 is a flow chart showing a manufacturing process of the liquid storage body 20A illustrated in FIG. 21C to be described below. The liquid storage body 20A is acquired by replenishing, with liquid, the liquid storage body 20 used in the liquid ejection apparatus 11 and then removed from the liquid ejection apparatus 11, and restoring the capability of supplying liquid to the liquid ejection apparatus 11. Note that the manufacturing process that will be described below can be interpreted as a method for restoring the liquid storage body 20.

In step S10, the pre-restored storage body 20 is prepared. The pre-restored storage body 20 is a used liquid storage body that was mounted in the liquid ejection apparatus 11, used for supplying liquid to the liquid ejection apparatus 11, and then removed from the liquid ejection apparatus 11. Hereinafter, the liquid storage body 20 before being restored that is to be processed in a subsequent process is also referred to as "pre-restored storage body 20".

The pre-restored storage body 20 is desirably in a used state where the amount of the liquid contained in the bag 60 has been decreased below a predetermined lower limit amount. The "predetermined lower limit amount" may be, for example, an amount in accordance with which the control apparatus 42 determines, through exchange of information with the storage-body-side electrical connection portion 53, that liquid in the liquid storage body 20 is scarce, in a state where the liquid storage body 20 is mounted in the liquid ejection apparatus 11.

Figure 21A:
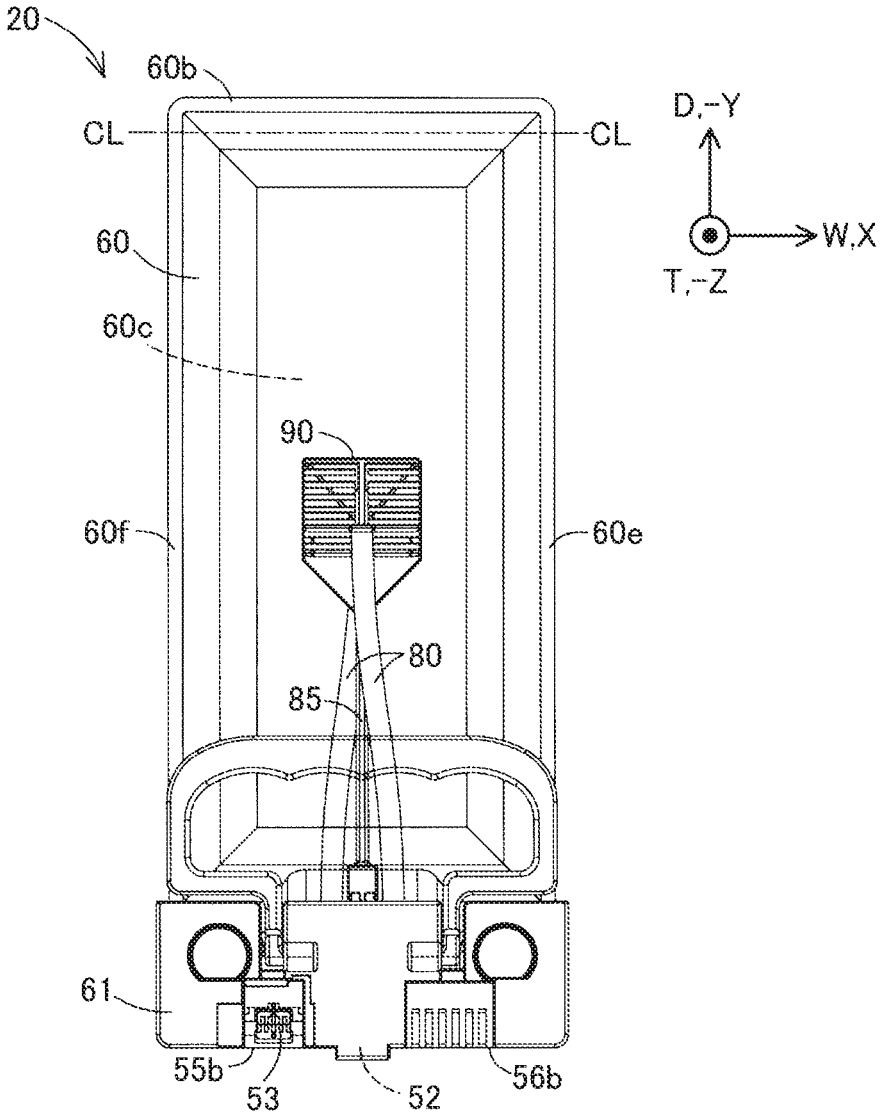
FIG. 21A is a first schematic view showing a manufacturing process of a liquid storage body in the first embodiment.
Figure 21B:
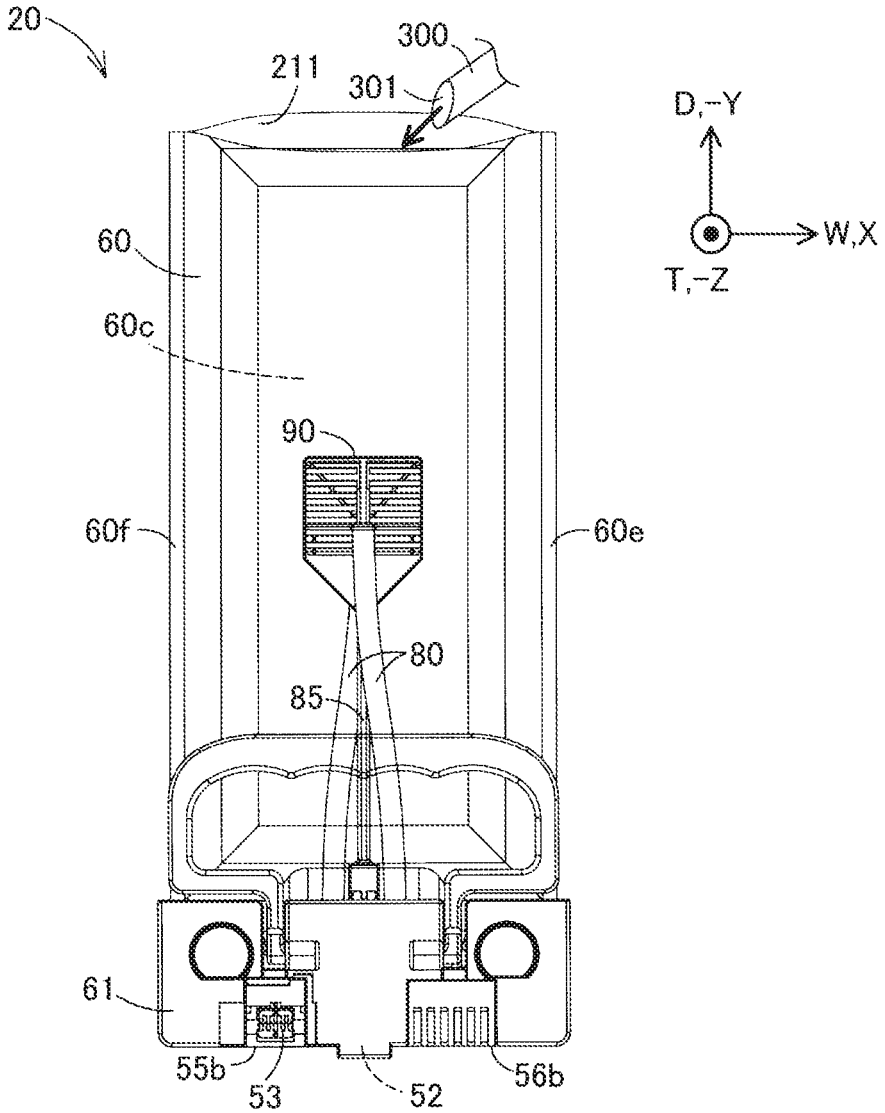
FIG. 21B is a second schematic view showing a manufacturing process of the liquid storage body in the first embodiment.
Figure 21C:
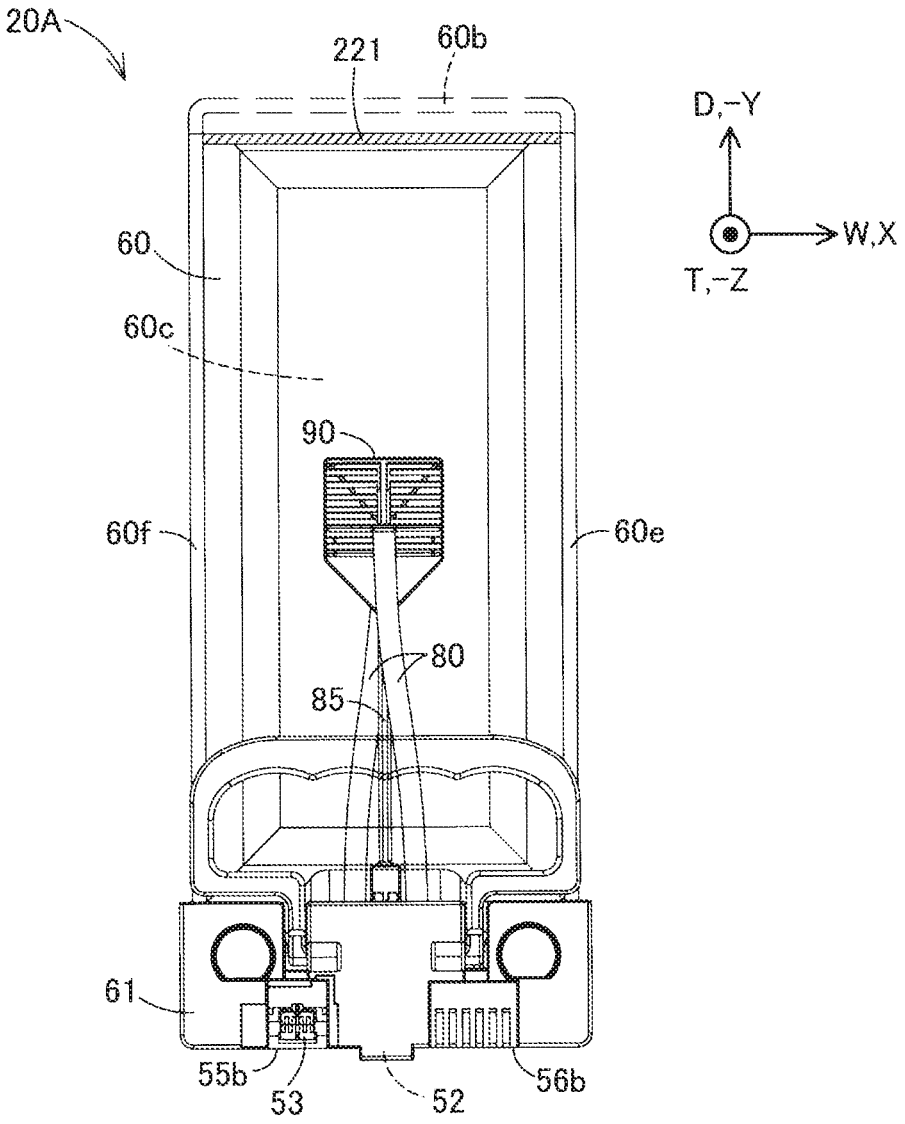
FIG. 21C is a schematic view showing a restored liquid storage body in the first embodiment.

FIGS. 21A to 21C are schematic views showing the processes in steps S20 to S40. In FIGS. 21A to 21C, for convenience, the liquid outlet tube 80, the coupling member 85, and the spacer member 90 that are arranged in the bag 60 are illustrated as being visible in a transparent manner. Note that the liquid outlet tube 80, the coupling member 85, and the spacer member 90 are illustrated similarly also in the drawings referenced in embodiments to be described later.

In step S20, a communication portion 211 (see FIG. 21B) that is in communication with the storage portion 60*c*, which is an internal space of the bag 60, is formed by processing the bag 60. In step S20 of this embodiment, the communication portion 211 is formed by cutting and removing at least a portion of the other end portion 60*b* that is the end portion on the −Y direction side of the bag 60. In step S20, for example, the communication portion 211 that is open in the −Y direction as illustrated in FIG. 21B is formed by cutting away a section that includes the other end portion 60*b* that is the end portion on the −Y direction side of the bag 60, along a cutting line CL as illustrated in FIG. 21A.

In step S20, the bag 60 is desirably cut at a position on the −Y direction side relative to the arrangement position of the spacer member 90 in the storage portion 60*c*. Accordingly, the spacer member 90 can remain to be arranged in the storage portion 60*c*.

In step S20, the communication portion 211 is desirably formed at a position closer to the other end portion 60*b* in the Y direction so as to suppress a reduction in the amount of liquid that can be contained in the storage portion 60*c*. More specifically, the communication portion 211 is desirably formed at a position at which the distance from the connection member 61 in the Y direction is 80% or more of the distance from the connection member 61 to the other end portion 60*b* in the Y direction. Note that the communication portion 211 does not need to be formed by cutting and removing the entirety of the other end portion 60*b*. The communication portion 211 may be formed by partially cutting and removing a portion of the other end portion 60*b*.

In step S30, as shown in FIG. 21B, liquid is injected into the bag 60 through the communication portion 211 formed in step S20. FIG. 21B illustrates a state where liquid is injected from an injection port 301 of an injection device 300 into the storage portion 60*c* of the bag 60. In step S30, liquid is injected into the bag 60 in a state where the bag 60 is brought into an orientation in which the communication portion 211 is open in the direction opposite to the gravity direction. In the first embodiment, the bag 60 is brought into an orientation in which the Y direction lies along the gravity direction, and liquid is injected into the bag 60.

In step S40, the communication portion 211 is closed, and the storage portion 60*c* of the bag 60 is sealed. In this embodiment, the communication portion 211 is closed by overlapping and welding peripheral end portions of the communication portion 211 that oppose each other in the Z direction. The communication portion 211 is desirably welded at the position of the liquid surface in the storage portion 60*c* such that air does not enter the storage portion 60*c*.

FIG. 21C is a schematic plan view of the liquid storage body 20A restored in steps S10 to S40, when viewed in the +Z direction. FIG. 21C illustrates, with hatching, a region in which a seal portion 221 is formed as a result of the communication portion 211 being sealed in step S40. In addition, in FIG. 21C, for comparison, the position of the other end portion 60*b* that is a seal portion of the pre-restored storage body 20 is indicated by broken lines.

The restored liquid storage body 20A can be attached/detached to/from the same case 13 in which the pre-restored storage body 20 was mounted. The restored liquid storage body 20A is mounted to the liquid ejection apparatus 11 in a state of being arranged in the case 13, as the pre-restored storage body 20. Hereinafter, a state where the restored liquid storage body 20A is mounted in the liquid ejection apparatus 11 is referred to as "mounted state", just like the pre-restored storage body 20. The restored liquid storage body 20A can supply the liquid in the storage portion 60*c* to the liquid ejection apparatus 11 in the mounted state, just like the pre-restored storage body 20.

The bag 60 of the restored liquid storage body 20A has, in the end portion on the −Y direction side thereof, a section positioned on the +Y direction side relative to the position of the other end portion 60*b* of the bag 60 of the pre-restored storage body 20 in the mounted state. The user can easily distinguish between the pre-restored storage body 20 and the restored liquid storage body 20A, according to a difference in the position and shape of the end portion on the −Y direction side of the bag 60.

In addition, the seal portion 221 of the bag 60 of the restored liquid storage body 20A is a section formed at a position different from the seal portion in the bag 60 of the pre-restored storage body 20. The user can easily distinguish between the pre-restored storage body 20 and the restored liquid storage body 20A, according to whether or not there is the seal portion 221.

The restored liquid storage body 20A is provided with the connection member 61 in which the liquid outlet port 52, the storage-body-side electrical connection portion 53, the first receiving portion 55*b*, and the second receiving portion 56*b* are provided, similar to the pre-restored storage body 20. Therefore, similar to the pre-restored storage body 20, it is easy to couple the restored liquid storage body 20A to the liquid ejection apparatus 11, and occurrence of an error of coupling to the liquid ejection apparatus 11 is suppressed.

In the orientation in the mounted state, similar to the pre-restored storage body 20, the width in the Z direction of the restored liquid storage body 20A is smaller than the width in the Y direction and the width in the X direction. Accordingly, similarly to the pre-restored storage body 20, the arrangement orientation of the restored liquid storage body 20A on the case 13 is stabilized.

In the case of the restored liquid storage body 20A, the liquid outlet tube 80, the coupling member 85, and the spacer member 90 are arranged in the bag 60. Therefore, similarly to the pre-restored storage body 20, liquid in the bag 60 is kept from remaining, and the concentration of liquid to be supplied to the liquid ejection apparatus 11 is kept from being uneven.

(5) Overview of First Embodiment

As described above, according to the manufacturing method of the liquid storage body 20A of the first embodiment, it is possible to easily restore the capability of the liquid storage body 20 of supplying liquid to the liquid ejection apparatus 11. According to the manufacturing method of the first embodiment, even when the amount of liquid contained in the liquid storage body 20 decreases below the lower limit value, the liquid storage body 20 does not need to be discarded, and can be reused as the restored liquid storage body 20A, and thus it is possible to reduce the cost for operating the liquid ejection apparatus 11. In addition, according to the restored liquid storage body 20A in the first embodiment, the restored liquid storage body 20A makes it possible to acquire actions and effects that are similar to those acquired using configurations common to the pre-restored storage body 20. Besides, according to the restored liquid storage body 20A and the manufacturing method thereof in the first embodiment, it is possible to exert various actions and effects described in the first embodiment.

2. Second Embodiment

Figure 22A:
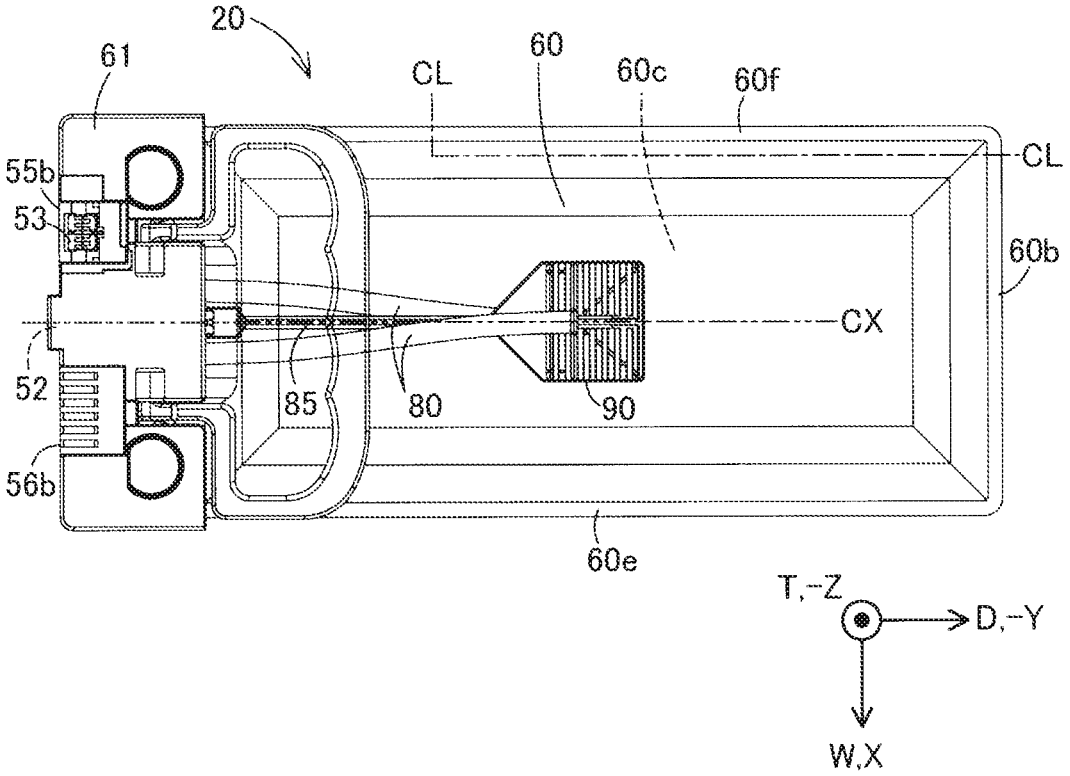
FIG. 22A is a first schematic view showing a manufacturing process of a liquid storage body in a second embodiment.

A manufacturing method of a liquid storage body 20B in a second embodiment and the configuration of the liquid storage body 20B will be described with reference to FIGS. 22A to 22C. The manufacturing method in the second embodiment is substantially the same as steps S10 to S40 (see FIG. 20) described in the first embodiment, except that the forming position of a communication portion 212 (see FIG. 22B) is different.

In step S20 of the second embodiment, the communication portion 212 is formed by cutting and removing at least a portion of the end portion on the +X direction side or the end portion on the −X direction side of the bag 60 of the pre-restored storage body 20 that has been prepared in step S10. In the examples in FIGS. 22A and 22B, the communication portion 212 that is open in the −X direction is formed by cutting and removing a portion of the second side end portion 60*f* that is the end portion on the −X direction side of the bag 60, at a position indicated by the cutting line CL in FIG. 22A.

The communication portion 212 may be formed by cutting and removing a portion of the first side end portion 60*e* that is the end portion on the +X direction side of the bag 60, in place of the second side end portion 60*f*. In addition, the communication portion 212 may be formed by cutting and removing the entirety of the first side end portion 60*e* or the second side end portion 60*f*.

In step S20, the bag 60 is desirably cut at a position on the +X direction side or the −X direction side relative to the arrangement position of the spacer member 90 in the storage portion 60*c*. Accordingly, the spacer member 90 can remain to be arranged in the storage portion 60*c*.

In step S20, the communication portion 212 is desirably formed at a position closer to the side end portion 60*e* or 60*f* to be cut and removed, so as to suppress a reduction in the amount of liquid that can be contained in the storage portion 60*c*. More specifically, the communication portion 212 is desirably formed at a position at which the distance in the X direction from the central axis CX of the liquid outlet port 52 is 80% or more of the distance in the X direction from the central axis CX to the side end portion 60*e* or 60*f* to be cut and removed.

Figure 22B:
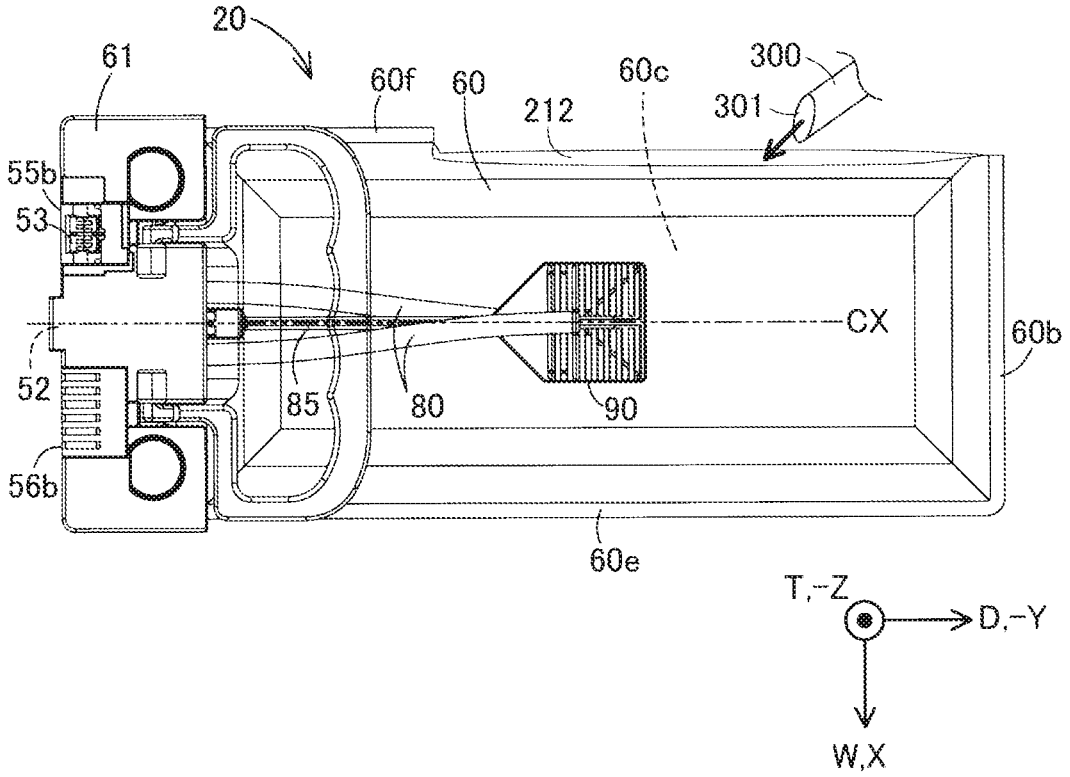
FIG. 22B is a second schematic view showing a manufacturing process of the liquid storage body in the second embodiment.

In step S30, as shown in FIG. 22B, the bag 60 is brought into an orientation in which the communication portion 212 is open on the side opposite to the gravity direction, and liquid is injected from the communication portion 212 into the storage portion 60*c* of the bag 60 using the injection device 300. In the second embodiment, the bag 60 is brought into an orientation in which the X direction lies along the gravity direction. After the storage portion 60*c* is replenished with liquid, the communication portion 212 is closed, and the storage portion 60*c* is sealed, in step S40. The communication portion 212 is sealed through welding, for example.

Figure 22C:
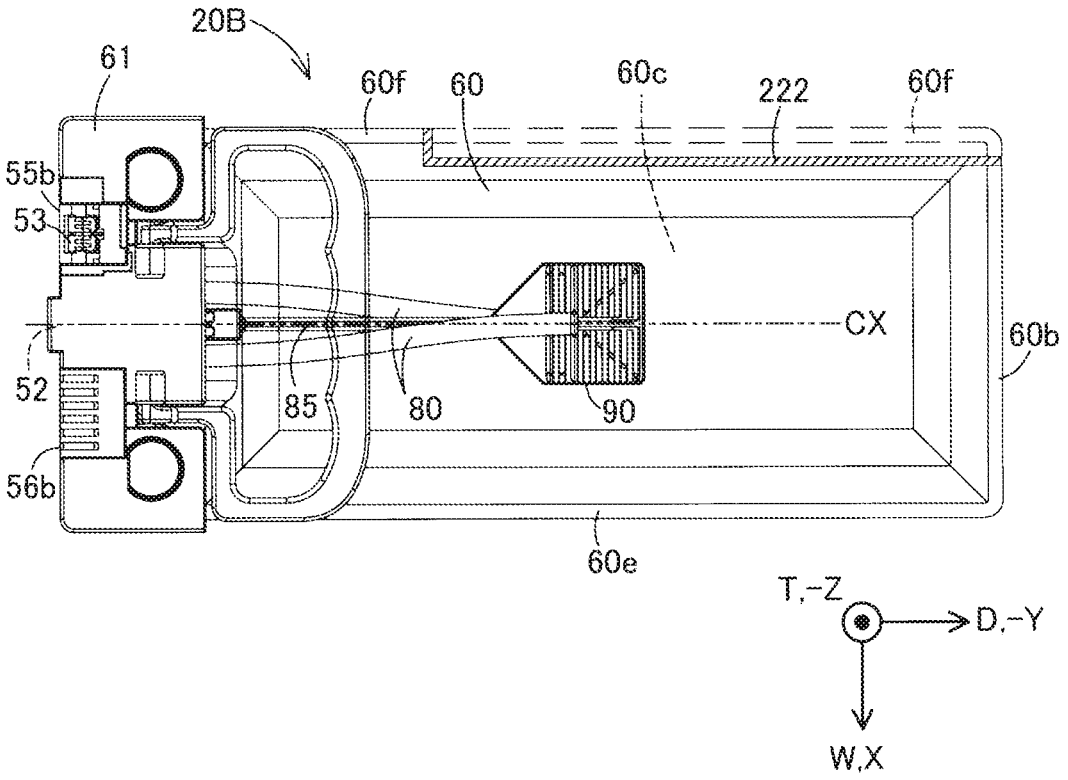
FIG. 22C is a schematic view showing a restored liquid storage body in the second embodiment.

FIG. 22C is a schematic plan view of the liquid storage body 20B restored in steps S10 to S40, when viewed in the +Z direction. FIG. 22C illustrates, with hatching, a region in which a seal portion 222 is formed as a result of the communication portion 212 being sealed in step S40. In addition, in FIG. 22C, for comparison, the position of the second side end portion 60*f* in the pre-restored storage body 20 is indicated by broken lines.

In the example in FIG. 22C, the bag 60 of the restored liquid storage body 20B has, at the end portion on the −X direction side thereof, a section positioned on the +X direction side relative to the second side end portion 60*f* on the −X direction side of the bag 60 in the pre-restored storage body 20, and positioned near the liquid outlet port 52 in the X direction. If the communication portion 212 is formed on the first side end portion 60*e* side in step S20, the bag 60 of the restored liquid storage body 20B has, at the end portion on the +X direction side, a section positioned on the −X direction side relative to the first side end portion 60*e* on the +X direction side of the bag 60 in the pre-restored storage body 20, and positioned near the liquid outlet port 52 in the X direction. The user can easily distinguish between the pre-restored storage body 20 and the restored liquid storage body 20B, according to a difference in the position and shape of the end portion on the X direction of the bag 60.

In addition, the seal portion 222 of the bag 60 of the restored liquid storage body 20B is a section formed at a position different from the seal portion in the bag 60 of the pre-restored storage body 20. The user can easily distinguish between the pre-restored storage body 20 and the restored liquid storage body 20B, according to whether or not there is the seal portion 222.

As described above, according to the manufacturing method of the liquid storage body 20B of the second embodiment, it is possible to easily restore the capability of the liquid storage body 20 of supplying liquid to the liquid ejection apparatus 11. Besides, according to the restored liquid storage body 20B and the manufacturing method thereof in the second embodiment, it is possible to exert various actions and effects described in the first embodiment and the second embodiment.

3. Third Embodiment

A manufacturing method of a liquid storage body 20C and the configuration of the liquid storage body 20C in a third embodiment will be described with reference to FIGS. 23A to 23C. The manufacturing method of the third embodiment is substantially the same as steps S10 to S40 (see FIG. 20) described in the first embodiment, except that the forming position of a communication portion 213 is different.

In step S20 of the third embodiment, the communication portion 213 is formed by cutting and removing one of corner portions C1 and C2 in the end portion on the −Y direction side of the bag 60 of the pre-restored storage body 20, which has been prepared in step S10. More specifically, the communication portion 213 is formed by cutting the bag 60 along the cut line CL that obliquely intersects the end portions 60*b* and 60*e* or 60*f* of the bag 60 that sandwich the corner portion C1 or C2 to be cut and removed.

Figure 23A:
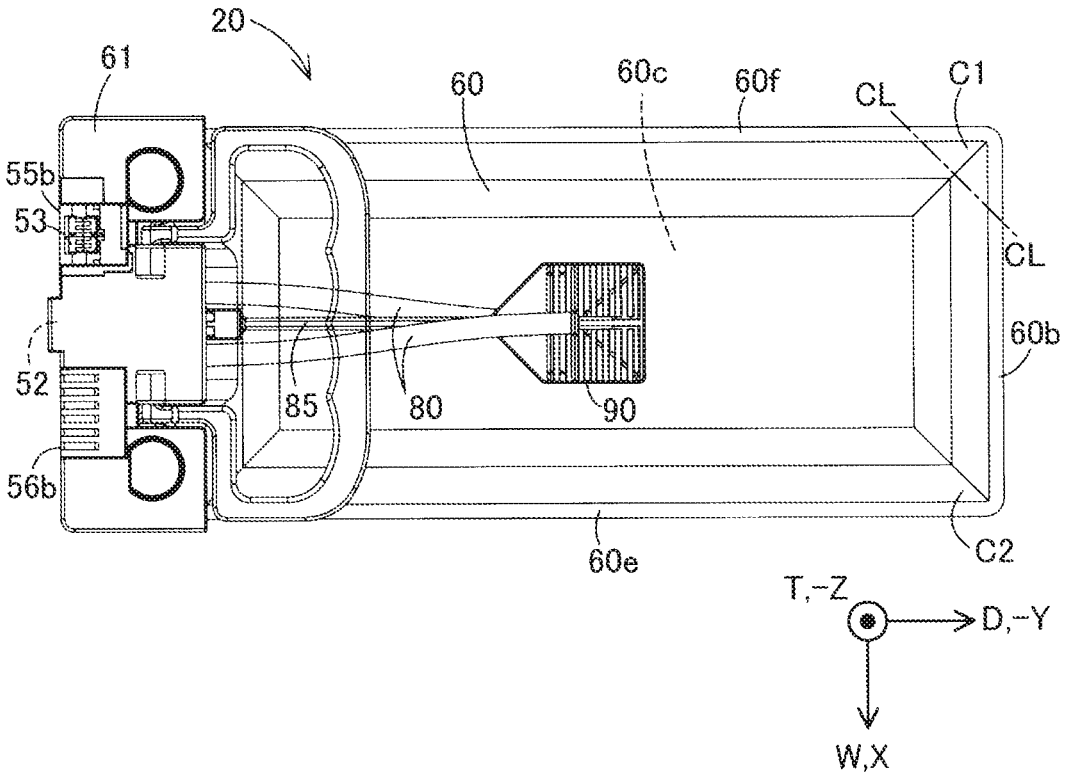
FIG. 23A is a first schematic view showing a manufacturing process of a liquid storage body in a third embodiment.
Figure 23B:
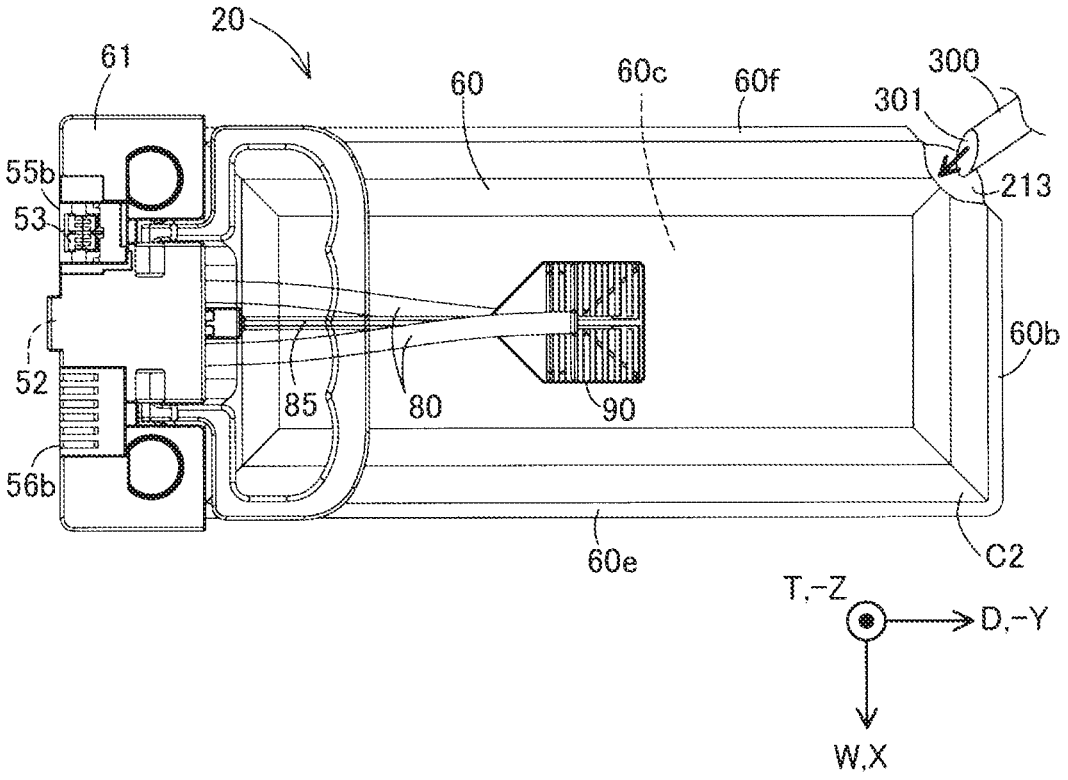
FIG. 23B is a second schematic view showing a manufacturing process of the liquid storage body in the third embodiment.

In the examples in FIGS. 23A and 23B, the corner portion C1 on the −X direction side of the bag 60 is cut and removed at a position indicated by the cut line CL in FIG. 23A so as to form the communication portion 213. The communication portion 213 may be formed by cutting and removing the corner portion C2 on the +X direction side of the bag 60 in place of the corner portion C1 on the −X direction side of the bag 60. In another embodiment, two communication portions 213 may be formed by cutting and removing two corner portions, namely both the corner portions C1 and C2 of the bag 60.

In step S20, the bag 60 is desirably cut at a position on the −Y direction side relative to the arrangement position of the spacer member 90 in the storage portion 60*c*. Accordingly, the spacer member 90 can remain to be arranged in the storage portion 60*c*.

In step S20, the area of the corner portion C1 or C2 that are cut and removed is desirably smaller so as to suppress a reduction in the amount of liquid that can be contained in the storage portion 60*c*. In step S20, the bag 60 is desirably cut along a cut line that connects a point in the second side end portion 60*f* at which the distance from the connection member 61 is 80% or more of the distance from the connection member 61 to the other end portion 60*b* and a point in the other end portion 60*b* at which the distance from the first side end portion 60*e* is 80% or more of the length in the X direction of the other end portion 60*b*. If the corner portion C2 is to be cut and removed, the bag 60 is desirably cut along a cut line that connects a point in the first side end portion 60*e* at which the distance from the connection member 61 is 80% or more of the distance from the connection member 61 to the other end portion 60*b* and a point in the other end portion 60*b* at which the distance from the second side end portion 60*f* is 80% or more of the length in the X direction of the other end portion 60*b*.

In step S30, as shown in FIG. 23B, the bag 60 is brought into an orientation in which the communication portion 213 is open on the side opposite to the gravity direction, and liquid is injected from the communication portion 213 to the storage portion 60*c* of the bag 60 using the injection device 300. In the third embodiment, when injecting liquid, the bag 60 is brought into an orientation in which the X direction lies along the gravity direction as shown in FIG. 23B. Note that the bag 60 may be brought into an orientation in which the connection member 61 side is the lower side, and the −Y direction side is the upper side. After the storage portion 60*c* is replenished with liquid, the communication portion 213 is closed and the storage portion 60*c* is sealed, in step S40.

Figure 23C:
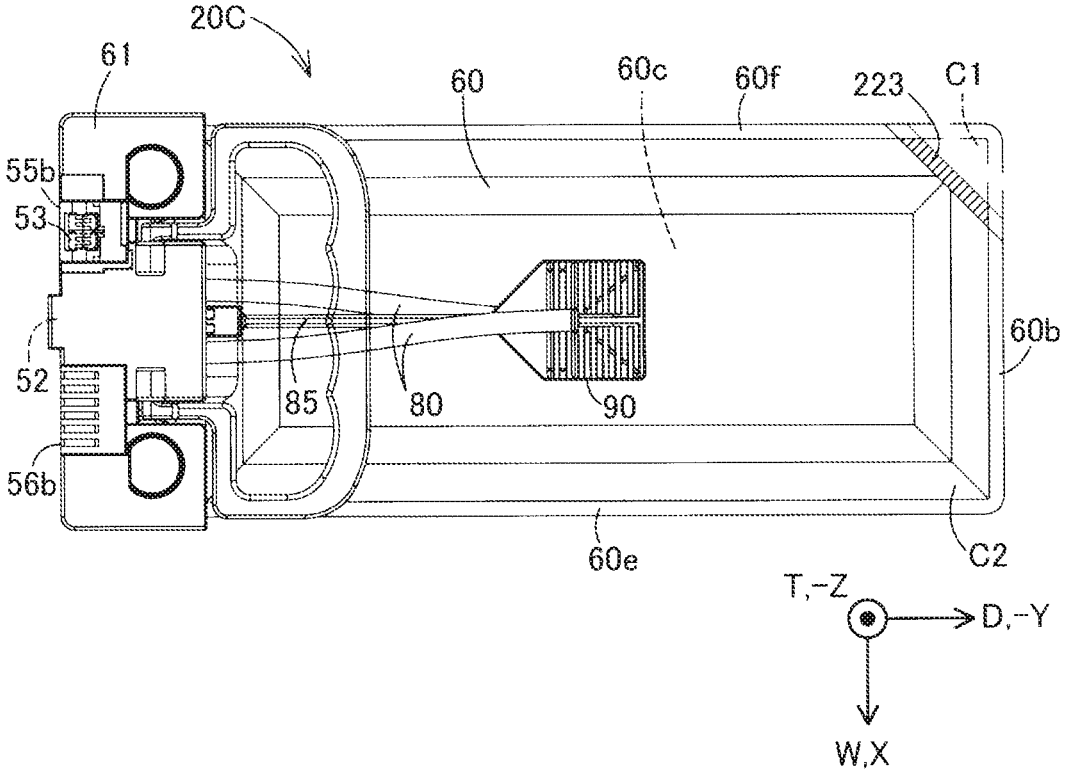
FIG. 23C is a schematic view showing a restored liquid storage body in the third embodiment.

FIG. 23C is a schematic plan view of the liquid storage body 20C restored in the above steps S10 to S40, when viewed in the +Z direction. FIG. 23C illustrates, with hatching, a region in which a seal portion 223 is formed as a result of the communication portion 213 being sealed in step S40. In addition, in FIG. 23C, for comparison, the cut and removed corner portion C1 is indicated by a broken line.

In the example of FIG. 23C, in the bag 60 of the restored liquid storage body 20C, a section between the second side end portion 60*f* on the −X direction side and the other end portion 60*b* on the −Y direction side in the mounted state has a shape in which the corner portion C1 in the bag 60 of the pre-restored storage body 20 is cut off. The user can easily determine that the liquid storage body 20C has been restored, according to the corner portion C1 being cut off.

In the restored liquid storage body 20C, the seal portion 223 that seals the communication portion 213 is formed in a section that has a shape in which the corner portion C1 is cut off. The seal portion 223 is a section formed at a position different from the seal portion in the bag 60 of the pre-restored storage body 20. The user can easily distinguish between the pre-restored storage body 20 and the restored liquid storage body 20C, according to whether or not there is the seal portion 223.

Note that, if the communication portion 213 is formed by cutting and removing the corner portion C2, a section between the first side end portion 60*e* on the +X direction side and the other end portion 60*b* on the −Y direction side in the mounted state has a shape in which the corner portion C2 is cut off. The seal portion 223 is then formed in the section having a shape in which the corner portion C2 is cut off.

As described above, according to the manufacturing method of the liquid storage body 20C of the third embodiment, it is possible to easily restore the capability of the liquid storage body 20 for supplying liquid to the liquid ejection apparatus 11. Besides, according to the restored liquid storage body 20C and the manufacturing method thereof in the third embodiment, it is possible to exert various actions and effects described in the first to third embodiments.

4. Fourth Embodiment

A manufacturing method of a liquid storage body 20D and the configuration of the liquid storage body 20D in a fourth embodiment will be described with reference to FIGS. 24A and 24B. The manufacturing method of the fourth embodiment is substantially the same as steps S10 to S40 (see FIG. 20) described in the first embodiment, except that the forming method and forming position of a communication portion are different, and a method for closing a through hole 214, which is a communication portion, is different.

Figure 24A:
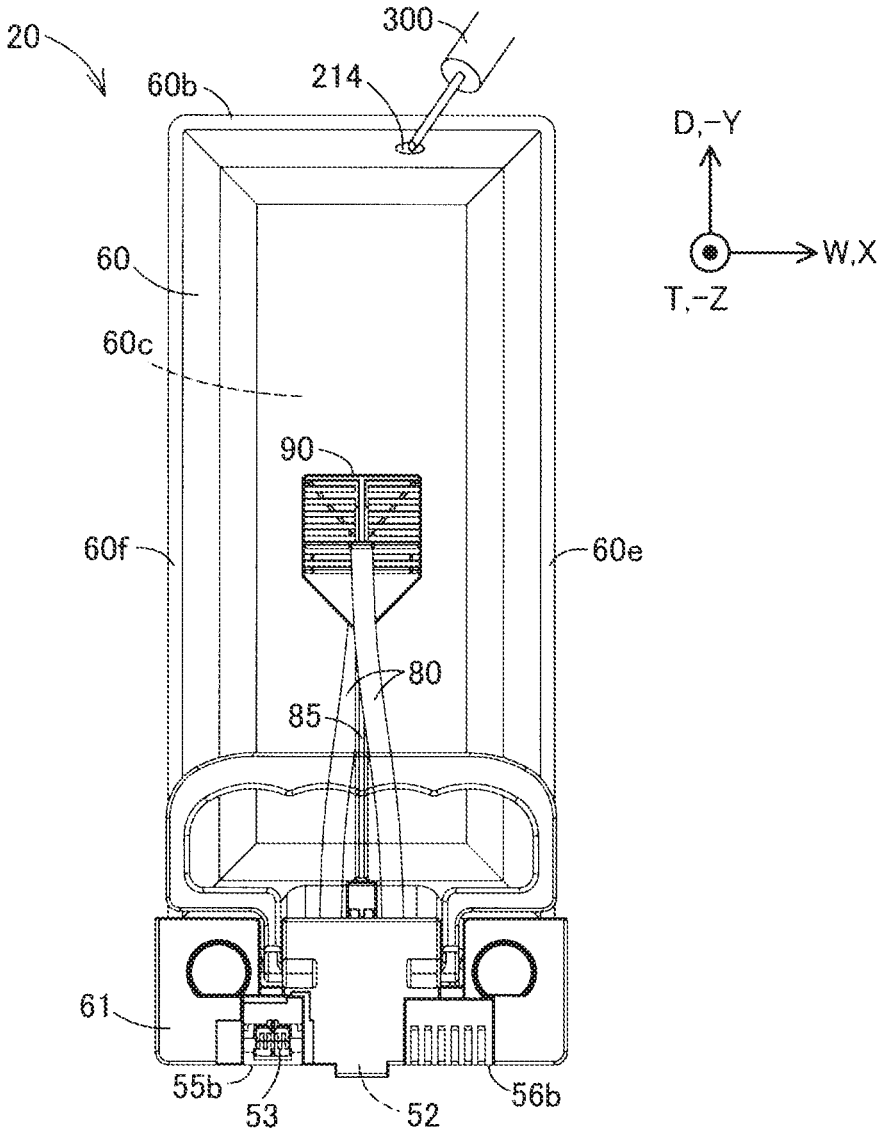
FIG. 24A is a schematic view showing a manufacturing process of a liquid storage body in a fourth embodiment.

In step S20 of the fourth embodiment, a communication portion that is in communication with the storage portion 60*c* is formed as the through hole 214 that passes through a film that constitutes the bag 60 of the pre-restored storage body 20, which has been prepared in step S10 (see FIG. 24A). The forming position of the through hole 214 is not particularly limited. In the example in FIG. 24A, the through hole 214 is formed as a substantially circular hole. The shape of the through hole 214 is not limited to a substantially circular shape, and, for example, the through hole 214 may be formed as a cut extending linearly.

In step S30, liquid is injected into the storage portion 60*c* via the through hole 214 using the injection device 300. Note that, a configuration may be adopted in which a syringe needle for injecting liquid as the injection device 300 is inserted into the bag 60 so as to form the through hole 214, and liquid is injected from the syringe needle into the bag 60, in steps S20 and S30.

Figure 24B:
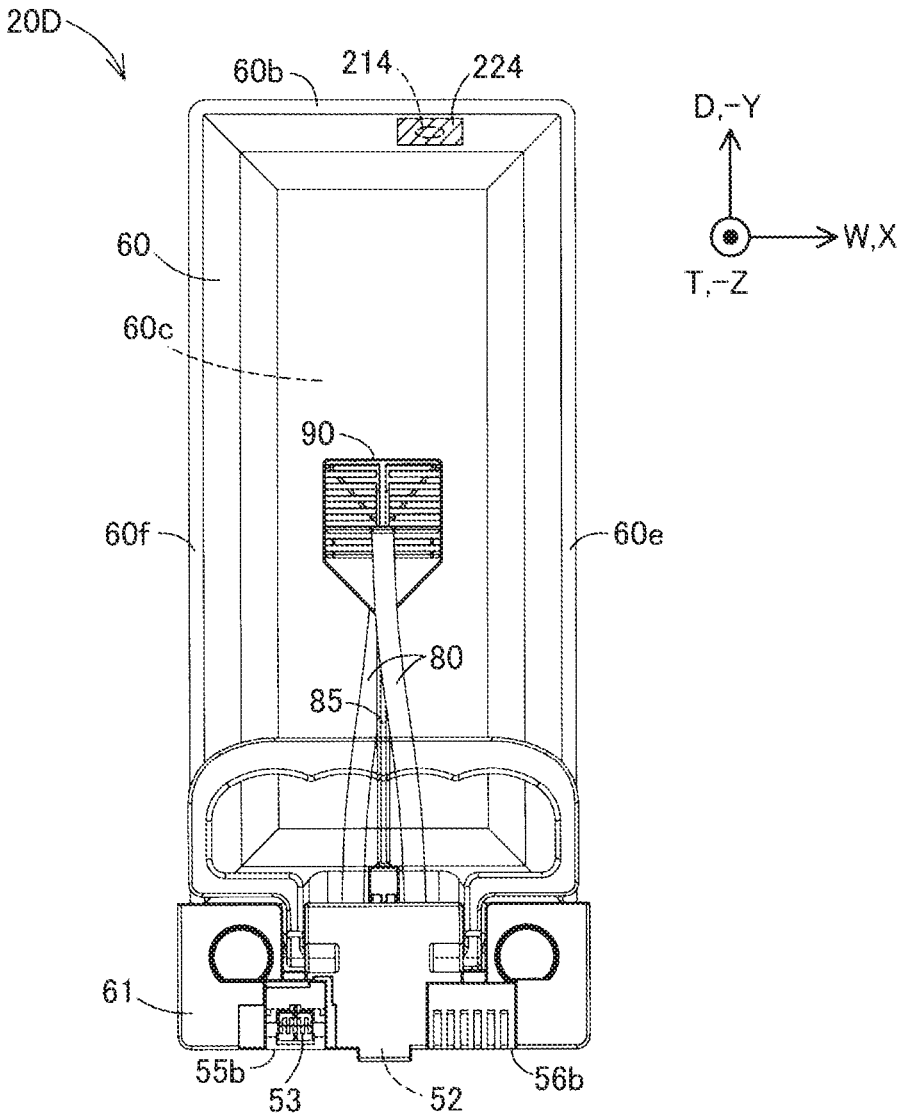
FIG. 24B is a schematic view showing a restored liquid storage body in the fourth embodiment.

FIG. 24B is a schematic plan view of the restored liquid storage body 20D when viewed in the +Z direction. In step S40, when an sealing member 224 that seals the through hole 214 is attached to the bag 60, the storage portion 60*c* is sealed. It can be interpreted that the sealing member 224 is a seal portion that is not included in the bag 60 of the pre-restored storage body 20, and is a seal portion formed at a position different from the seal portion in the bag 60 of the pre-restored storage body 20. The user can easily distinguish between the pre-restored storage body 20 and the restored liquid storage body 20D, according to the sealing member 224.

According to the manufacturing method of the liquid storage body 20D of the fourth embodiment, it is possible to inject liquid into the storage portion 60*c* without cutting the bag 60. Therefore, the volume of the storage portion 60*c* is kept from changing before and after restoration, and it is possible to suppress a reduction in the amount of liquid that can be contained in the restored liquid storage body 20D from the amount of liquid that can be contained in the pre-restored storage body 20.

As described above, according to the manufacturing method of the liquid storage body 20D of the fourth embodiment, it is possible to easily restore the capability of the liquid storage body 20 of supplying liquid to the liquid ejection apparatus 11. In addition, the amount of liquid that can be contained in the restored liquid storage body 20D can be kept from decreasing from the amount of liquid that can be contained the pre-restored storage body 20. Besides, according to the restored liquid storage body 20D and the manufacturing method thereof in the fourth embodiment, it is possible to exert various actions and effects described in the first to fourth embodiments.

5. Fifth Embodiment

Figure 25:
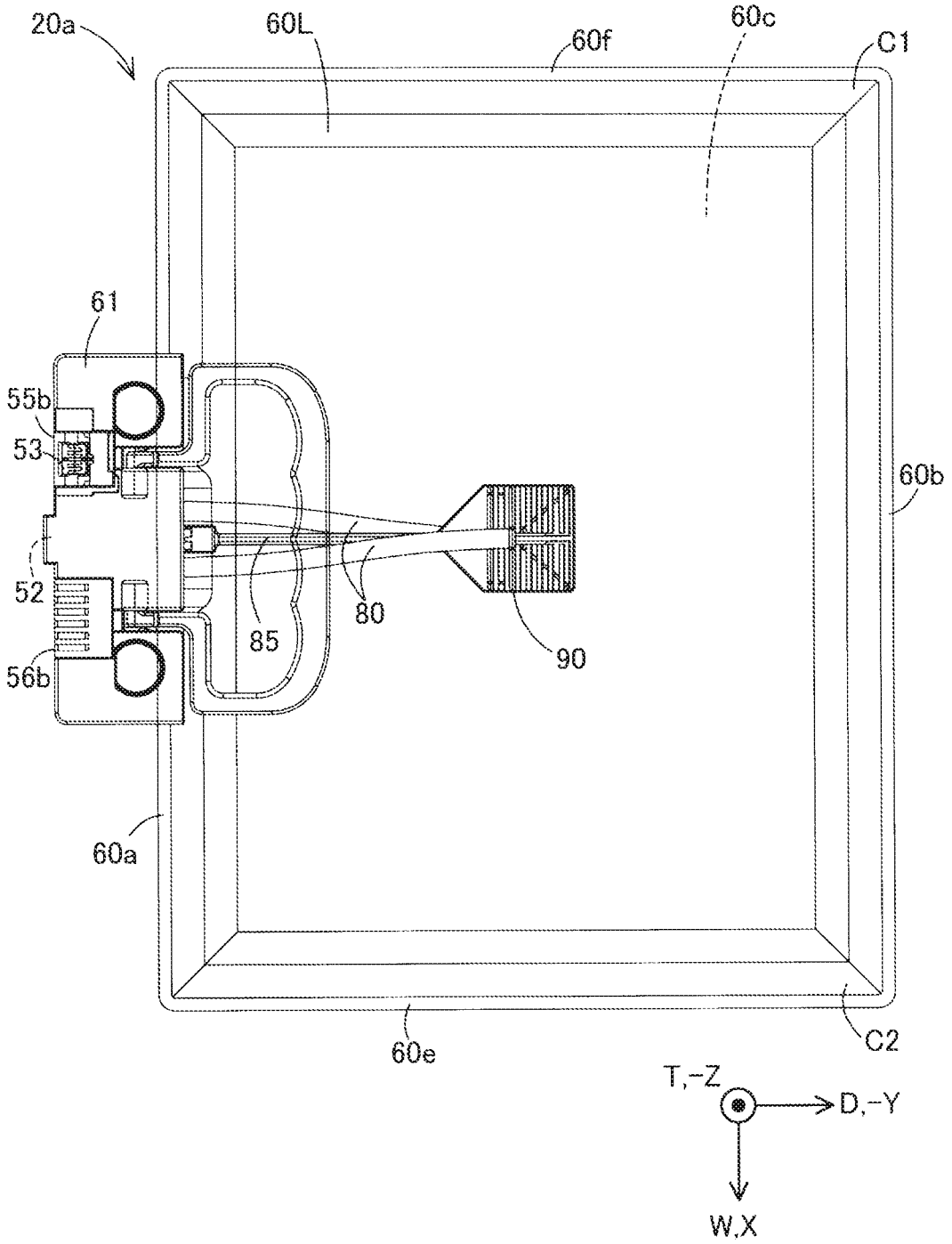
FIG. 25 is a schematic plan view showing a pre-restored liquid storage body in a fifth embodiment.

FIG. 25 is a schematic plan view of a liquid storage body 20*a* that is to be restored in the fifth embodiment, when viewed in the +Z direction. The configuration of the liquid storage body 20*a* is substantially the same as the liquid storage body 20 of the first embodiment, except that the amount of liquid that can be contained is larger due to the size in the X direction of a bag 60L being larger than the bag 60 of the liquid storage body 20 described in the first embodiment.

The liquid storage body 20*a* is provided with a connection member 61 having the same configuration as that described in the first embodiment. The connection member 61 is attached to substantially at the center in the X direction of an end portion 60*a* that is the end portion on the +Y direction side of the bag 60L. The bag 60L of the liquid storage body 20*a* has, on the two sides in the X direction of the connection member 61, sections extending from the connection member 61. The configuration of a case in which the liquid storage body 20*a* is mounted is substantially the same as the configuration of the case 13 described in the first embodiment, except that the width in the X direction is increased such that the liquid storage body 20*a* can be stored without folding the sections extending from the two sides of the connection member 61. The case is not illustrated for convenience. The liquid storage body 20*a* is stored in the case storage portion 14 (see FIG. 2) of the liquid ejection apparatus 11 in a state of being stored in the case. The liquid storage body 20*a* is coupled to the connection mechanisms 29 (see FIG. 3), and supplies liquid to the liquid ejection unit 21 of the liquid ejection apparatus 11.

Figure 26:
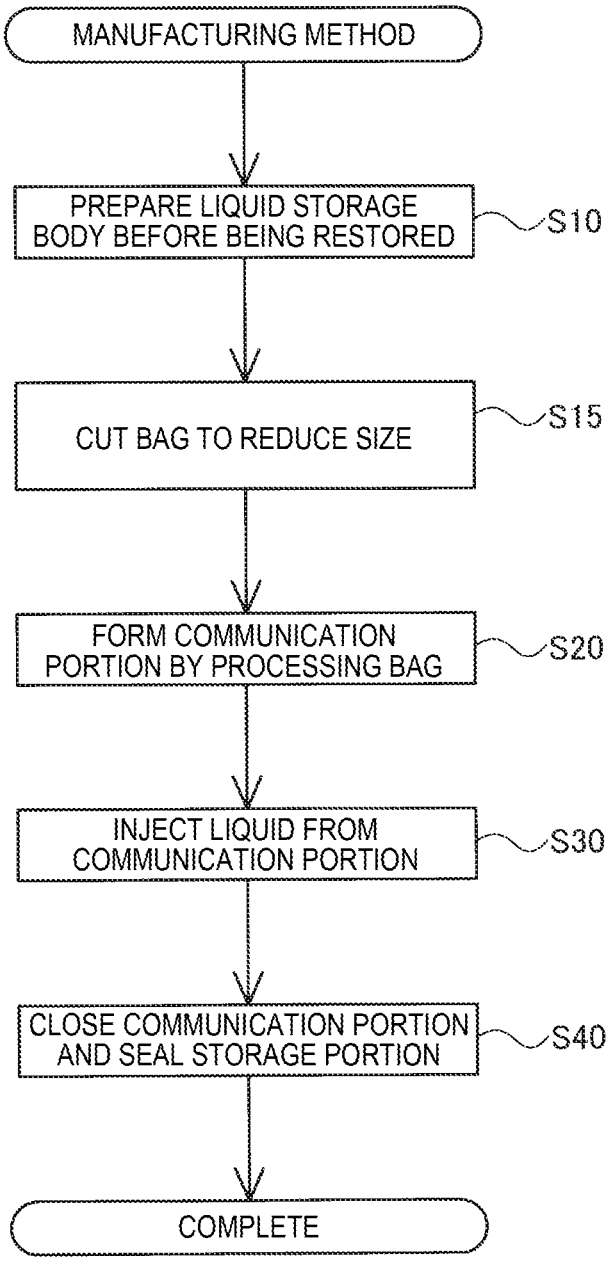
FIG. 26 is a flow chart showing a manufacturing process of a restored liquid storage body in the fifth embodiment.

FIG. 26 is a flow chart showing a manufacturing process of a restored liquid storage body 20E in the fifth embodiment illustrated in FIG. 28B to be described later. The manufacturing process in the fifth embodiment is substantially the same as the manufacturing process (see FIG. 20) described in the first embodiment, except that step S15 is added. In the manufacturing process of the fifth embodiment, the liquid storage body 20*a* is restored as the liquid storage body 20E, whose size in the X direction is reduced so as to be attachable/detachable to/from the case 13 (see FIGS. 4 and 5) described in the first embodiment.

In step S10, the used liquid storage body 20*a* used for supply of liquid to the liquid ejection apparatus 11, and then removed from the liquid ejection apparatus 11 is prepared as a target to be processed. Hereinafter, this liquid storage body 20*a* before being restored, which is to be processed, is also referred to as "pre-restored storage body 20*a*". In step S15, the bag 60L is cut on the two ends in the X direction thereof, so as to reduce the size in the X direction of the bag 60L.

Figure 27A:
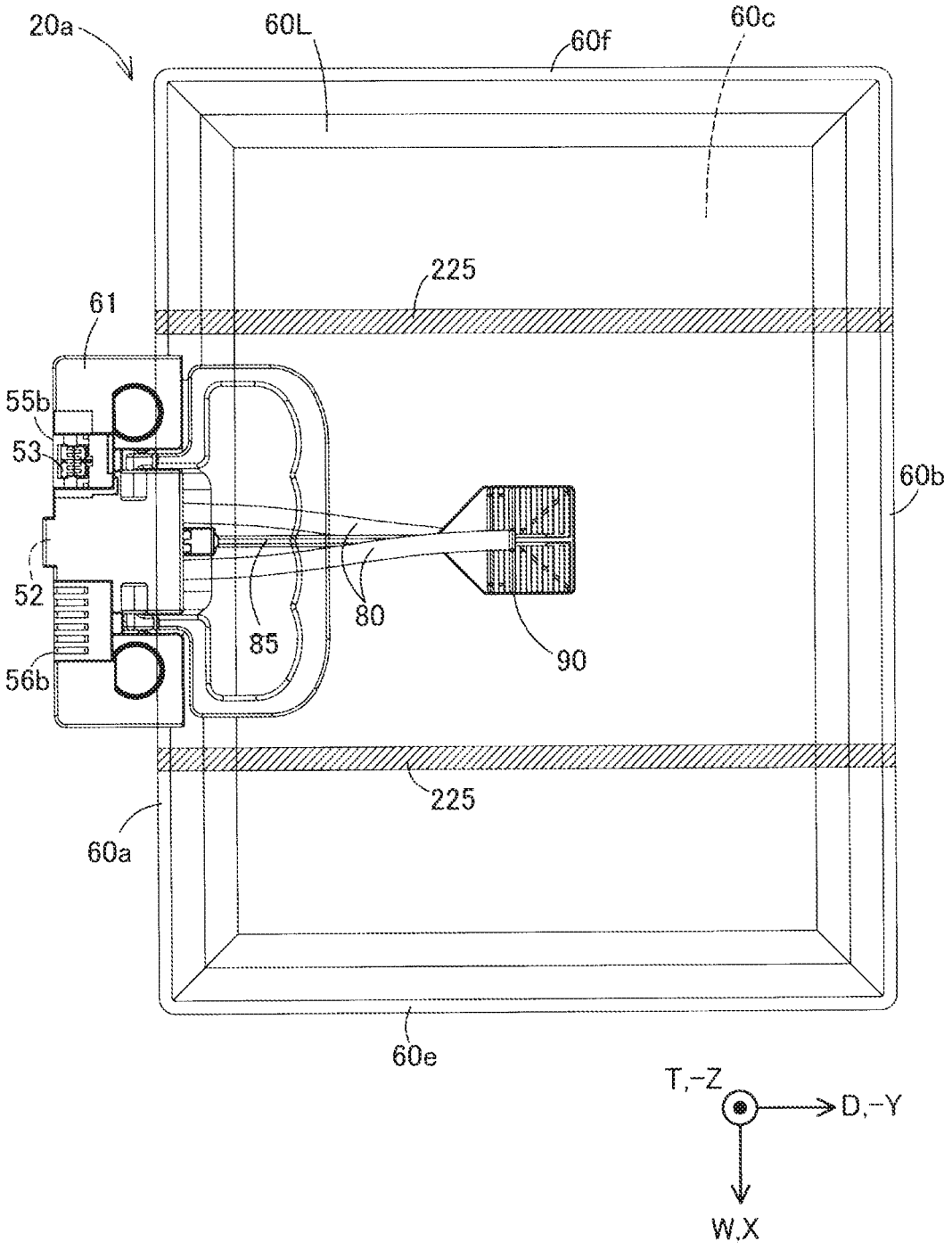
FIG. 27A is a first schematic view showing a manufacturing process of a liquid storage body in the fifth embodiment.

Description will be given with reference to FIGS. 27A and 27B. In step S15, first, seal portions 225 that seal, over the Y direction, the storage portion 60*c* on the two sides in the X direction thereof (see FIG. 27A) are formed. FIG. 27A illustrates, with hatching, the forming regions of the seal portions 225. The seal portions 225 are formed through ultrasonic welding, for example. The seal portions 225 are respectively formed on two ends in the X direction of the connection member 61. The seal portions 225 are desirably formed at positions corresponding to the positions of the first side end portion 60*e* and the second side end portion 60*f* in the liquid storage body 20 of the first embodiment.

Figure 27B:
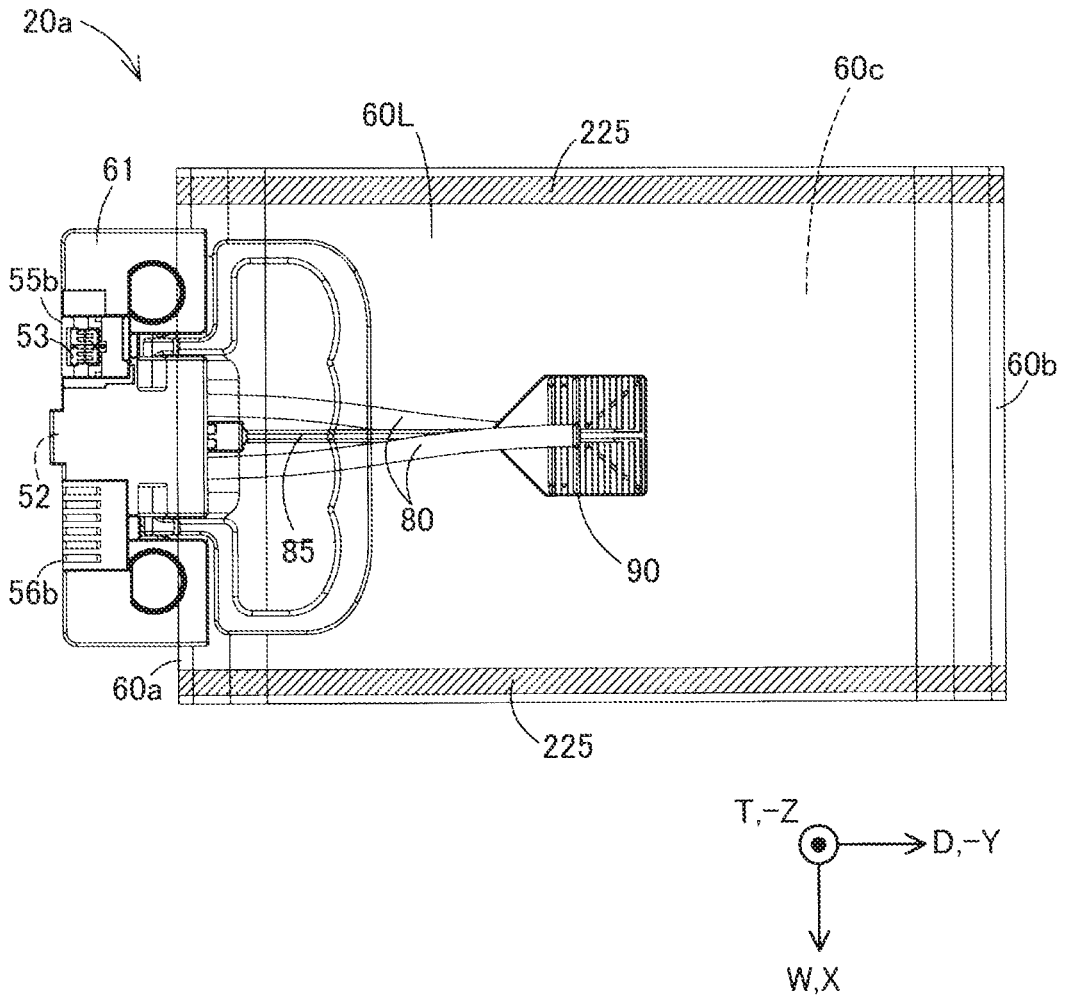
FIG. 27B is a second schematic view showing a manufacturing process of the liquid storage body in the fifth embodiment.

Next, as illustrated in FIG. 27B, sections positioned outside of a region sandwiched by the seal portions 225 are cut and removed. Accordingly, the width in the X direction of the bag 60L is reduced to a width that is about the same as the bag 60 of the liquid storage body 20 described in the first embodiment, and the bag 60L is sized so as to be able to be easily stored in the case 13 (see FIGS. 4 and 5) described in the first embodiment.

Figure 28A:
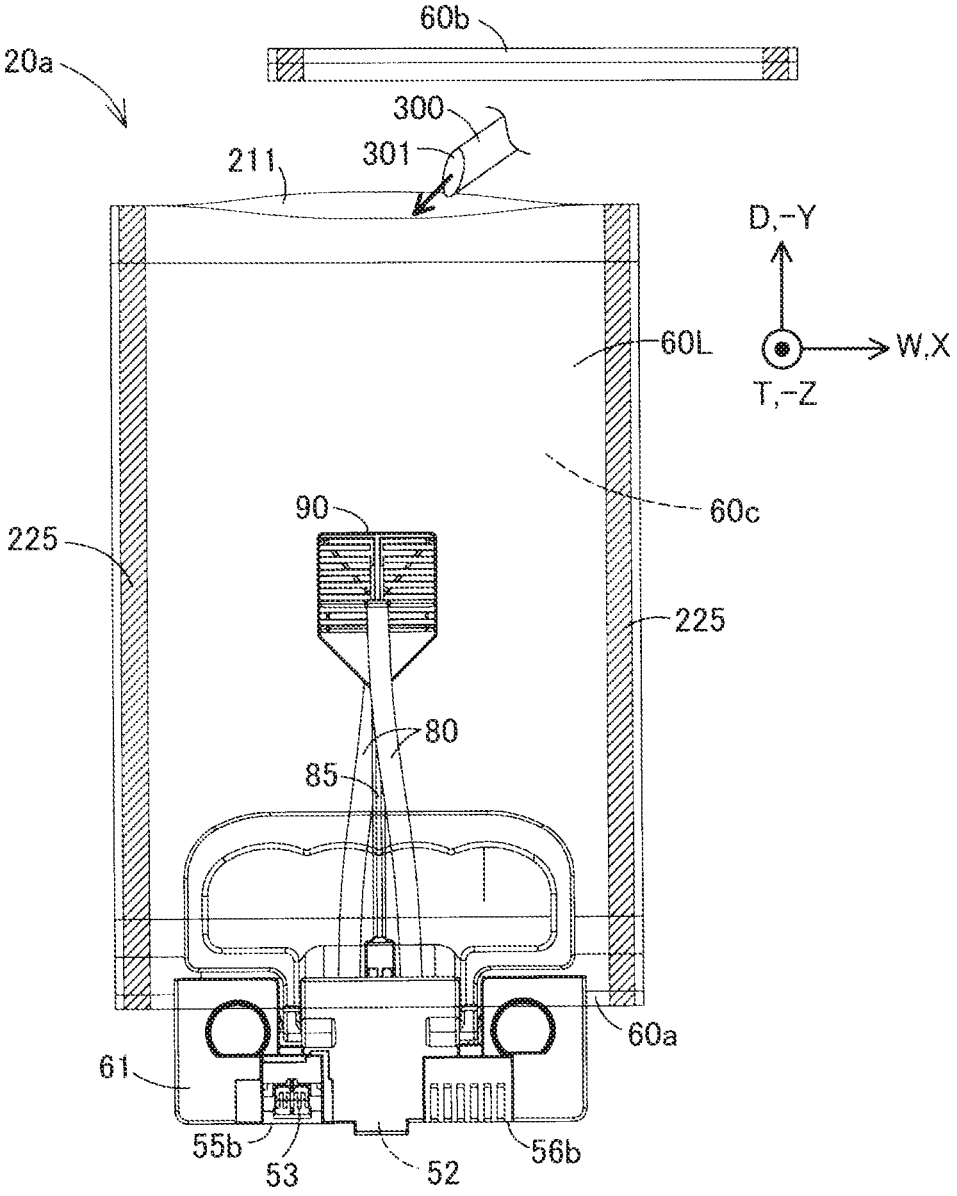
FIG. 28A is a third schematic view showing a manufacturing process of the liquid storage body in the fifth embodiment.
Figure 28B:
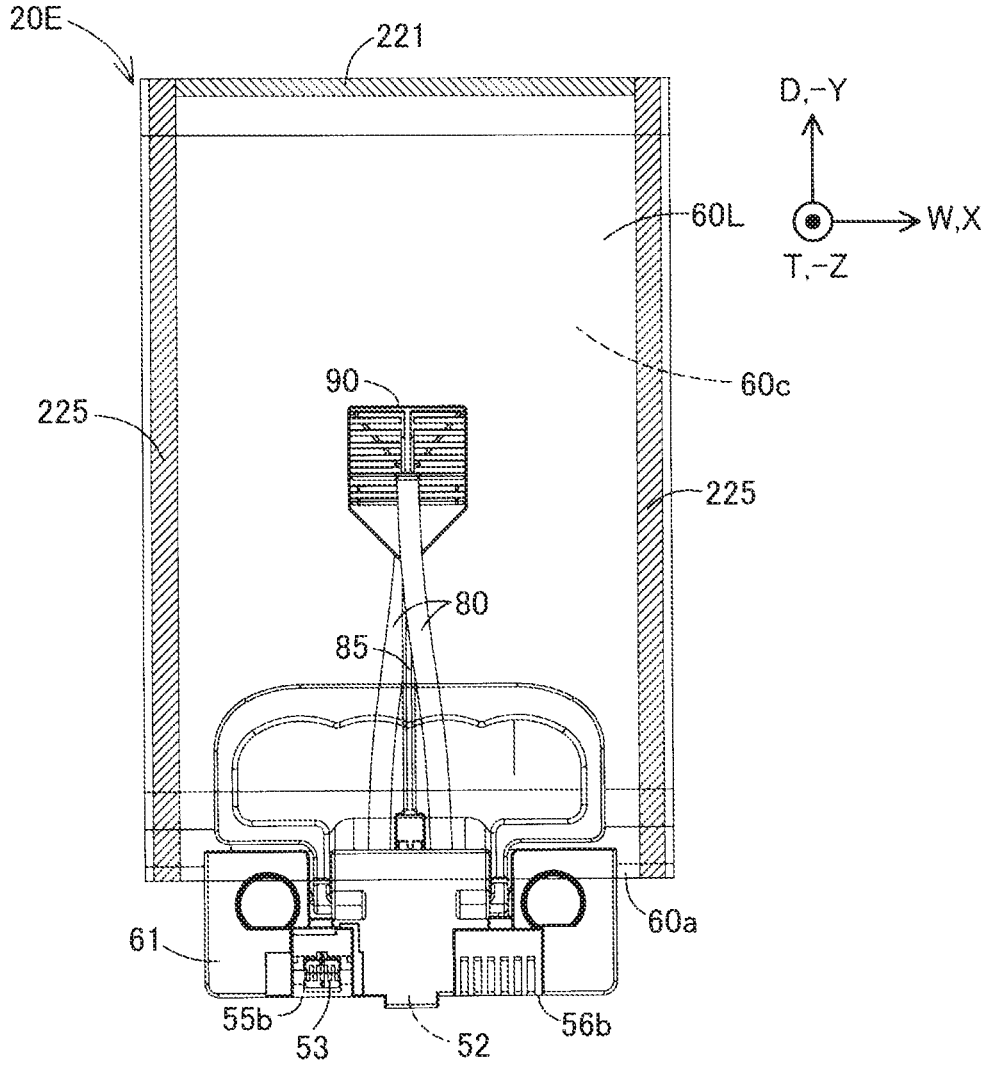
FIG. 28B is a schematic view showing a restored liquid storage body in the fifth embodiment.

FIGS. 28A and 28B are schematic views showing the contents in steps S20 to S40. In steps S20 to S40, liquid is injected into the bag 60L in processes similar to those described in the first embodiment. In step S20, the communication portion 211 is formed by cutting and removing a portion on the other end portion 60*b* side that is the end portion on the −Y direction side of the bag 60L (see FIG. 28A). In step S30, liquid is injected into the storage portion 60*c* using the injection device 300.

In step S40, a seal portion 221 at which the communication portion 211 is closed is formed in a region indicated with hatching in FIG. 28B, to seal the storage portion 60*c*. Accordingly, the restored liquid storage body 20E in the fifth embodiment is complete. Note that, in another embodiment, in steps S20 to S40, liquid may be injected into the bag 60L in the processes described in the second to fourth embodiments in place of the processes described in the first embodiment.

As described above, according to the manufacturing method of the fifth embodiment, it is possible to easily obtain the liquid storage body 20E whose liquid supply capability is restored, and whose size is reduced such that the liquid storage body 20E can be used in the liquid ejection apparatus 11 that has the small case 13. Besides, according to the restored liquid storage body 20E and the manufacturing method thereof in the fifth embodiment, it is possible to exert various actions and effects described in the first to fifth embodiments.

6. Sixth Embodiment

Figure 29:
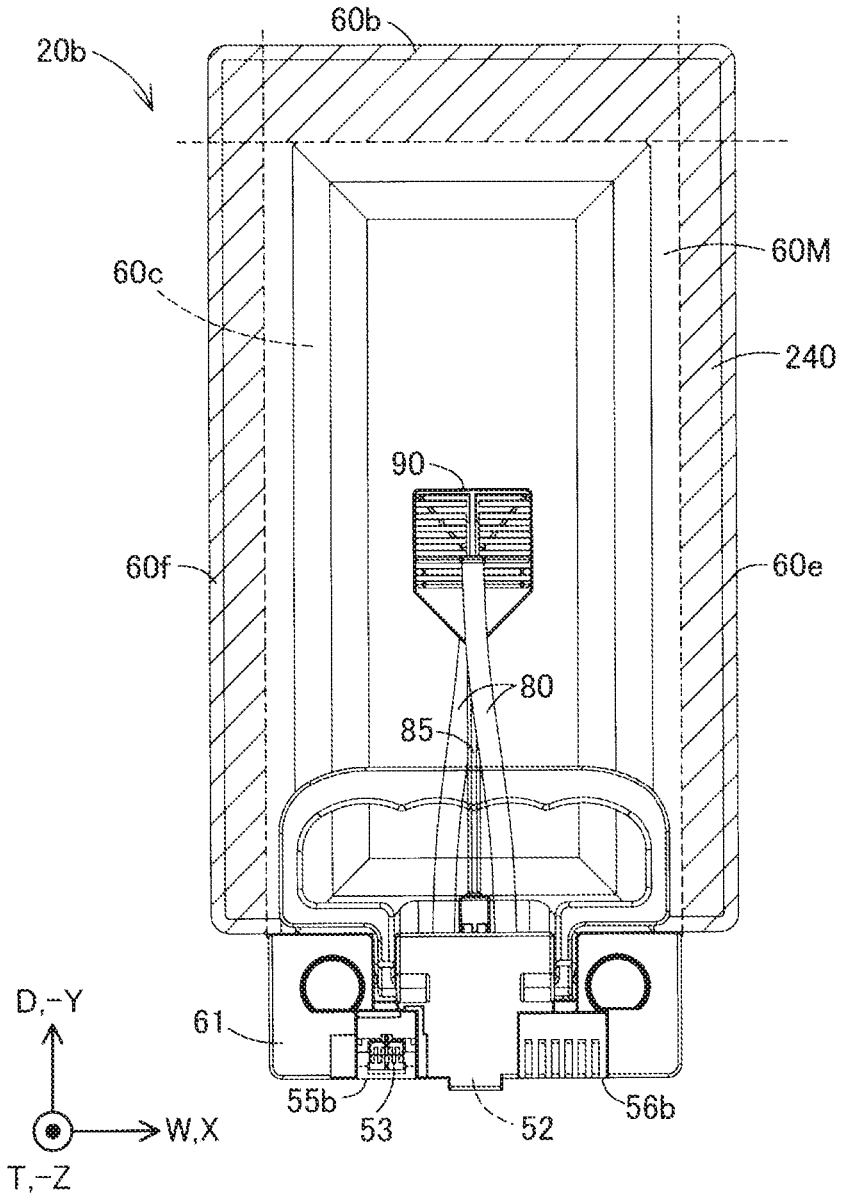
FIG. 29 is a schematic view showing a pre-restored liquid storage body in a sixth embodiment.

FIG. 29 is a schematic plan view of a liquid storage body 20*b* that is to be restored in a sixth embodiment, when viewed in the +Z direction. The configuration of the pre-restored liquid storage body 20*b* is substantially the same as the liquid storage body 20 of the first embodiment, except that a bag 60M that has an extra section 240 indicated by hatching is included.

The extra section 240 is a section that does not fit within the face of the bottom plate 67 of the case 13 and protrudes when a connection member 61 of the liquid storage body 20*b* engages with the engagement-receiving portion 65 of the case 13 (see FIGS. 4 and 5). The liquid storage body 20*b* is stored in the opening 13*a* of the case 13 as a result of the extra section 240 being folded in a direction toward a central portion of the bag 60M. In FIG. 29, positions at which the extra section 240 is folded are indicated by broken lines.

In the bag 60M, the other end portion 60*b*, a first side end portion 60*e*, and a second side end portion 60*f* that constitute the seal portion at which the storage portion 60*c* is sealed are included in the extra section 240. The inside of the extra section 240 constitutes a portion of the storage portion 60*c*. Note that, when the liquid storage body 20*b* is stored in the case 13, the extra section 240 is folded in a state where the liquid does not remain therein. Accordingly, liquid can be kept from remaining in the extra section 240. Liquid of an amount prescribed based on the volume of the storage portion 60*c* in a region enclosed by the extra section 240, excluding the volume of the storage portion 60*c* included in the extra section 240, is contained in the bag 60M of the liquid storage body 20*b*.

Figure 30:
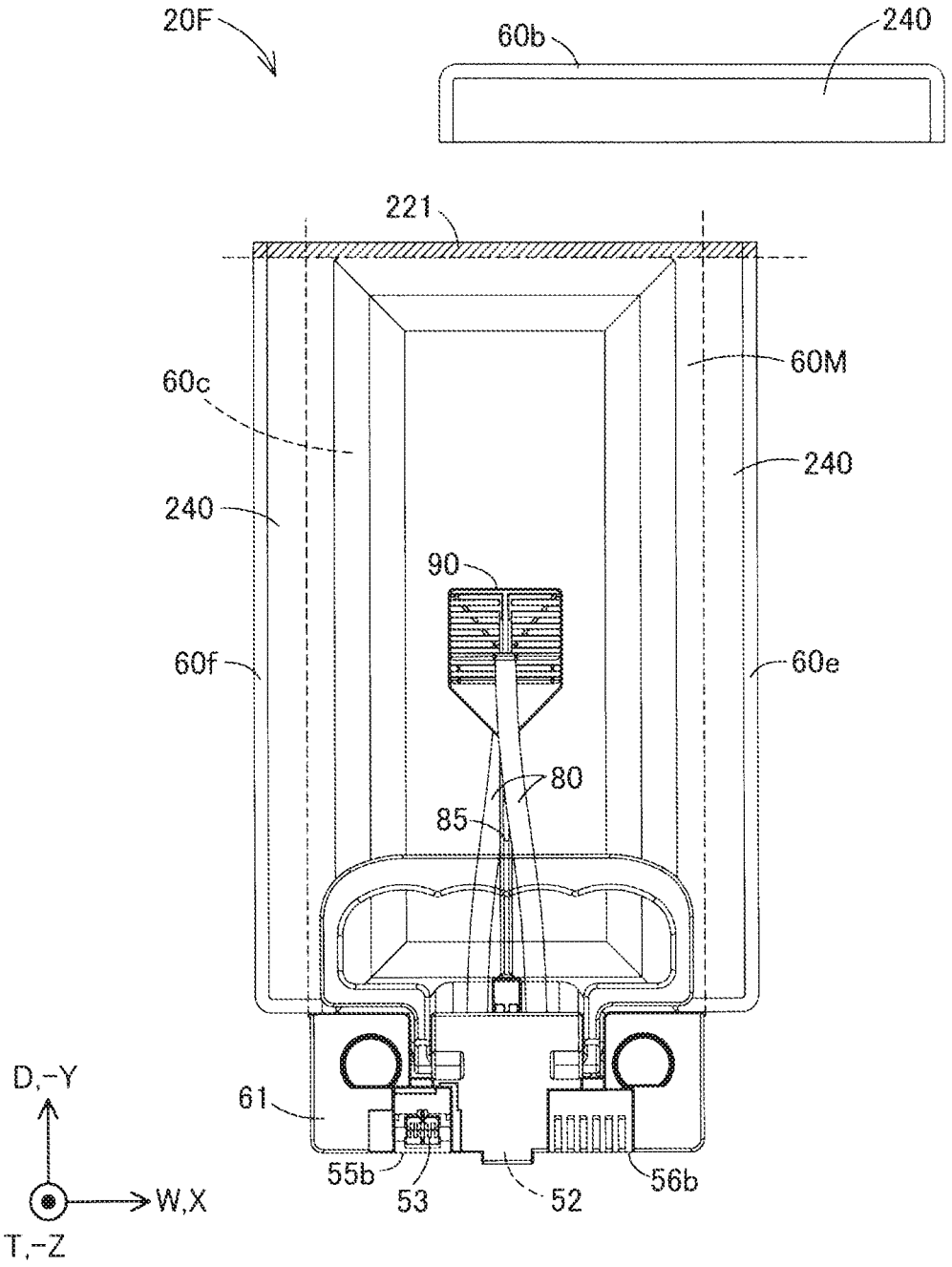
FIG. 30 is a schematic view showing a restored liquid storage body in the sixth embodiment.

FIG. 30 is a schematic plan view of a liquid storage body 20F of the sixth embodiment acquired by restoring the liquid storage body 20*b*, when viewed in the +Z direction. The restored liquid storage body 20F is manufactured in steps S10 to S40 that are similar to those described in the first embodiment, using the used liquid storage body 20*b*. In step S20, a communication portion 211 for injecting liquid is formed by cutting and removing at least a portion of the extra section 240 on the −Y direction side. Subsequently, a seal portion 221 at which the communication portion 211 is closed is formed at a position included in the extra section 240 on the −Y direction side. In steps S20 to S40, a configuration may be adopted in which the end portion 60*e* or 60*f* in the X direction or a corner portion C1 or C2 included in the extra section 240 is cut and removed, and liquid is injected, similar to the manufacturing processes in the second and third embodiments.

The liquid storage body 20F of the sixth embodiment is replenished with liquid by cutting and removing the extra section 240, in which liquid does not need to be contained. Therefore, even after the bag 60M was cut in order to form the communication portion 211, liquid of about the same amount as the pre-restored liquid storage body 20*b* can be contained. In addition, if the extra section 240 remains, steps S20 to S40 for restoring the liquid storage body 20E can be performed repeatedly while maintaining the volume of liquid that can be contained, the volume being about the same as the pre-restored liquid storage body 20*b*.

Besides, according to the restored liquid storage body 20F and the manufacturing method thereof in the sixth embodiment, it is possible to exert various actions and effects described in the first to sixth embodiments.

7. Other Working Examples

The various configurations described in the above embodiments can be modified as follows, for example. Other working examples that will be described below are all regarded as an example of a mode for carrying out the present disclosure, similar to the above embodiments.

(1) Other Working Example 1

In the above embodiments, the seal portions 221 to 223 at which the communication portions 211 to 213 are closed may be formed by attaching a member such as a tape, for example. In addition, in the fourth embodiment, the through hole 214 may be sealed through welding, instead of being sealed by the sealing member 224.

(2) Other Working Example 2

The configurations of the liquid storage bodies 20, 20*a*, 20*b*, and 20A to 20F of the above embodiments can also be applied to a liquid storage body that is mounted in any liquid ejection apparatus that ejects liquid other than ink. For example, the present disclosure can be applied to liquid storage bodies for the following various liquid ejection apparatuses.

(a) an image recording apparatus such as a facsimile apparatus, (b) a color material ejection apparatus used for manufacturing a color filter for an image display device such as a liquid crystal display, (c) an electrode material ejection apparatus used for forming an electrode of an organic EL (Electro Luminescence) display, a surface light emission display (Field Emission Display, FED) or the like, (d) a liquid ejection apparatus for ejecting a liquid containing a biological organic substance used for manufacturing a biochip, (e) a sample ejection apparatus as a precision pipette, (f) a lubricant oil ejection apparatus, (g) a resin liquid ejection apparatus, (h) a liquid ejection apparatus for ejecting lubricant oil onto a precision device such as a timepiece and a camera in a pin-point manner, (i) a liquid ejection apparatus for ejecting transparent resin liquid such as ultraviolet-curing resin liquid onto a substrate in order to form a microhemispherical lens (an optical lens) or the like used in an optical communication element or the like, (j) a liquid ejection apparatus for ejecting acidic or alkaline etching liquid in order to etch a substrate or the like, and (k) a liquid ejection apparatus provided with a liquid consumption head for discharging a very small amount of droplet of any other liquid.

Note that a "droplet" refers to a state of liquid discharged from a liquid ejection apparatus, and includes a granular shape, a tear-drop shape, and a shape having a thread-like trailing end. In addition, the "liquid" mentioned here may be any kind of material that can be consumed by the liquid ejection apparatus. For example, the "liquid" need only to be a material whose substance is in the liquid phase, and includes fluids such as an inorganic solvent, an organic solvent, a solution, a liquid resin, and a liquid metal (metal melt) in the form of a material in the state of liquid having a high or low viscosity, a sol, gel water, or the like. In addition, the "liquid" is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink.

8. Other Aspects

The present disclosure is not limited to the above embodiments and working examples and can be achieved as various aspects without departing from the gist of the present disclosure. For example, the present disclosure can be realized as the following aspects. The technical features in the above embodiments that correspond to the technical features in the modes described below may be replaced or combined as appropriate in order to solve a part of, or the entire problem of the present disclosure, or to achieve some or all of the effects of the present disclosure. The technical features that are not described as essential in the specification may be deleted as appropriate.

(1) A first aspect of the present disclosure is provided as a manufacturing method of a liquid storage body. A direction parallel to a gravity direction is defined as a Z direction, in which a direction that is the same as the gravity direction is defined as a +Z direction and a direction that is opposite to the gravity direction is defined as a −Z direction, a direction orthogonal to the Z direction is defined as a Y direction, in which one direction is defined as a +Y direction and another direction is defined as a −Y direction, and a direction orthogonal to the Z direction and the Y direction is defined as an X direction, in which one direction is defined as a +X direction and another direction is defined as a −X direction. The liquid storage body is attachable/detachable to/from a liquid ejection apparatus that includes a case storage portion, a case inserted into the case storage portion by moving toward the +Y direction, a liquid introduction portion positioned in an end portion on the +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion. The liquid storage body includes a flexible bag that contains a liquid, and a connection member positioned in an end portion on the +Y direction side of the bag in a mounted state where the liquid storage body is mounted in the liquid ejection apparatus. The connection member is provided with a liquid outlet port that receives the liquid introduction portion in the mounted state, and that is in communication with an internal space of the bag, a storage-body-side electrical connection portion that comes into electrical contact with the apparatus-side electrical connection portion while receiving force that has at least a component in the +Z direction from the apparatus-side electrical connection portion in the mounted state, a first receiving portion that receives the first positioning portion in the mounted state, and a second receiving portion that receives the second positioning portion in the mounted state. The first receiving portion is located on the −X direction from the liquid outlet port. The second receiving portion is located on the +X direction from the liquid outlet portion. The liquid storage body has a width in the Z direction of the liquid storage body which is smaller than a width in the Y direction and a width in the X direction.

The manufacturing method of this aspect includes preparing a pre-restored storage body that has the bag to which the connection member is attached, and that is thereby sealed; forming a communication portion that is in communication with the internal space of the bag, by processing the bag of the pre-restored storage body; injecting a liquid from the communication portion into the internal space of the bag; and closing the communication portion so as to seal the bag.

According to the manufacturing method of this aspect, by processing the bag of the liquid storage body used for liquid supply in the liquid ejection apparatus, the liquid supply performance can be easily restored. Therefore, the liquid storage body removed from the liquid ejection apparatus can be kept from being discarded as is.

(2) A second aspect of the present disclosure is provided as a restored liquid storage body. A direction parallel to a gravity direction is defined as a Z direction, in which a direction that is the same as the gravity direction is defined as a +Z direction and a direction that is opposite to the gravity direction is defined as a −Z direction, a direction orthogonal to the Z direction is defined as a Y direction, in which one direction is defined as a +Y direction and another direction is defined as a −Y direction, and a direction orthogonal to the Z direction and the Y direction is defined as an X direction, in which one direction is defined as a +X direction and another direction is defined as a −X direction.

The restored liquid storage body of this aspect is acquired by restoring a liquid storage body that is attachable/detachable to/from a liquid ejection apparatus that includes a case storage portion, a case inserted into the case storage portion by moving toward the +Y direction, a liquid introduction portion positioned in an end portion on the +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion. The liquid storage body includes a flexible bag that contains a liquid, and a connection member positioned in an end portion on the +Y direction side of the bag in a mounted state where the liquid storage body is mounted in the liquid ejection apparatus. The connection member is provided with a liquid outlet port that receives the liquid introduction portion is inserted in the +Y direction in the mounted state, a storage-body-side electrical connection portion that comes into electrical contact with the apparatus-side electrical connection portion while receiving force that has at least a component in the +Z direction from the apparatus-side electrical connection portion in the mounted state, a first receiving portion that receives the first positioning portion in the mounted state, and a second receiving portion that receives the second positioning portion in the mounted state. The first receiving portion is located on the −X direction from the liquid outlet port. The second receiving portion is located on the +X direction from the liquid outlet portion. The liquid storage body has a width in the Z direction of the liquid storage body which is smaller than a width in the Y direction and a width in the X direction. The bag has a section in an end portion on a −Y direction side, the section is positioned on the +Y direction side relative to the end portion on the −Y direction side of a bag of the pre-restored liquid storage body, in the mounted state.

The restored liquid storage body in this aspect is acquired by restoring a pre-restored liquid storage body, simply by cutting and removing the end portion on the −Y direction side of the bag. Regarding this restored liquid storage body, the pre-restored liquid storage body is reused without constituent parts thereof being discarded.

(3) A third aspect of the present disclosure is provided as a restored liquid storage body. A direction parallel to a gravity direction is defined as a Z direction, in which a direction that is the same as the gravity direction is defined as a +Z direction and a direction that is opposite to the gravity direction is defined as a −Z direction, a direction orthogonal to the Z direction is defined as a Y direction, in which one direction is defined as a +Y direction and another direction is defined as a −Y direction, and a direction orthogonal to the Z direction and the Y direction is defined as an X direction, in which one direction is defined as a +X direction and another direction is defined as a −X direction.

The restored liquid storage body of this aspect is acquired by restoring a liquid storage body that is attachable/detachable to/from a liquid ejection apparatus that includes a case storage portion, a case inserted into the case storage portion by moving toward the +Y direction, a liquid introduction portion positioned in an end portion on the +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion. The liquid storage body includes a flexible bag that contains a liquid, and a connection member positioned in an end portion on the +Y direction side of the bag in a mounted state where the liquid storage body is mounted in the liquid ejection apparatus. The connection member is provided with a liquid outlet port that receives the liquid introduction portion in the mounted state, a storage-body-side electrical connection portion that comes into electrical contact with the apparatus-side electrical connection portion while receiving force that has at least a component in the +Z direction from the apparatus-side electrical connection portion in the mounted state, a first receiving portion that receives the first positioning portion in the mounted state, and a second receiving portion that receives the second positioning portion in the mounted state. The first receiving portion is located on the −X direction from the liquid outlet port. The second receiving portion is located on the +X direction from the liquid outlet portion. The liquid storage body has a width in the Z direction of the liquid storage body which is smaller than a width in the Y direction and a width in the X direction. The bag has a section in at least one of an end portion on a +X direction side and an end portion on a −X direction side, the section positioned closer to the liquid outlet port side relative to an end portion in a bag of the pre-restored liquid storage body, in the mounted state.

The restored liquid storage body in this aspect is acquired by restoring a pre-restored liquid storage body, simply by cutting and removing an end portion in the X direction of the bag. Regarding this restored liquid storage body, the pre-restored liquid storage body is reused without constituent parts thereof being discarded.

(4) A fourth aspect of the present disclosure is provided as a restored liquid storage body. A direction parallel to a gravity direction is defined as a Z direction, in which a direction that is the same as the gravity direction is defined as a +Z direction and a direction that is opposite to the gravity direction is defined as a −Z direction, a direction orthogonal to the Z direction is defined as a Y direction, in which one direction is defined as a +Y direction and another direction is defined as a −Y direction, and a direction orthogonal to the Z direction and the Y direction is defined as an X direction, in which one direction is defined as a +X direction and another direction is defined as a −X direction.

The restored liquid storage body of this aspect is acquired by restoring a liquid storage body that is attachable/detachable to/from a liquid ejection apparatus that includes a case storage portion, a case inserted into the case storage portion by moving toward the +Y direction, a liquid introduction portion positioned in an end portion on the +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion. The liquid storage body includes a flexible bag that contains a liquid, and a connection member positioned in an end portion on the +Y direction side of the bag in a mounted state where the liquid storage body is mounted in the liquid ejection apparatus. The connection member is provided with a liquid outlet port that receives the liquid introduction portion in the mounted state, a storage-body-side electrical connection portion that comes into electrical contact with the apparatus-side electrical connection portion while receiving force that has at least a component in the +Z direction from the apparatus-side electrical connection portion in the mounted state, a first receiving portion that receives the first positioning portion in the mounted state, and a second receiving portion that receives the second positioning portion in the mounted state. The first receiving portion is located on the −X direction from the liquid outlet port. The second receiving portion is located on the +X direction from the liquid outlet portion. The liquid storage body has a width in the Z direction of the liquid storage body which is smaller than a width in the Y direction and a width in the X direction. The bag has a seal portion that seals the internal space thereof; and the seal portion has a section formed at a position different from a seal portion on a bag of the pre-restored liquid storage body.

The restored liquid storage body in this aspect is acquired by restoring a pre-restored liquid storage body, simply by processing the bag of the pre-restored liquid storage body so as to change the position of the sealing portion. Regarding this restored liquid storage body, the pre-restored liquid storage body is reused without constituent parts thereof being discarded.

(5) In the restored liquid storage body of the above aspect, the seal portion constitutes the end portion on the +X direction side, the end portion on the −X direction side, and the end portion on the −Y direction side of the bag in the mounted state, and, in the bag, at least one of a section between the end portion on the +X direction side and the end portion on the −Y direction side in the mounted state and a section between the end portion on the −X direction side and the end portion on the −Y direction side in the mounted state may have a shape in which a corner portion of the bag in the pre-restored liquid storage body is cut off.

The restored liquid storage body of this aspect is acquired by restoring a pre-restored liquid storage body, simply by cutting off a corner portion of the bag.

(6) A fifth aspect of the present disclosure is provided as a restored liquid storage body. A direction parallel to a gravity direction is defined as a Z direction, in which a direction that is the same as the gravity direction is defined as a +Z direction and a direction that is opposite to the gravity direction is defined as a −Z direction, a direction orthogonal to the Z direction is defined as a Y direction, in which one direction is defined as a +Y direction and another direction is defined as a −Y direction, and a direction orthogonal to the Z direction and the Y direction is defined as an X direction, in which one direction is defined as a +X direction and another direction is defined as a −X direction.

The restored liquid storage body of this aspect is acquired by restoring a liquid storage body that is attachable/detachable to/from a liquid ejection apparatus that includes a case storage portion, a case inserted into the case storage portion by moving toward the +Y direction, a liquid introduction portion positioned in an end portion on the +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion. The liquid storage body includes a flexible bag, and a connection member positioned in an end portion on the +Y direction side of the bag in a mounted state where the liquid storage body is mounted in the liquid ejection apparatus. The connection member is provided with a liquid outlet port that receives the liquid introduction portion in the mounted state, a storage-body-side electrical connection portion that comes into electrical contact with the apparatus-side electrical connection portion while receiving force that has at least a component in the +Z direction from the apparatus-side electrical connection portion in the mounted state, a first receiving portion that receives the first positioning portion in the mounted state, and a second receiving portion that receives the second positioning portion in the mounted state. The first receiving portion is located on the −X direction from the liquid outlet port. The second receiving portion is located on the +X direction from the liquid outlet portion. The liquid storage body has a width in the Z direction of the liquid storage body which is smaller than a width in the Y direction and a width in the X direction. The bag has an internal space in which a liquid is contained, a through hole that is in communication with the internal space, and a seal portion that seals the through hole, the through hole does not exist in a bag of the pre-restored liquid storage body.

The restored liquid storage body of this aspect is acquired by restoring a pre-restored liquid storage body, by injecting liquid into the bag of the pre-restored liquid storage body through a through hole formed in the bag, and then sealing the through hole. Regarding this restored liquid storage body, the pre-restored liquid storage body is reused without constituent parts thereof being discarded. In addition, the volume of the internal space of the bag after restoration is kept from decreasing from the volume of the internal space of the bag before restoration.

The present disclosure can be achieved in various aspects other than a manufacturing method of a liquid storage body and a restored liquid storage body. For example, the present disclosure can be achieved in aspects of a method for restoring a liquid storage body, a method for replenishing a liquid storage body with liquid, a method for remodeling a liquid storage body, a liquid ejection system in which a liquid storage body is restored and repeatedly used, and the like.

What is claimed is:

1. A manufacturing method of a liquid storage body that is attachable/detachable to/from a liquid ejection apparatus including a case storage portion, a case inserted into the case storage portion by moving toward a +Y direction, a liquid introduction portion positioned in an end portion on a +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion, the liquid storage body including:

a flexible bag that contains a liquid, the bag having an opening portion, a through hole, and a seal portion, the opening portion being disposed at the end portion on the +Y direction side of the bag, the through hole being disposed at a position different from the opening portion, and the seal portion being disposed so as to cover the through hole; and a connection member positioned at the end portion on the +Y direction side of the bag in a mounted state where the liquid storage body is mounted in the liquid ejection apparatus, the connection member including:

a liquid outlet port that receives the liquid introduction portion in the mounted state, and that is in communication with an internal space of the bag, a storage-body-side electrical connection portion that comes into electrical contact with the apparatus-side electrical connection portion while receiving force that has at least a component in a +Z direction from the apparatus-side electrical connection portion in the mounted state, a first receiving portion that receives the first positioning portion in the mounted state, the first receiving portion is located on a −X direction from the liquid outlet port, and a second receiving portion that receives the second positioning portion in the mounted state, the second receiving portion is located on a +X direction from the liquid outlet port, the liquid storage body having a width in a Z direction being smaller than a width in a Y direction and a width in an X direction in an orientation in the mounted state, the manufacturing method comprising:

preparing a pre-restored storage body that has the bag to which the connection member is attached, and that is thereby sealed;

forming a communication portion that is in communication with the internal space of the bag, by processing the bag of the pre-restored storage body;

injecting the liquid from the communication portion into the internal space of the bag; and closing the communication portion so as to seal the bag, wherein a direction parallel to a gravity direction is defined as the Z direction, in which a direction that is the same as the gravity direction is defined as the +Z direction and a direction that is opposite to the gravity direction is defined as a −Z direction, a direction orthogonal to the Z direction is defined as the Y direction, in which one direction is defined as the +Y direction and another direction is defined as a −Y direction, and a direction orthogonal to the Z direction and the Y direction is defined as the X direction, in which one direction is defined as the +X direction and another direction is defined as the −X direction.

2. A restored liquid storage body acquired by restoring a pre-restored liquid storage body that is attachable/detachable to/from a liquid ejection apparatus including, a case storage portion, a case inserted into the case storage portion by moving toward a +Y direction, a liquid introduction portion positioned in an end portion on a +Y direction side of the case storage portion, an apparatus-side electrical connection portion positioned in the end portion on the +Y direction side of the case storage portion, and a first positioning portion and a second positioning portion positioned in the end portion on the +Y direction side of the case storage portion, the restored liquid storage body including:

a flexible bag that contains a liquid, the bag having an opening portion, a through hole, and a seal portion, the opening portion being disposed at the end portion on the +Y direction side of the bag, the through hole being disposed at a position different from the opening portion, and the seal portion being disposed so as to cover the through hole; and a connection member positioned at the end portion on the +Y direction side of the bag in a mounted state where the restored liquid storage body is mounted in the liquid ejection apparatus, the connection member including:

a liquid outlet port that receives the liquid introduction portion in the mounted state, a storage-body-side electrical connection portion that comes into electrical contact with the apparatus-side electrical connection portion while receiving force that has at least a component in a +Z direction from the apparatus-side electrical connection portion in the mounted state, a first receiving portion that receives the first positioning portion in the mounted state, the first receiving portion is located on a −X direction from the liquid outlet port, and a second receiving portion that receives the second positioning portion in the mounted state, the second receiving portion is located on a +X direction from the liquid outlet port, the restored liquid storage body having a width in a Z direction being smaller than a width in a Y direction and a width in an X direction in an orientation in the mounted state, wherein a direction parallel to a gravity direction is defined as the Z direction, in which a direction that is the same as the gravity direction is defined as the +Z direction and a direction that is opposite to the gravity direction is defined as a −Z direction, a direction orthogonal to the Z direction is defined as the Y direction, in which one direction is defined as the +Y direction and another direction is defined as the −Y direction, and a direction orthogonal to the Z direction and the Y direction is defined as the X direction, in which one direction is defined as the +X direction and another direction is defined as the −X direction.

3. A restored liquid storage body acquired by restoring a pre-restored liquid storage body that is attachable/detachable to/from a liquid ejection apparatus including a case storage portion, a case inserted into the case storage portion by moving toward a +Y direction, a liquid introduction portion positioned in an end portion on a +Y direction side of the case storage portion, an apparatus-side electrical connection portion positioned in the end portion on the +Y direction side of the case storage portion, the restored liquid storage body including:

a flexible bag that contains a liquid, the bag having an opening portion, a through hole, and a seal portion, the opening portion being disposed at the end portion on the +Y direction side of the bag, the through hole being disposed at a position different from the opening portion, and the seal portion being disposed so as to cover the through hole; and a connection member positioned at the end portion on the +Y direction side of the bag in a mounted state where the restored liquid storage body is mounted in the liquid ejection apparatus, the connection member including:

a liquid outlet port that receives the liquid introduction portion in the mounted state, a storage-body-side electrical connection portion that comes into electrical contact with the apparatus-side electrical connection portion while receiving force that has at least a component in a +Z direction from the apparatus-side electrical connection portion in the mounted state, a first receiving portion that receives the first positioning portion in the mounted state, the first receiving portion is located on a −X direction from the liquid outlet port, and a second receiving portion that receives the second positioning portion in the mounted state, the second receiving portion is located on a +X direction from the liquid outlet port, the restored liquid storage body having a width in a Z direction being smaller than a width in a Y direction and a width in an X direction in an orientation in the mounted state, wherein a direction parallel to a gravity direction is defined as the Z direction, in which a direction that is the same as the gravity direction is defined as the +Z direction and a direction that is opposite to the gravity direction is defined as a −Z direction, a direction orthogonal to the Z direction is defined as the Y direction, in which one direction is defined as the +Y direction and another direction is defined as a −Y direction, and a direction orthogonal to the Z direction and the Y direction is defined as the X direction, in which one direction is defined as the +X direction and another direction is defined as the −X direction.

* * * * *